US010964209B2

(12) United States Patent
Publicover et al.

(10) Patent No.: US 10,964,209 B2
(45) Date of Patent: Mar. 30, 2021

(54) METHOD AND SYSTEM FOR TRAFFIC AND PARKING MANAGEMENT

(71) Applicants: Mark W. Publicover, Saratoga, CA (US); William Knight Foster, Saratoga, CA (US)

(72) Inventors: Mark W. Publicover, Saratoga, CA (US); William Knight Foster, Saratoga, CA (US)

( * ) Notice: Subject to any disclaimer, the term of this patent is extended or adjusted under 35 U.S.C. 154(b) by 0 days.

(21) Appl. No.: 16/666,281

(22) Filed: Oct. 28, 2019

(65) Prior Publication Data

US 2020/0242924 A1 Jul. 30, 2020

Related U.S. Application Data

(63) Continuation-in-part of application No. 15/805,027, filed on Nov. 6, 2017, now Pat. No. 10,460,601, which is a continuation of application No. 14/878,918, filed on Oct. 8, 2015, now Pat. No. 9,812,009, application No. 16/666,281, which is a continuation-in-part of application No. 14/676,714, filed on Apr. 1, 2015, and a continuation of application No. 13/155,376, filed on Jun. 7, 2011,
(Continued)

(51) Int. Cl.

| | |
|---|---|
| ***G08G 1/095*** | (2006.01) |
| ***G08G 1/0965*** | (2006.01) |
| ***G08G 1/0962*** | (2006.01) |
| ***G08G 1/0967*** | (2006.01) |
| ***G08G 1/087*** | (2006.01) |

(52) U.S. Cl.
CPC ..... *G08G 1/095* (2013.01); *G08G 1/087* (2013.01); *G08G 1/0962* (2013.01); *G08G 1/0965* (2013.01); *G08G 1/096716* (2013.01); *G08G 1/096725* (2013.01); *G08G 1/096758* (2013.01); *G08G 1/096775* (2013.01); *G08G 1/096791* (2013.01)

(58) Field of Classification Search
None
See application file for complete search history.

(56) References Cited

U.S. PATENT DOCUMENTS 3,509,525 A 4/1970 Levine et al.
5,231,393 A 7/1993 Strickland
(Continued)

*Primary Examiner* — Brent Swarthout
(74) *Attorney, Agent, or Firm* — Klarquist Sparkman, LLP

(57) ABSTRACT

A traffic and parking management system is in signal communication with vehicles to direct them to park in specific locations that are under the systems authority. The system tracks and determines the availability of parking spaces via a digital camera network, and then allocates spaces based on need, predicted availability, and predicted arrival time at a preferred destination or vicinity. The vehicles are directed to the space so allocated, and in the case of a pay for parking system, billed by the system. The traffic and parking management system operates in conjunction with a smart traffic control device which transmits information to approaching vehicles regarding its current and future state enabling vehicles to control their speed to avoid arriving at the traffic control device until it permits the passage of traffic, thus avoiding stopping, idling and reaccelerating when reaching the traffic control device.

7 Claims, 29 Drawing Sheets

Related U.S. Application Data now Pat. No. 9,196,158, which is a continuation of application No. 12/974,598, filed on Dec. 21, 2010, now abandoned, which is a continuation of application No. 12/642,724, filed on Dec. 18, 2009, now abandoned, which is a continuation of application No. 11/861,158, filed on Sep. 25, 2007, now Pat. No. 7,663,505, which is a continuation-in-part of application No. 11/015,592, filed on Dec. 16, 2004, now Pat. No. 7,274,306.

(60) Provisional application No. 61/974,425, filed on Apr. 2, 2014, provisional application No. 60/532,484, filed on Dec. 24, 2003.

(56) References Cited

U.S. PATENT DOCUMENTS

| | | | |
|---|---|---|---|
| 5,926,113 | A | 7/1999 | Jones et al. |
| 6,150,961 | A | 11/2000 | Alewine et al. |
| 6,204,778 | B1 | 3/2001 | Bergan et al. |
| 6,356,820 | B1 | 3/2002 | Hashimoto |
| 6,377,191 | B1 | 4/2002 | Takubo |
| 6,437,688 | B1 | 8/2002 | Kobayashi |
| 6,442,473 | B1 | 8/2002 | Berstis et al. |
| 6,463,900 | B1 | 10/2002 | Wakabayashi et al. |
| 6,516,273 | B1 | 2/2003 | Pierowicz et al. |
| 6,535,142 | B2 | 3/2003 | Wakabayashi et al. |
| 6,708,085 | B2 | 3/2004 | Yamane et al. |
| 6,728,623 | B2 | 4/2004 | Takenaga et al. |
| 6,765,495 | B1 | 7/2004 | Dunning et al. |
| 6,807,464 | B2 | 10/2004 | Yu et al. |
| 6,900,740 | B2 | 5/2005 | Bloomquist et al. |
| 6,958,707 | B1 | 10/2005 | Siegel |
| 6,965,829 | B2 | 11/2005 | Yamadaji et al. |
| 6,985,089 | B2 | 1/2006 | Liu et al. |
| 6,985,090 | B2 | 1/2006 | Ebner et al. |
| 6,985,827 | B2 | 1/2006 | Williams et al. |
| 6,989,766 | B2 | 1/2006 | Mese et al. |
| 6,999,001 | B2 | 2/2006 | Kojima |
| 7,050,903 | B1 | 5/2006 | Shutter et al. |
| 7,148,813 | B2 | 12/2006 | Bauer |
| 7,149,696 | B2 | 12/2006 | Shimizu et al. |
| 7,274,306 | B2 | 9/2007 | Publicover |
| 7,382,274 | B1 | 6/2008 | Kermani et al. |
| 7,383,121 | B2 | 6/2008 | Shinada |
| 7,474,232 | B2 | 1/2009 | Chen et al. |
| 7,663,505 | B2 | 2/2010 | Publicover |
| 7,711,485 | B2 | 5/2010 | Matsumoto |
| 8,204,688 | B2 | 6/2012 | Cabral et al. |
| 9,196,158 | B2 | 11/2015 | Publicover |
| 9,685,085 | B2 | 6/2017 | Krivacic et al. |
| 9,812,009 | B2 | 11/2017 | Publicover |
| 2003/0063015 | A1 | 4/2003 | Ebner et al. |
| 2003/0191577 | A1 | 10/2003 | Decaux |
| 2004/0254840 | A1 | 12/2004 | Slemmer et al. |
| 2006/0155427 | A1* | 7/2006 | Yang ..... G08G 1/081 701/1 |
| 2006/0181433 | A1 | 8/2006 | Wolterman |
| 2008/0048885 | A1 | 2/2008 | Quinn |
| 2011/0068950 | A1 | 3/2011 | Flaherty |
| 2011/0320256 | A1 | 12/2011 | Florucci et al. |
| 2012/0095812 | A1 | 4/2012 | Stefik et al. |
| 2012/0130891 | A1 | 5/2012 | Bogaard et al. |
| 2012/0245966 | A1 | 9/2012 | Volz |
| 2013/0268187 | A1 | 10/2013 | Scofield et al. |
| 2014/0316865 | A1 | 10/2014 | Okamoto |
| 2014/0340241 | A1 | 11/2014 | Smart, Jr. |
| 2014/0372155 | A1 | 12/2014 | Wang et al. |
| 2015/0127191 | A1* | 5/2015 | Misra ..... G08G 1/143 701/1 |
| 2016/0042643 | A1 | 2/2016 | Hohenacker |
| 2016/0163200 | A1 | 6/2016 | He et al. |
| 2017/0293296 | A1 | 10/2017 | Stenneth et al. |
| 2018/0301031 | A1* | 10/2018 | Naamani ..... G06K 9/4604 |
| 2020/0280829 | A1* | 9/2020 | Benefield ..... H04W 4/46 |

* cited by examiner

METHOD AND SYSTEM FOR TRAFFIC AND PARKING MANAGEMENT

CROSS REFERENCE TO RELATED APPLICATIONS

This application is a continuation-in-part of U.S. patent application Ser. No. 14/676,714 filed Apr. 1, 2015 which claims the benefit of U.S. Provisional Application No. 61/974,425, filed Apr. 2, 2014. This application is also a continuation-in-part of U.S. patent application Ser. No. 15/805,027, filed Nov. 6, 2017, now U.S. Pat. No. 10,460,601, which is a continuation of U.S. patent application Ser. No. 14/878,918, filed Oct. 8, 2015, now U.S. Pat. No. 9,812,009, which is a continuation of U.S. patent application Ser. No. 13/155,376, filed Jun. 7, 2011, now U.S. Pat. No. 9,196,158, which is a continuation of U.S. patent application Ser. No. 12/974,598, filed Dec. 21, 2010, now abandoned, which is a continuation of U.S. patent application Ser. No. 12/642,724, filed Dec. 18, 2009, now abandoned, which is a continuation of U.S. patent application Ser. No. 11/861,158, filed Sep. 25, 2007, now U.S. Pat. No. 7,663,505, which is a continuation-in-part of U.S. patent application Ser. No. 11/015,592, filed Dec. 16, 2004, now U.S. Pat. No. 7,274,306, which claims the benefit of U.S. Provisional Application No. 60/532,484, filed Dec. 24, 2003. The prior applications are incorporated herein by reference in their entirety.

FIELD

This invention relates to vehicle traffic control, including identifying and directing vehicles to parking locations.

BACKGROUND

A great deal of city and urban traffic is created by vehicles searching for parking spaces. This results in traffic congestion, lost time and productivity, as well as more air pollution. Further, in many urban areas, private parking spaces are frequently empty but not available to the public, because the usage of such spaces by the owner is not known in advance or is unpredictable and there is not an easy communication mechanism between the public and the owner. Moreover, with respect to traffic flow, while traffic lights work effectively to allow for the safe passage of vehicles through intersections, they have limited capabilities to manage traffic flow in their current configuration. Some traffic lights operate in response to detecting the relative traffic volume in the cross streets they regulate, providing a greater interval of time for vehicles to pass in proportion to the higher traffic load in one direction, with a shorter travel interval to the opposing traffic. However, even when traffic lights are optimally efficient to manage a difference in traffic flow on second by second needs basis, vehicles are necessarily stopped in lines at the traffic light for some period of time, creating traffic congestion. Moreover, increasing population density has generated growing traffic congestion problems that increase air pollution and fuel.

Turning to freeways, typical freeway traffic consists of vehicles traveling at self-managed speeds. When freeway traffic increases, vehicles tend to bunch up in continuous and relatively regular spacing and the rate of speed decreases. In these cases, driver error or lag from driver reaction time is compounded as each vehicle that, in the system described herein, this traffic flow method can alleviate traffic congestion and improve overall traffic flow. The idea of controlling traffic on expressways by timing lights is well known in the art. Simple traffic light coordination schemes that have previously been implemented do not have the ability to actively manage the speed and routing of traffic to eliminate the waste of stopped vehicles and ensure peak flow rates. Accordingly, the inability to better coordinate individual vehicle speeds on roads with intersections is a major cause of traffic congestion, air pollution, and fuel inefficiency.

As can be seen from the foregoing, there is a need for improved methods and systems for managing vehicles to reduce traffic congestion and improve the efficiency by which vehicle movement is managed and controlled and furthermore to improve the manner in which parking spaces are dynamically identified and allocated for vehicles.

SUMMARY

Embodiments disclosed herein provide computerized methods and systems that operate to improve management of vehicle parking, thereby providing multiple benefits. Vehicles spend less time looking for parking spaces, and the distance between the ultimate destination and the parking location is minimized. The result is reduced traffic as well as reduced energy consumption. Driver anxiety of being able to find an empty/available parking space is reduced and safety for the driver, passenger(s), pedestrians and cyclists is improved as drivers are not distracted looking for available parking. The embodiments disclosed herein also enable municipalities to dynamically allocate parking and the associated pricing. Moreover, the disclosed embodiments permit allocation of private property, such as a driveway, by the property owner for usage by others.

In one embodiment, parking space allocation is accomplished by transmitting at least one of a target location and vicinity objective from a vehicle to a control system, calculating an arrival time in the vicinity, calculating an arrival time at prospective parking locations expected to be empty within the vicinity, comparing arrival times at alternative locations, determining an allocation to a user based on the comparison and optionally user preferences, and communicating the identity of the allocated space via a location and instructions that aid in arrival at the appropriate time. The accuracy of the calculated arrival time in the vicinity is increased by utilization of the traffic control system, such as by the assignment to one or more pods during travel along the vehicle route to facilitate uncongested traversal to and from a parking space allocation. In situations where the predicted arrival time would result in a predicted wait upon arrival until a prospective parking location is expected to be empty, the vehicle's average speed may be reduced, such as by assigning to slower moving pods, resulting in fuel conservation an estimated arrival time that is closer to the predicted time the prospective parking location being vacated. Additional features include determining and managing fees, rebates, departure times, parking restrictions, public or private parking spaces and prospective parking locations meeting a criteria of either currently vacant or expected to be vacant at a calculated arrival time.

Certain embodiments incorporate a process for improving the traffic flow on roads that utilize lights and signage to control the flow of vehicles through intersections. It can also improve traffic flow on highways and freeways where lights and signage are reduced or non-existent. Such embodiments can provide for more fuel-efficient transportation on roads utilizing traffic lights and signage at intersections. Such embodiments can provide for more fuel-efficient transportation on freeways and roads without traffic lights, especially during periods of heavy traffic. Such embodiments can increase transportation system capacity with minimum capital cost and taking of land for infrastructure. Moreover, such embodiments can improve safety by more effectively regulating and coordinating the flow of traffic through intersections and on freeways.

Additional aspects related to the invention will be set forth in part in the description which follows, and in part will be apparent to those skilled in the art from the description or may be learned by practice of the invention. Aspects of the invention may be realized and attained by means of the elements and combinations of various elements and aspects particularly pointed out in the following detailed description and the appended claims.

It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive techniques. Specifically.

DETAILED DESCRIPTION

1. Table of Contents

Figure 1:
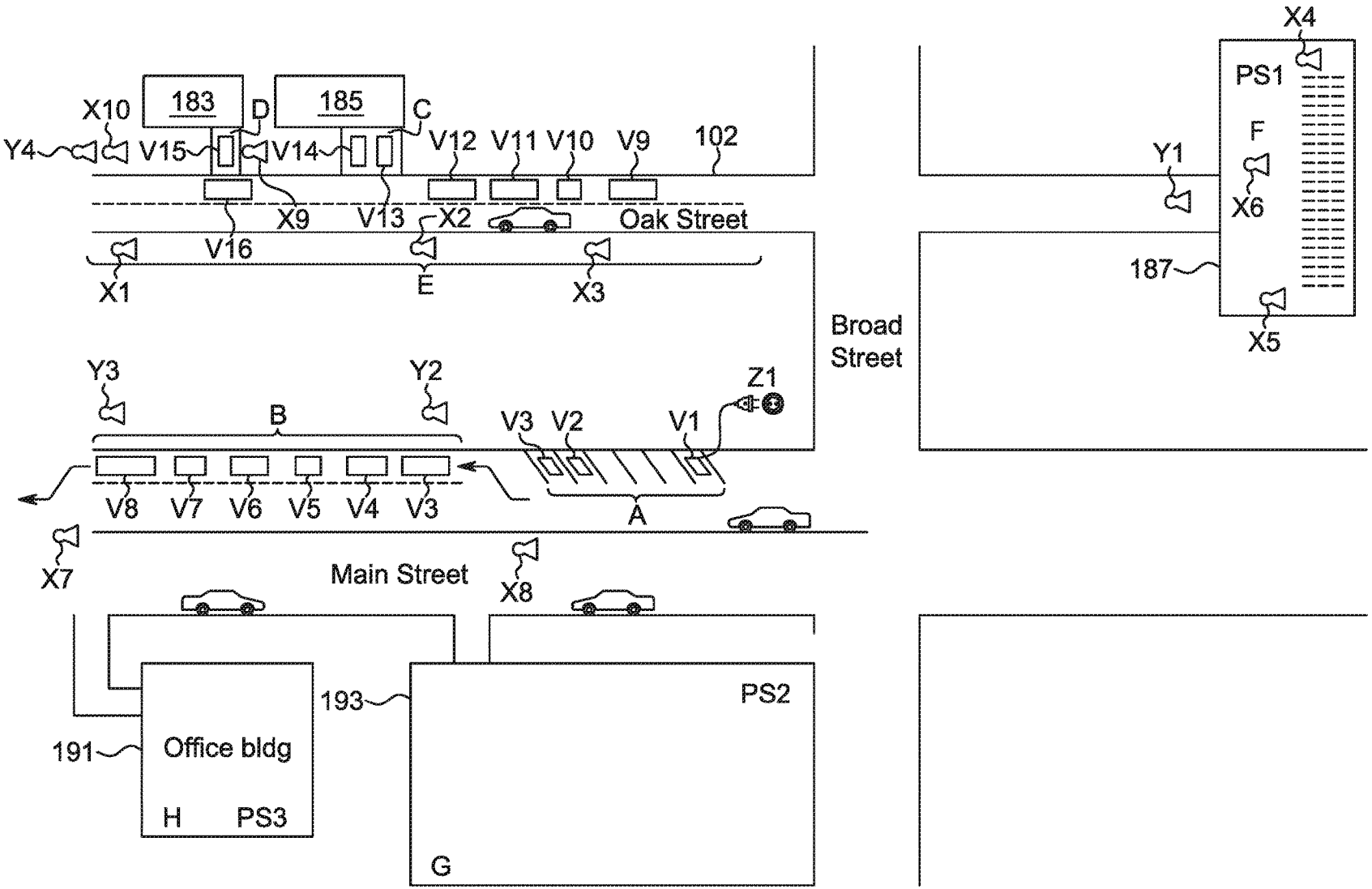
FIG. 1 shows a simplified illustration of city streets and a variety of Parking Spaces and structures to facilitate understanding of the operation of the Traffic Parking Management System described herein.

| | | |
|---|---|---|
| 1. | Table of Contents | 6 |
| 2. | Key Terms | 7 |
| 3. | Overview | 8 |
| 4. | Hardware Overview | 11 |
| 5. | Parking Spaces | 19 |
| 6. | Parking Space Identification and Allocation | 27 |
| 7. | Repositioning of Parked Vehicles | 33 |
| 8. | Priority | 39 |
| 9. | Selective Deployment | 41 |
| 10. | Management of Private Parking Spaces | 43 |
| 11. | Availability Prediction | 45 |
| 12. | Parking System Controller (PSC) | 48 |
| 13. | Additional TPMS Functions | 54 |
| 14. | Traffic Management Device and System | 63 |

2. Key Terms

Certain words within the description of the disclosed system have specific meanings, and are generally capitalized within the text of the description. These words whether in singular or plural form, shall have the meanings as defined below.

Parking Space: A three-dimensional region of space in which a Vehicle may be located when not in use. A Parking Space may be discrete, possibly with markings that provide a visual indication of its boundaries and accommodating a single Vehicle. A Parking space may also be of variable size and be capable of accommodating a variable number of Vehicles of varying Vehicle Extents.

Parking Space Allocation: The assignment of a Vehicle to the whole of a Parking Space (in the case of a discrete Parking Space) or a portion of a Parking Space (in the case of a continuous Parking Space). The assignment includes a start and end time and in the case of a future reservation includes probabilities of becoming actual. For continuous Parking Space Allocations, the assignment includes the Vehicle Extent required and a location within the Parking Space.

Vehicle: A device that transports people and/or cargo from one location to another and may require temporary storage at one or more locations in between such transportation. A Vehicle may be operated by a person from within or remotely, or may be fully or partially automated robotic and/or self-driving. Vehicles include motorcycles, bicycles, skateboards, wagons, sleighs, cars, sedans, trucks, sport utility vehicles (SUVs), buses, trains, ships, boats, canoes, airplanes, spacecraft, etc.

Vehicle Extent: The space required for a Vehicle to park in a Parking Space including the Vehicle's dimensions such as length, width, and height and also other Vehicle characteristics required for a vehicle to enter, occupy and exit a Parking Space, such as mass, turning radius, door/trunk/hood locations and measure of space needed for opening Vehicle door/trunk/hood.

3. Overview

In the following detailed description, reference will be made to the accompanying drawing(s), in which identical functional elements are designated with like numerals. The aforementioned accompanying drawings show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense.

FIG. 1 shows a simplified illustration of city streets and a variety of Parking Spaces and structures to facilitate understanding of the operation of the Traffic Parking Management System described herein. A grid pattern of streets (Main, Broad, Oak) is shown with a variety of different types of Parking Spaces. Main Street contains two sets (A and B) of street parking. A set of diagonally oriented and marked Parking Spaces, A, is shown on Main Street, with vehicles V1, V2, V3 parked therein. V1 is an electric or plug-in hybrid vehicle that is charging with the charging station Z1 provided for that Parking Space. Also, on Main Street is parking set B, which is comprised of a plurality of Parking Spaces oriented in a first-in, first-out (FIFO) arrangement, with vehicles V3-V8 (of varying Vehicle Extents) parked therein. Oak Street, which includes residential buildings, includes traditional curbside parallel Parking Space set E with vehicles V9-12 and V16 (or varying Vehicle Extents) parked therein. Parking sets C and D are each located on the driveway of an associated residential building. Parking set C at 185 Oak Street includes two vehicles V13 and V14 parked therein and parking set D at 183 Oak Street includes a single vehicle V15. As can be seen, vehicle V16 is parked in a manner to block parking set D and hence vehicle V15 which is parked therein. While ordinarily inconvenient and possibly illegal, utilization of such a Parking Space by V16 is permitted by embodiments of the present invention.

In FIG. 1, the letters A, B, C, . . . , G, H refer to parking sets, the designations PS1, PS2, PS3, refer to parking structures, the designations V1, V2, V3, . . . , V14, V15 refer to Vehicles 50, and the designations X1 X2, X3, . . . X9, X10, Y1, Y2, Y3, Y4 refer to PMN(s) 1210.

Several parking structures PS1, PS2 and PS3 are shown generally in FIG. 1. PS1 at 187 Oak Street is a dedicated parking structure, providing a ten to twelve foot high ceiling clearance, containing multiple floors, each containing multiple Parking Spaces, with the Parking Spaces being organized as a plurality of sets as will be described herein. The ground floor and entrance provide a twelve-foot high ceiling clearance and contain one set of 36 marked diagonal Parking Spaces, and another set of 4 larger marked handicapped accessible spaces. Other floors afford a ten-foot high ceiling clearance. The basement contains charging stations in each of its set of 42 Parking Spaces for electric and plug-in hybrid vehicles to park and charge. The second floor contains variable diagonal Parking Spaces, where Parking Spaces are not marked, allowing vehicles to park according to their width needs in a variable set of Parking Spaces. The third floor is the roof and has a set of 90 Parking Spaces (name parking set F) that are stacked to allow double parking for greater vehicle density and may accompany valet services. Parking structures PS2 and PS3 are located in commercial buildings G and H located respectively at 193 and 191 Main Street and may be similar in organization to PS1. In accordance with the principles of some aspects of the present invention, the sets of Parking Spaces in PS1, PS2 and PS3 may be configured according to varying needs. For example, the orientation and size of the Parking Spaces (such as those on the second floor of PS1) may be changed to accommodate different parking needs. Some sets may be oriented as traditional parking garage type spaces permitting free ingress/egress to each vehicle (such as those on the first floor of PS1). Other sets of Parking Spaces may be configured in a valet style where vehicles may be arranged according to expected departure times (such as those on the third floor roof of PS1). The size of the Parking Space allocations can also be varied to accommodate different Vehicle Extents (e.g., varying sizes of motorcycles, sedans, sport utility vehicles (SUVs), trucks, motorhomes, etc.) and parking density requirements (e.g., according to driver ability, self-driving vehicle, valet service, etc.).

In FIG. 1, Parking Monitoring Nodes (PMN) 1210 (described in conjunction with FIG. 2) that include camera sensors 1211 are designated by X1, X2, X3, . . . , X10 and other Parking Monitoring Nodes (PMN) 1210 that include other kinds of sensors 1211 are designated by Y1, Y2, Y3, and Y4. For example, PMN 1210 Y4 that includes a light-curtain sensor 1211 and PMN 1210 X10 that includes a camera sensor 1211 are utilized together to monitor parking set D at 183 Oak Street, and PMN 1210 X9 monitors parking set C by camera sensor 1211 at 185 Oak Street. PMN 1210 X1, X2, and X3 work together to monitor the street parking along Oak Street by use of camera sensors 1211. At Parking Structure PS1, PMN 1210 Y1 detects vehicles as they enter and leave PS1 through the use of treadle sensors 1211 in the ground that detect vehicles as they drive over it. On the roof of PS1, PMN 1210 X4, X5, and X6 monitor the stacked spaces of parking set D through the use of camera sensors 1211. At parking set B, there are PMN 1210 Y2 and Y3 that include RFID transponder reader sensors 1211 to detect entry and exit respectively from the FIFO parking set B as well as PMN 1210 X7 that includes a camera sensor 1211 to also monitor status of parking set B. Parking set A is monitored by PMN 1210 X8 that includes a camera sensor 1211.

4. Hardware Overview

Figure 2:
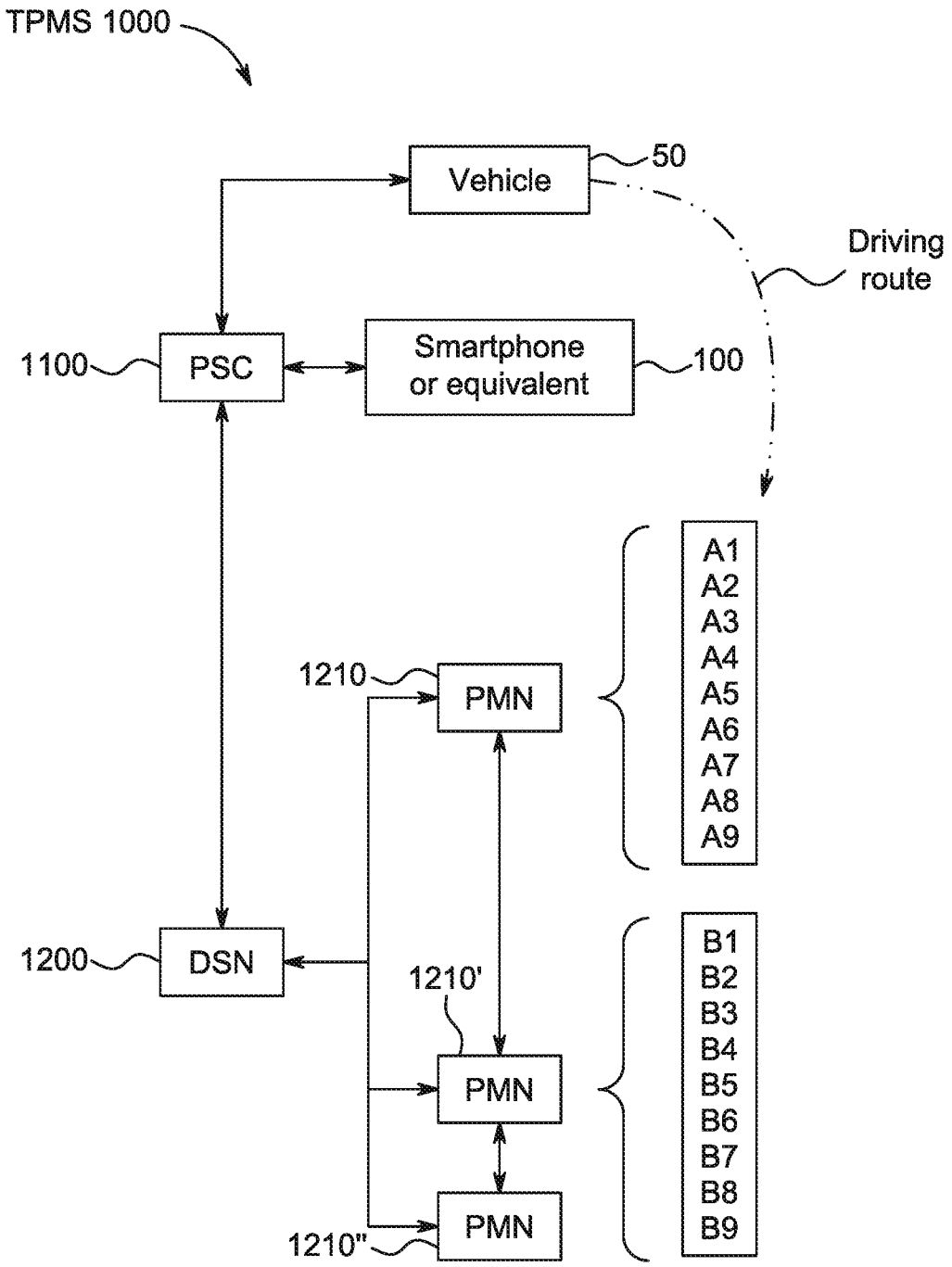
FIG. 2 is a schematic overview of the TPMS 1000.
Figure 3:
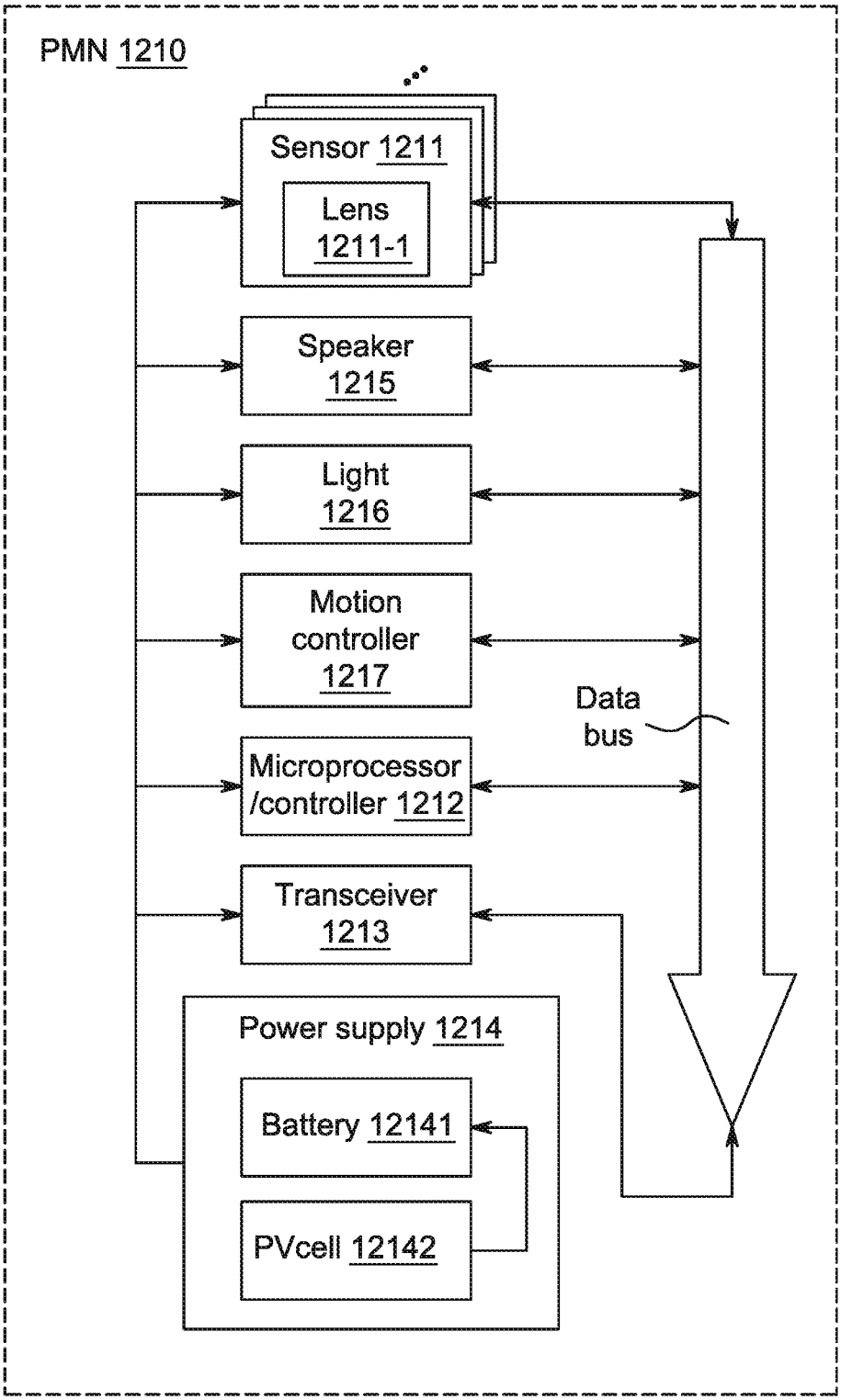
FIG. 3 is a schematic overview of an embodiment of the PMN 1210 component of the DSN 1200 shown in FIG. 2.
Figure 4:
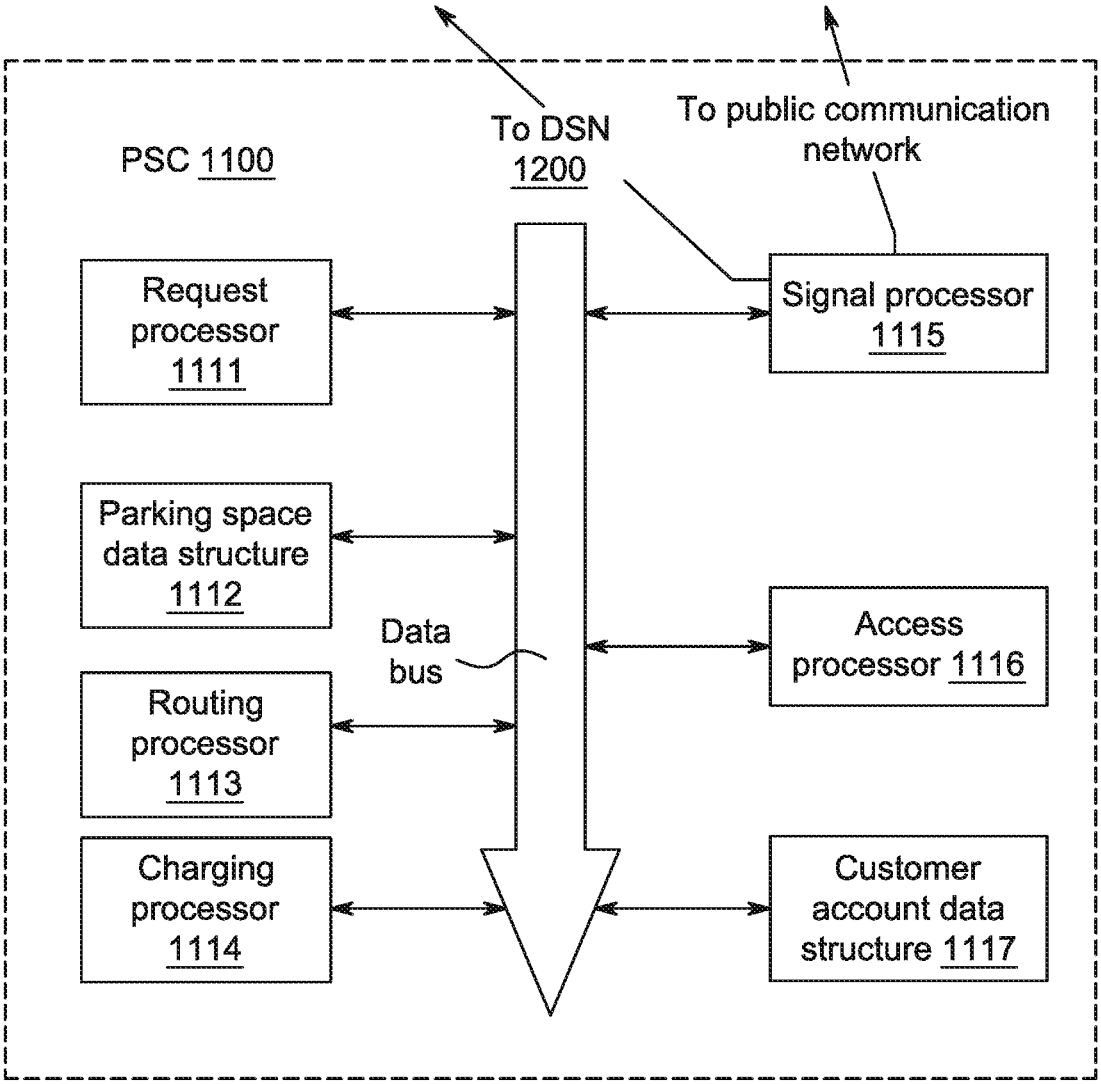
FIG. 4 is a schematic overview of an embodiment of the PSC 1100 component of the TPMS 1000 shown in FIG. 2.

Referring to FIGS. 2 through 4, wherein like reference numerals refer to like components in the various views, there is illustrated therein a new and improved TRAFFIC AND PARKING MANAGEMENT SYSTEM (TPMS), generally denominated 1000 herein.

In accordance with one aspect of the present invention the TPMS 1000 comprises a Parking System Controller (PSC) 1100 in signal communication with Digital Sensor Network (DSN) 1200. The DSN 1200 preferably comprises a plurality of Parking Monitoring Nodes (PMN) such as 1210, 1210' and 1210" as shown in FIG. 2. A PMN 1210 preferably includes a digital camera sensor 1211 in signal communication with an image processing means, such as a microprocessor 1212 or other computing means, which can be remote over a connected (wired or wirelessly) computer/telecommunications network, and other components via a data bus, for determining the occupancy or vacancy state of a discrete Parking Space or range of Parking Spaces along a street, in a lot, or a driveway. Each PMN 1210 optionally deploys a still or continuous image-acquiring (video) camera sensor 1211 and is mounted on light posts, traffic signal posts or telephone poles, buildings and walls and any above ground utility structure, including suspension from utility wires and overhead telephone lines, to provide multiple views of potential Parking Spaces. A PMN 1210 may include one or more sensor 1211 such as microphones to detect and/or record sounds such as vehicle noise or spoken words, or garage door safety infrared sensors to detect vehicle ingress and egress, or magnetic field sensors analogous to buried security gate sensors used to open a gate when a vehicle approaches for exit and drives over the sensor, or RFID tag sensors, or inductive sensors, or treadle sensors (possibly offset-treadle installations), or light-curtain laser profilers. Each sensor 1211 is in signal communication with a sensor processing means, such as a microprocessor 1212 or other computing means which can be remote over a connected (wired or wirelessly) computer/telecommunications network, and other components via a data bus, for determining the occupancy or vacancy state of a Parking Space (e.g., a single location or range along a street, in a lot, or a driveway). Such nodes 1210 may be correlated with other nodes 1210', 1210", etc. possibly triggering additional signal processing such as by microprocessor 1212 and/or energizing of other portions of DSN 1200 that may be in a low-power sleep state awaiting triggering wake-up by other nodes PMN 1210 or by PSC 1100. Low power modes may vary power supplied across a single PMN 1210, such as providing differing levels of power to the one or more sensor 1211, speaker 1215, light 1216, microprocessor/controller 1212, and transceiver 1213.

As shown in FIG. 3, each PMN 1210 preferably includes its own power source 1214 for energizing the sensor 1211 and speaker 1215 and lights 1216 and microprocessor 1212 and transceiver 1213. The power source 1214 preferably also include photovoltaic or solar cells (PV Cell 12142) which continuously maintain the charge state of storage batteries 12141 that form part of each PMN 1210 unit, and supply power to the sensor 1211, speaker 1215, lights 1216, microprocessor 1212 and transceiver 1213.

The power supply 1214 optionally can include one or more of a battery and solar cell. It can also be a direct attachment to a main or municipal power supply, which can be used to charge the battery as a back-up power supply as well as to energize the various camera components, particularly auxiliary lights. The battery can also be charged from a small wind-turbine that drives an electrical generator, as well as the solar cell. Alternatively, the battery can also be charged from a hand crank or through harvesting of kinetic energy such as that produced by a sign on a pole being shaken and/or swaying due to the wind or other cause. Such methods are known in the art, example methods are disclosed in US Pat. No. 20100045241 A1 (Published 2010-02-25) for a "Piezoelectric Kinetic Energy Harvester". Additional example methods are disclosed in U.S. Pat. No. 8,269,399 B2 (Published 2012-09-18) for a "Systems and apparatus for harvesting energy". Additional example methods are disclosed in U.S. Pat. No. 4,227,092 A (Published 1980-10-07) for a "Hand cranked electrical power source". Alternatively, inductive charging to a receiver that is part of the power supply 1214 can be deployed when the magnetic field generated by fortuitously nearby located flowing current supplies sufficient power to energize the PMN 1210 or re-charge the batteries 12141. Such inductive coupling of power may facilitate the installation and integration of sensors 1211.

Images acquired by the sensor 1211, where sensor 1211 takes the form of a digital camera, are stored in memory and analyzed by the microprocessor 1212 for a correspondence with a geospatial map to determine which pixels correspond to each Parking Space (A1-A9 for the camera sensor 1211 in PMN 1210 and B1-B9 for the camera sensor 1211 in PMN 1210'). For example, a group of pixels corresponding to the location of an empty portion of the parking lane can have a unique appearance of the unobstructed view of the adjacent sidewalk, curb and adjacent empty parking lane and may be used to confirm the specific length of the parking lane that is vacant, and hence available for parking one or more vehicles. A unique reference marking on the curb/street can also be used to calibrate the pixel correspondence with the length of the parking lane via a prior calibration. Such methods are known in the art, example methods are disclosed in the 2010 paper "Rectangular Empty Parking Space Detection Using Sift Based Classification" by Harish Bhaskar et al. and the 2007 paper "Vacant Parking Space Detection in Static Images" by Nicholas True.

Figure 14:
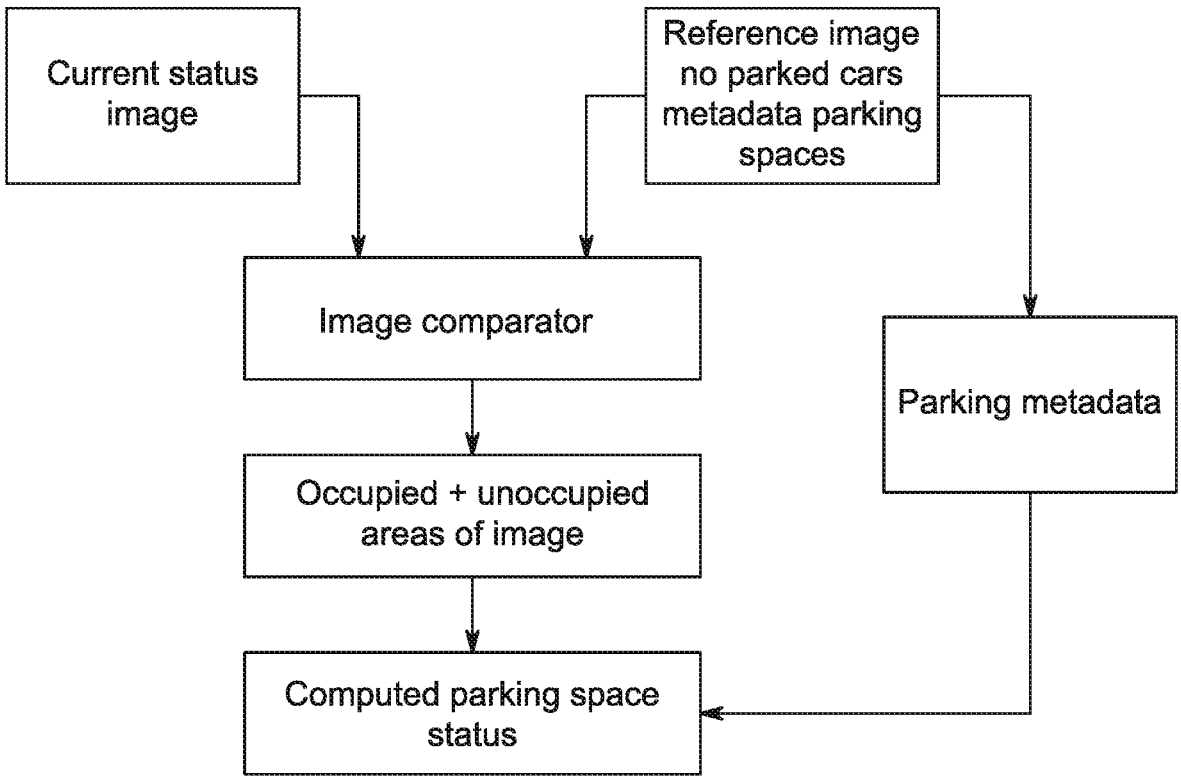
FIG. 14 is a flow chart illustrating the operation of an image comparator to compute whether Parking Spaces are occupied or not for recording of said status as data in Parking Space Data Structure 1112.

In FIG. 14 a flow chart illustrating the operation of an image comparator to compute whether Parking Spaces are occupied or not for recording of said status as data in Parking Space Data Structure 1112 is presented. The image comparator receives a current status image of a Parking Space and a reference image of the same Parking Space from the same perspective showing its appearance when vacant. The comparator determines which areas of the image are occupied (allocated) and which are unoccupied (vacant) and associates these with an updated status of Parking Spaces in the Parking Space data structure 1112.

Figure 6:
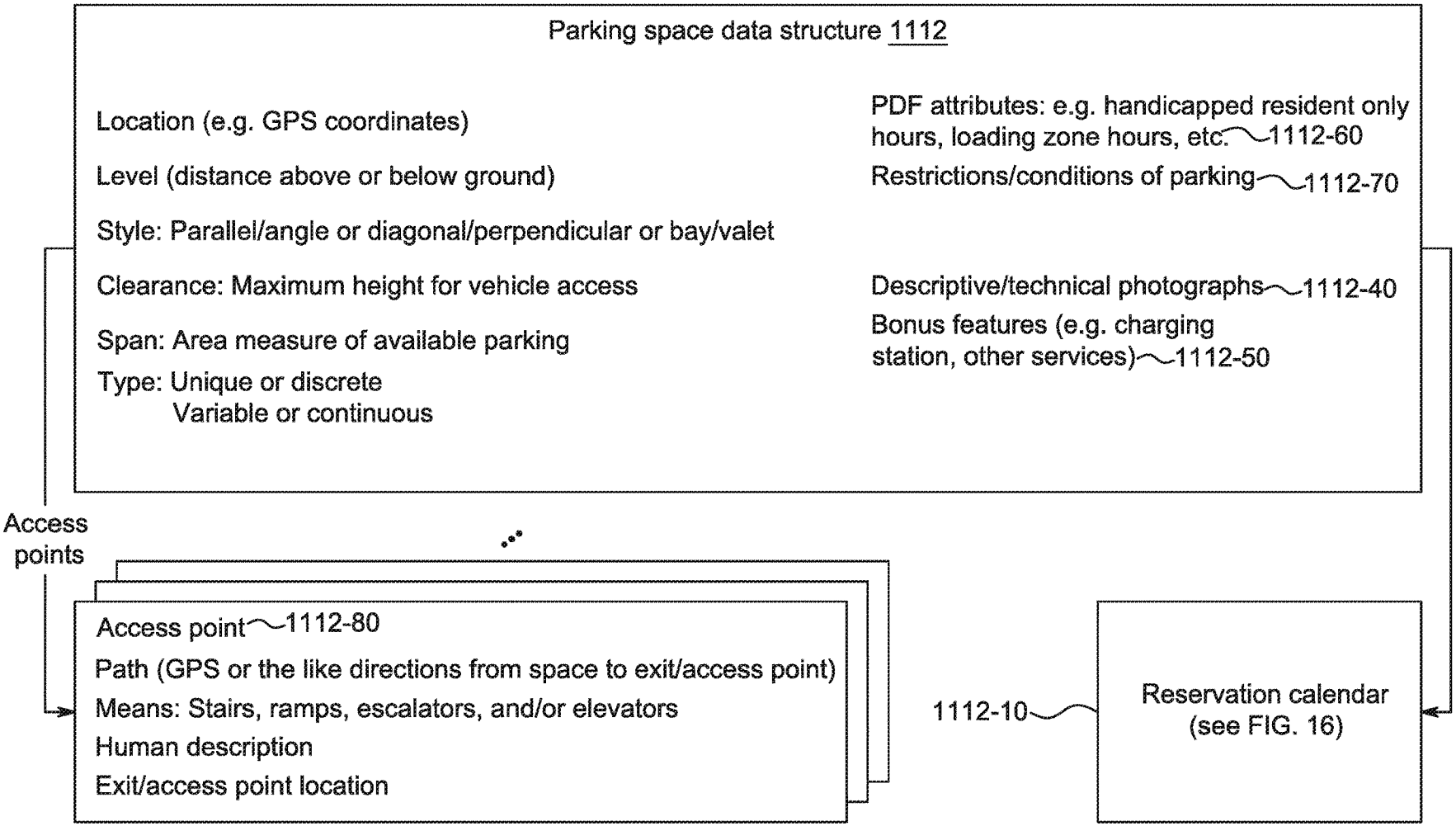
FIG. 6 is a block diagram showing details of the Parking Space Data Structure 1112 shown in FIG. 4.

In FIG. 6 a block diagram showing details of the Parking Space Data Structure 1112 is shown. The Parking Space data structure 1112 includes the location (e.g., GPS coordinates or other locating information) of a Parking Space; the level (e.g., floor number or distance above or below ground level); style (e.g., parallel parking, angle or diagonal parking, perpendicular or bay parking, and valet parking); clearance (maximum height of Vehicle Extent for access to parking);

span (the measure of the available parking area that may be occupied by one or more Vehicles); type (unique, discrete, marked parking or variable, continuous parking); Priority Determination Factors PDF(s) attributes 1112-60 such as handicapped parking, resident only hours (e.g., from 6 pm to 7 am), loading zone hours, etc.; restrictions and/or conditions of parking 1112-70; description of Parking Space including technical details and/or photographs 1112-40; bonus features of Parking Space (e.g., charging station, running water, bathroom, or other services) 1112-50. A parking space data structure 1112 is also associated with one or more access points 1112-80. An access point 1112-80 contains a path that may include GPS coordinates or other location information to provide a customer with directions from a Parking Space to an exit or access point (e.g., take the elevator in the northwest corner down to the second floor to exit the parking building on Oak Street). An access point also contains a means of access, such as stairs, ramps, escalators, elevators, and/or shuttle bus. The access point 1112-80 may also include a human readable description for use by a person in understanding how to exit a parking structure and subsequently return to their Vehicle. An access point 1112-80 also includes the GPS or other identifying coordinates of the exit or access point, such as the GPS of the 183 Oak Street pedestrian entryway.

Sensors 1211, where sensor 1211 takes the form of a digital camera, preferably have a very wide angle or fisheye lens 1211-1 of fixed focus. Each camera sensor 1211 of the PMN 1210 preferably has a lens that provides a rectangular view field, rather than a spherical view field, to capture wide street scene views, minimizing the need for multiple camera devices. However, to the extent that multiple sensors are deployed on the same street, lot or intersection it is preferable that occupancy data from multiple sensors is cross-referenced for accuracy and/or error correction.

The PMN 1210 can be mounted on light posts, utility poles, cellular antenna support structure, buildings, walls, wires, trees/plants, above ground pipes, parking meters, signs, any kind of support structure, traffic signal poles at intersections and the like, and be charged or powered by the power supply energizing or running through or along these structures. Mounting may be in a variety of fixed locations (such as just described) or variable locations such as mounting on a vehicle 50 for sensor monitoring at a variable position corresponding to the vehicle 50 location. Mounting locations of PMN 1210 may be selected to optimize cost versus performance of DSN 1200. The mounting locations and number of PMN 1210 sensors varies, dependent upon the needs of a particular area being monitored, and locations are generally selected so as to provide a reasonably accurate indication of the status of an area of monitoring interest. Mounting often is desirable in locations out of access, reach and/or notice of most individuals that pass by a sensor In addition to or as an alternative to a wide angle/fish eye lens 1211-1, the camera is optionally mounted with motion controllers 1217 to pan or scan over a region, or can be directed to point at a fixed location or sightline to zoom in for a magnified view of a vehicle, or portion thereof, such as the license plate or specialty parking tags, as for example a handicapped sticker or tag. In the case of directional sensors, for example a parabolic antenna sensor or parabolic microphone sensor, the directional sensor is optionally mounted with motion controllers 1217 to pan or scan over a region, or can be directed to point at a fixed location or sensor aiming target to accumulate sensor data for a more detailed sensor view of a vehicle, or portion thereof, such as the transponder of a vehicle or for more accurate" recording of the speech of any individuals in the targeted area. In some embodiments, the camera or sensor is directed remotely according to the input provided by a person using a software application to manage and/or patrol the Parking Spaces under the control of the TPMS. Alternatively, the camera or sensor may be directed automatically according to the automated software of the TPMS or some combination of the two approaches such as computer assisted control to facilitate management by a person.

Similarly, auxiliary lights 1216 and/or speaker 1215 can be a part of the PMN 1210, and can pan with the sensor 1211, or with auxiliary lens system 1211-1 wherein sensor 1211 includes a digital camera sensor, microphone sensor 1211, or other targetable sensor 1211, auxiliary lights 1216 can zoom/focus to same field of view or sensor 1211 focus/aim, such as the camera imaging zoom is the case of a camera sensor 1211 or microphone pickup targeting in the case of a microphone sensor 1211, so as to better illuminate the license plate (or other identifying vehicle marks/signage) in the case of a camera sensor 1211, or better pickup the voices of targeted individuals in the case of a microphone sensor 1211, or provide greater security as the vehicles' occupants enter or leave at night, and speaker 1215 can be directed to transmit sound in the same direction as sensor 1216 is being directed to better communicate with individuals in a target location. Auxiliary lights 1216 may take the form of LED (Light Emitting Diode lamps), HID (High Intensity Discharge lamps), halogen lighting, etc.

These modes of sensor 1211, speaker 1215, and lighting 1216 motion and focus can be initiated by the PSC 1100 in response to the expected or tracked position of a vehicle or the one or more of the occupants of a vehicle returning or leaving thereto. The methods of vehicle tracking can include GPS tracking of position, but other means such as cell tower location and wireless Ethernet (e.g., Wi-Fi®) positioning may also be employed. These methods may be combined together for even greater accuracy and for position coverage where some of these are unavailable or minimally available. Such methods are known in the art, example methods are disclosed in U.S. Pat. No. 8,633,853 B2 (Issued 2014-01-21) for a "Method and apparatus for location detection using GPS and WiFi/WiMAX". Additional example methods are disclosed in U.S. Pat. No. 7,397,424 B2 (Issued 2008-07-08) for a "System and method for enabling continuous geographic location estimation for wireless computing devices". Additional example methods are disclosed in U.S. Pat. No. 7,696,923 B2 (Issued 2010-04-13) for a "System and method for determining geographic location of wireless computing devices".

However, the aforementioned modes of sensor, speaker, and lighting motion and focus can also be initiated by independent sensors 1211 of noise, vibration, infrared light, motion detection and the like. For example, it is common for sensors to be employed on outdoor lighting so as to turn on lights when human activity is presumed due to sensor detection/triggering and to turn them off, some chosen elapsed time after such detected activity ceases, in a likewise manner, the modes of PMN 1210 sensor (e.g., camera, microphone), speaker and lighting motion may also be initiated by independent sensors 1211 by way of signal communication with PMN 1210 to DSN 1200 and/or PSC 1100 to PMN 1210'. Such independent sensors can connect to the PSC 1100 through the PMN 1210 and DSN 1200, or be integrated into the PMN 1210. Such sensors 1211 may provide additional means of detecting and/or confirming the presence/absence, entry/exit, identity, and location of vehicles 50 in Parking Spaces. These means include the use of proximity sensors utilizing either electromagnetic or ultrasonic sensors to detect Vehicles and measure Vehicle Extent. Such methods are known in the art, example methods are disclosed in U.S. Pat. No. 7,804,742 B2 (Published 2010-09-28) for an "Ultrasonic transducer for a proximity sensor".

Data acquired by the sensor 1211 is stored in memory and analyzed by the microprocessor 1212 for a correspondence with the sensor's associated Parking Space(s) and/or parking set(s) (e.g., Parking Spaces A1-A9 for the sensor 1211 in PMN 1210 and Parking Spaces B1-B9 for the sensor 1211 in PMN 1210'). For example, in FIG. 1, PMN 1210 that is labeled Y3 collects data that is associated with exit of Vehicle 50 from parking set B, whereas Y2 collects data that is associated with entry of Vehicle 50 to parking set B and sensors Y2 and Y3 may additionally include RFID transponder reader sensors 1211 for Vehicle 50 transponders to identify Vehicle 50 upon entry and exit and associate a time stamp generated by microprocessor 1212 with such events for communication to DSN 1200 for further communication to PSC 1100.

The transceiver 1213 associated with the PMN 1210 at each communication network node is further operative to transmit the status of each Parking Space upon a status change, such as that initiated by noise, vibration, infrared light, sound and motion detection by sensors 1211 that itself initiates any new acquisition of images by the camera sensor 1211 and/or other data collection by other sensors 1211, and can be used to confirm a vehicle has parked, moved, or left a Parking Space. Any of these status changes can initiate new computational efforts to refresh the data structure of the stored Parking Space information, or reconfigure the data structure to refresh the number and type of available Parking Spaces, as well as initiate computational efforts to determine if vehicles can or should be moved to create additional Parking Spaces and/or have their future reservations reoptimized to reflect status changes. These methods can provide significant power savings benefits. The system can go into low power mode where it awaits status change detection and then powers up into higher power consumption to do more data analysis and acquisition.

An example wireless network for Parking Space management is disclosed in U.S. Pat. No. 7,714,742B1 (Issued 2010-05-11) for a "Wireless mesh network parking measurement system". Further, U.S. Pat. No. 7,974,265B2 (issued 2011 Jul. 5) for a "Remote parking meter auditing module", is an example of a wireless network in which receivers are associated with parking meters. Published US Pat. Appl. No. US2006-0220911A1 (published 2006 Oct. 5) for a "Parking space detection method" is an example disclosure for a method of using a video camera to detect and measure the size of empty/unused Parking Spaces.

Each PMN 1210 unit also preferably includes a digital signal transceiver 1213 controlled by the microprocessor 1212 for signal routing via other PMN(s) via a predetermined protocol to form a linked communication network in the DSN 1200, as shown. In other words, the DSN 1200 is in signal communication with the PSC 1100 to report the presence and status of Parking Spaces identified by each PMN unit 1210, with each PMN unit in signal communication with one or more nearest PMN units 1210' for reporting the Parking Space status to the PSC 1100.

The TPMS 1000 is operative via the PSC 1100 to be in signal communication with one or more, and preferably multiple vehicles/drivers or dispatchers, to direct them to available Parking Spaces in response to specific demands, needs and criteria described below. The available Parking Spaces can be those detected by the DSN 1200, or those known to be available by other means. Such other means can include other types of sensors PMN 1210 and position detection devices for open Parking Spaces, interconnected vehicles, a database of available Parking Spaces, showing unallocated location (e.g., of 100 spaces in a garage, 93 are currently assigned by the PSC 1100, leaving 7 available Parking Spaces or of the 500 foot long parking set E on Oak street in FIG. 1 only 42 feet of continuous street Parking Space beginning 33 feet in from the corner of Broad street and another 17 feet of continuous Parking Space beginning 208 feet in from the same corner are unoccupied and available for parking), or crowdsourced reporting by individuals using their Smartphone 100 to report parking availability in their vicinity.

The signal communication between the TPMS 1000 and preferably multiple vehicles/drivers or dispatchers can be directed from the TPMS 1000 towards a vehicle navigation system and/or the occupants of the vehicle, via personal Smartphones 100 or related GPS (Global Positioning Satellite or equivalent system) electronic devices equipped with transceivers 1213 via a wireless communication system, such as a cellular telephone network that is connected to the Internet and permits the transmission of data from the vehicle to the PSC 1100.

Smartphone 100 should be understood to be a computing and communication device that includes one or more user interfaces, such as a visual display, tactile output (e.g., vibration), touch, voice or accelerometer command input, and associated audio input and output devices, as well as a microprocessor and memory in signal communication therewith, generally via a data bus. Smartphones 100 also includes a means to communicate with other users, operating systems, such as the PSC 1100, and remote storage through signal communication using one or more communication networks including, cellular voice, data, Wi-Fi, using at least one wireless communication protocols, such as 3G, 4G, TDMA, and one or more of the Bluetooth standards among others. Such communication can be in the form of audio signals, such as voice, as well as text, data and live or prerecorded video signals or still images. Smartphone devices 100 also include various internal transducers and/or detectors such as accelerometers, and for the purpose of the applications disclosed herein and preferably include a global positioning satellite (GPS) receiver, each of which are connected to the data bus. While one or more of the potential microprocessors of the Smartphone 100 is utilized by a general operating system, one or more microprocessors can be programmed with one or more application programs that enable input, output and communication between Smartphone 100 and the PSC 1100 as described herein. An application program is provided on such a Smartphone 100 that records and/or transmits the present and anticipated geographic position of the Smartphone device, which can serve as a surrogate for the location of the vehicle and/or occupants or Smartphone 100 user, to the PSC 1100 that an occupant of the vehicle uses. The PSC 1100 is an automated data processor system that is in signal communication with multiple drivers and vehicles, which accesses records of available Parking Spaces in a Parking Space data structure 1112 to determine which spaces best suit the needs and priorities of each driver vehicle, which may also take into account needs of the vehicle occupants, or parties that plan to pick up at a target location.

5. Parking Spaces

Parking Spaces can consist of, for example, normal street parking, privately owned lots, valet parking lots, and private driveways, including the street Parking Spaces whose use blocks access or egress from a private driveway or garage door. Parking spaces can be unique/discrete, such as those defined by lines in a parking lot or spacer markings in street parking lanes used to associate vehicles with specific conventional parking meters. Alternatively, Parking Spaces can be variable/continuous with allocatable portions delineated by the length of empty spaces detected between Vehicle Extents and/or other obstacles (e.g., column, wall, fire hydrant, or curb), and hence allocated to vehicles based on Vehicle Extent. It should be understood that as not all spaces are sufficient for all vehicles due to Vehicle Extent such as length variation and driver ability variation, the definition of space for each parking request can take into account the specifics of the vehicle 50 and driver ability, among other parameters, discussed further below. It should be understood that vehicle 50 may include motorcycles, bicycles, cars, sedans, trucks, motorhomes, SUVs, etc.

The availability of the space between parked vehicles will be specific to the vehicle (and possibly driver) searching for space, taking into account its Vehicle Extent (e.g., length), any requirements for access that require additional space around the vehicle, and any extra distance required for safe maneuvering into the space, such as by parallel parking. However, for vehicles equipped with automated means for parallel parking, this extra distance may be less. The extra distance is optionally variable to add extra space for drivers less confident in their ability to parallel park or to take into account the difficulty of parking on steep slopes, in particular for vehicles with manual transmissions. Additional space around a vehicle may be required for a disabled vehicle, such as due to vehicle failure, to provide more efficient or easier access to the disabled vehicle so that it may be loaded/attached more readily to a tow truck or so that it may be accessed in place for repair. Alternatively, extra access space may be required around a parked vehicle, to allow for vehicle service access in the vehicle's parked location, such as replacing a windshield, washing and detailing a vehicle, or loading/unloading large objects into/from a parked vehicle. Such additional space requirements may not be required throughout the whole time a vehicle is parked, for example, extra space to allow easier parking and egress, are only required at the beginning and end of the time, whereas during the vehicle's parked occupation of the space, other vehicles requiring less space buffer may temporarily park closer. Likewise, any extra space required to service a vehicle or load/unload a vehicle may only be required for a portion of the time a vehicle is parked.

Figure 17:
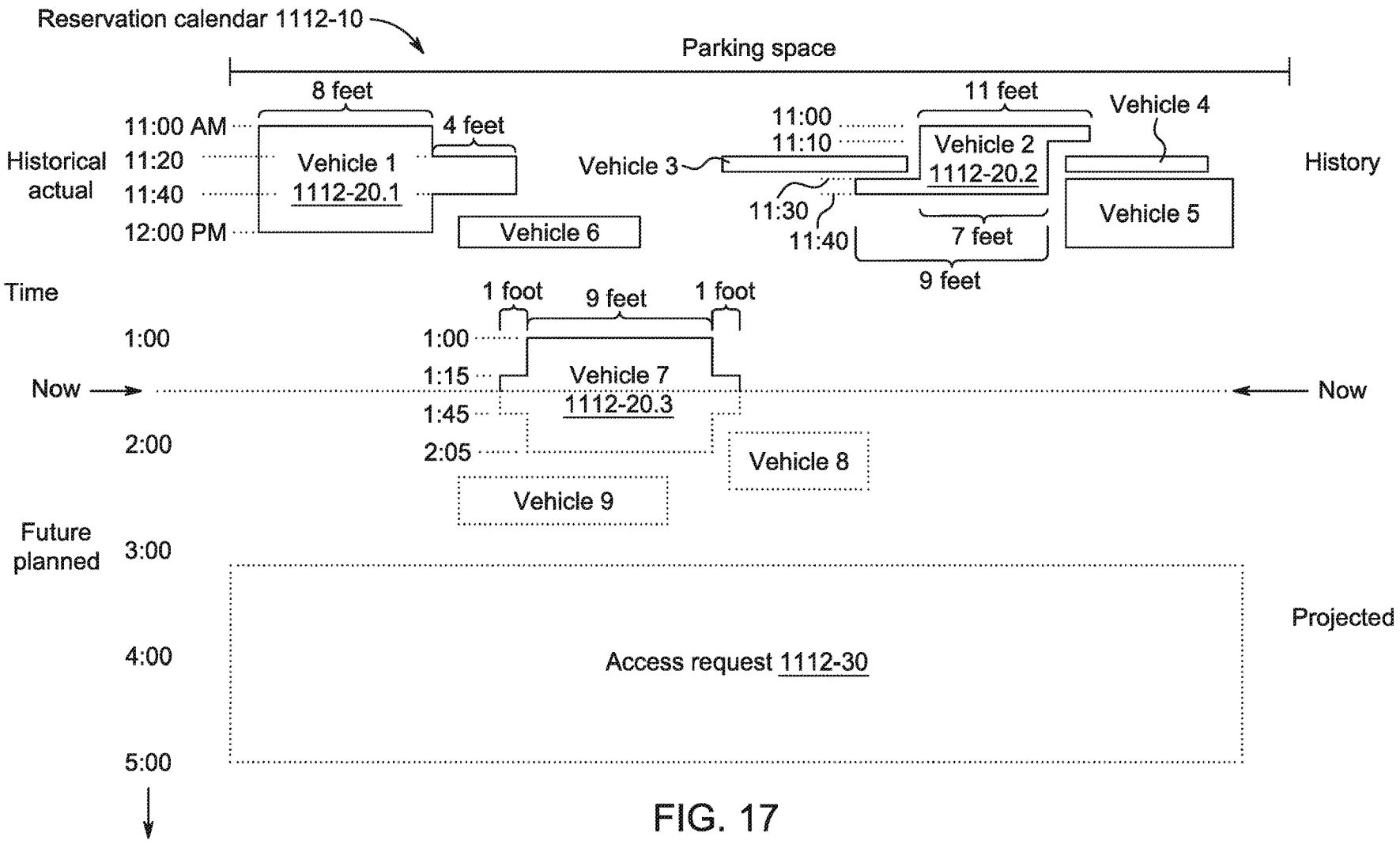
FIG. 17 is a block diagram showing exemplary details of an instance of the reservation calendar entries 1112-20 utilizing variable space.

Within the reservation calendar 1112-10, temporary extra space may be represented by using a rectilinear polygon for a reservation calendar entry 1112-20, such as the examples shown in FIG. 17. For example, in FIG. 17, an exemplary reservation calendar 1112-10 is shown in which vehicle reservation calendar entry 1112-20.1 shows that vehicle 1 was parked at 11:00 am in a space of 8 feet, but at 11:20 am an additional 4 feet of space was required at the rear of the vehicle for twenty minutes, such as to allow loading large materials into the rear of the vehicle, and then at 11:40 am the vehicle space reverted to its original footprint of 8 feet until the vehicle vacated the space at 12:00 pm. This allowed vehicle 6 to park at 11:50 am utilizing the no longer needed loading space behind vehicle 1. Another example is found for exemplary vehicle reservation calendar entry 1112-20.2 for vehicle 2, in which vehicle 2 owner was scheduled to arrive between 11:00 am and 11:10 am and required easy parking access of an additional four feet of space behind the vehicle to make parking easier, then the vehicle 2 owner was scheduled to leave between 11:30 am and 11:40 am and required an additional two feet in front of their vehicle for easy egress. Vehicles 4 and 5 occupied the buffer space behind the vehicle 2 after it was parked and vehicle 3 occupied the buffer space in front of vehicle 2 before it was scheduled to leave. Another example is found for exemplary vehicle reservation calendar entry 1112-20.3 for vehicle 7, in which vehicle 7 owner scheduled their vehicle 7 to have a detail wash from 1:15 pm to 1:45 pm that requires an extra 1 foot of space both in front of and behind the vehicle 7 to facilitate its being washed which is currently transpiring at the present time of 1:30 pm. In anticipation of the detail service completing at 1:45 pm, vehicle 8 has a reservation in the calendar for 1:50 pm that overlaps the extra space needed behind vehicle 7 while it is being washed.

Allocation of Parking Spaces can include the PSC 1100 consideration of a space range to optimize its use pattern projected into the future planned space utilization as recorded in reservation calendar 1112-10, such as shown in FIG. 17. Vehicles can be directed where to park by routing processor 1113 within a space range to optimize its use pattern projected into the future planned space utilization of reservation calendar 1112-10 (for example, a Vehicle 50 may be directed by routing processor 1113 to park in the middle of the large space that can accommodate multiple Vehicles 50, or alternatively a Vehicle 50 may be directed to park at the front or the rear of a long Parking Space, or alternatively to leave ½ space in front so that when the vehicle ahead leaves, there will be extra long space needed by the next occupant). Such direction may be fine-tuned using the images provided by camera sensor 1211 and analyzed by the microprocessor 1212 to direct the vehicles to a precise desired location within a space. For example, in FIG. 16, vehicle 8 that arrives at 10:45 am is directed to park precisely between existing parked vehicles 4 and 5 according to Reservation Calendar 1112-10 and Reservation calendar entry 1112-20, leaving an exact space between itself and vehicle 4 such that later arriving vehicle 10 will fit and leaving an exact space between itself and vehicle 5 such that later arriving vehicle 9 will also fit. In the event that vehicle 8 is detected, such as by images provided by camera sensor 1211 to have incorrectly parked, for example, causing vehicle 9 to no longer fit, then Reservation Calendar 1112-10 is updated to reflect the actual vehicle 8 positioning in its Reservation Car Entry 1112-20. Such space updates may be communicated via Signal Processor 1115 to Request Processor 1111, causing a new search of Parking Space Data Structure 1112 for affected vehicles such as vehicle 9, possibly including reassignment of other, now non-optimal, vehicles such as 10 to find a reasonable replacement solution in the vicinity of vehicle 8.

Figure 16:
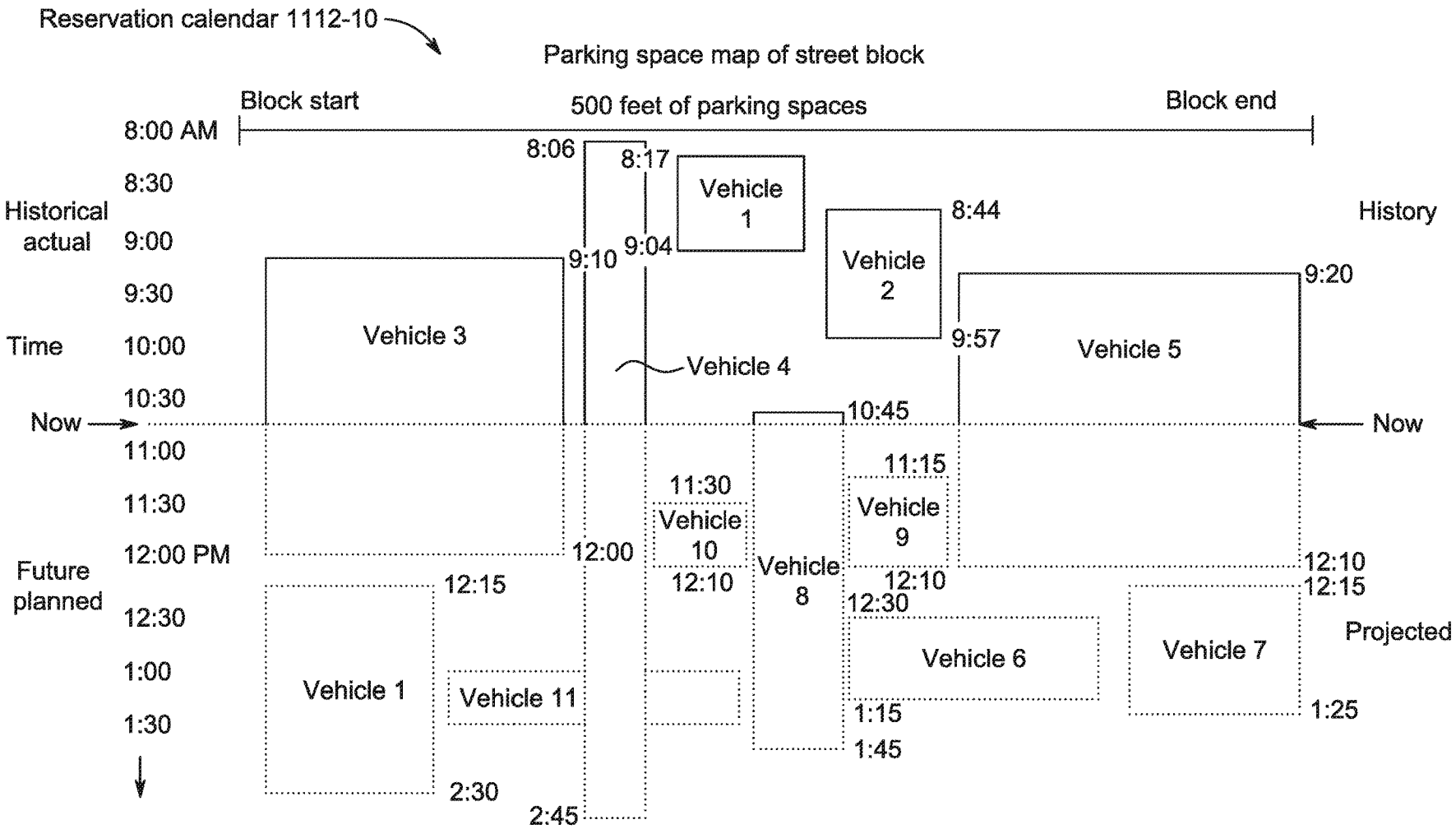
FIG. 16 is a block diagram showing exemplary details of an instance of the Reservation Calendar 1112-10.

Also as shown in FIG. 16, vehicle 11 has a backup Parking Space Allocation from 1:00 pm to 1:30 pm to fit between vehicle 1 and vehicle 8 and which is a part of a containing Parking Space reservation that bundles together several Parking Space Allocations, including the one shown here in FIG. 16. This Parking Space Allocation is behind the one for vehicle 4 and will only be available if vehicle 4 ultimately vacates the space before the end of its reserved Parking Space Allocation that has an actualized start time but pending end time that is allocated up until 2:45 pm. Vehicle 4 may have, for example, a predicted vacancy probability of 27% by 1:00 pm.

Figure 18:
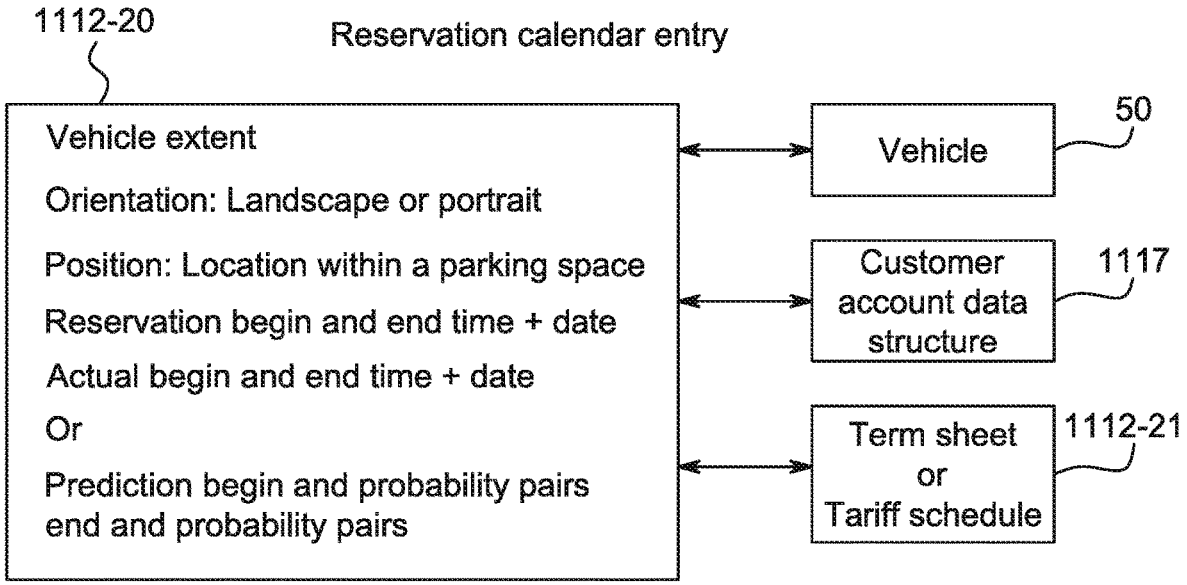
FIG. 18 is a block diagram showing details of the Reservation Calendar Entry 1112-20.

As shown in FIG. 18, a reservation calendar entry 1112-20 is associated with a Vehicle 50, a customer account data structure 1117, and a term sheet/tariff schedule 1112-21. A reservation calendar entry 1112-20 includes the Vehicle Extent and orientation (landscape or portrait) that Vehicle 50 is allocated to the Parking Space as well as the position within the span of a Parking Space for the Parking Space Allocation. A reservation calendar entry 1112-20 also includes the reserved time and date of the beginning and end of the Parking Space Allocation. Before a reservation is actualized it preferably includes a prediction of when the Parking Space will be actually taken and another prediction of when it will be actually vacated. The predicted begin or end time may be represented as a function such as by a series of begin time and probability pairs of the probability that the space will have been taken by a particular time (e.g., 5% by 9:04 am, 12% by 9:06 am, 38% by 9:09 am, 79% by 9:10 am, 98% by 9:15 am). Once a Vehicle actually occupies a Parking Space, the predicted begin time and probabilities are replaced by an actual begin time. Likewise, once a Vehicle actually vacates a Parking Space, the predicted end time and probabilities are replaced by the actual end time. The predicted probabilities of occupation and vacancy may be updated as events transpire, such as when a Vehicle departs and is en route to a Parking Space Allocation or when a Vehicle's passengers begin walking back to their car.

Figure 13:
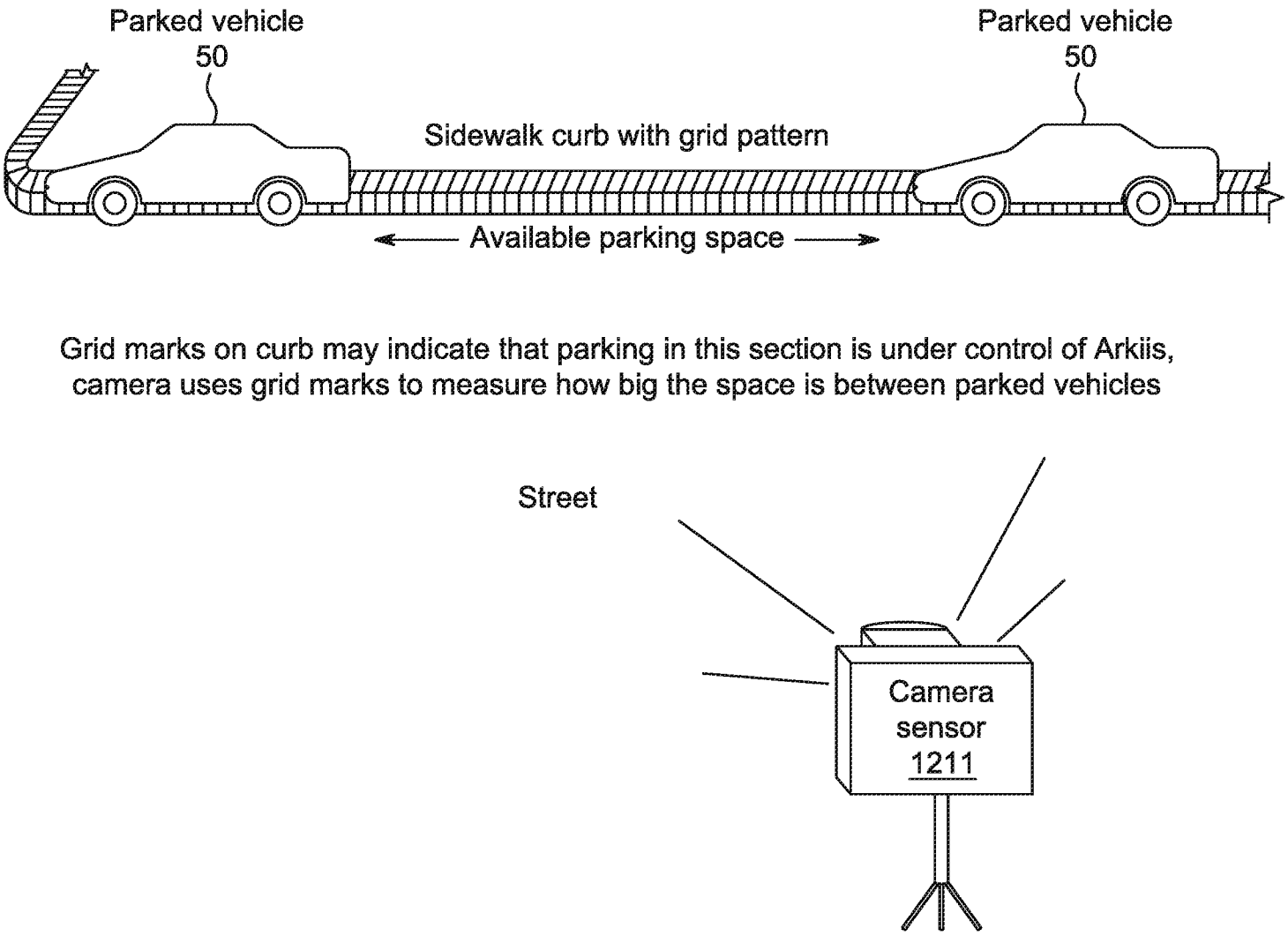
FIG. 13 depicts how grid marks may be placed on sidewalk curbing or other areas in and around where vehicles may park to designate parking under TPMS control and/or provide a known reference measure to facilitate recognition of the status of Parking Spaces and the span measure of unoccupied spaces.

To facilitate the adoption of this system, Parking Spaces may be subdivided into sections under control of the TPMS 1000 and sections outside control of the system. In this way, the design of TPMS 1000 may allow for partial participation by drivers in a given area. For example, upon first being implemented in a geographical area, perhaps only 10% of all available Parking Spaces are allocated to be under control of the TPMS 1000 with the remaining under existing parking control. Such spaces can be identified by distinctive markings including the use of one or more of: special curb color, pavement paint markings, signage, overhead markings in roofed garages, wall and/or column markings, replacement of parking meters with distinctive objects, or the coloring of parking meter support poles. Such markings may be integrated into the operation of the PMN 1210, such as a zebra pattern on the curb and/or pavement (as shown in FIG. 13 where grid markings are on the sidewalk curb and used by a camera sensor 1211 to more easily determine the empty spaces between parked Vehicles 50) to both identify a section as under the control of TPMS 1000 and to serve the dual purpose of facilitating the PMN 1210 measuring the extent of available spaces by providing a known reference scale based upon the fixed controlled distance between stripes on the curb or pavement.

Optionally, the extent of available spaces may be measured by means of PMN 1210 comparing two or more image frames wherein at least one of the vehicles presently adjacent to an available space was moved into its parked position. Alternatively, vehicles being parked under control of TPMS 1000 that are equipped with backup, forward, and/or side view camera technology to assist drivers maneuvering in constrained areas may be in communication with TPMS 1000 and may supply image frames from such onboard cameras. Such methods are known in the art, example methods are disclosed in U.S. Pat. No. 8,164,628 B2 (Issued 2012-04-24) for an "Estimating distance to an object using a sequence of images recorded by a monocular camera". Vacant Parking Space detection algorithms including color histogram classification (through analyzing an RGB image or converting the image to L*a*b* color space to create histograms with the help of, for example, a support vector machine) or vehicle detection (through interest point detection and feature extraction within each identified Parking Space) may also be utilized to distinguish vacant from available Parking Spaces.

Optionally, the system may provide an audio alert when an unauthorized driver parks in a space under control of the TPMS 1000. Such alerts may be provided by way of Smartphone 100 and transmitted through wired or wireless networks as well as cellular networks (e.g., 3G, 4G). Alternatively, in an area under control of the TPMS 1000, PMN 1210 devices may include an audio speaker 1215 to direct audio alerts toward parked vehicles and their general vicinity and may replace traditional parking meters and use existing parking meter poles. Audio alerts may take the form of simple alarms and/or beeps to indicate non-compliant parking or may take the form of verbal warnings or directions indicating that a vehicle is unauthorized and will be given a citation and/or towed. Such warnings may direct the vehicle to alternate location(s) where it may be parked compliantly. In the case of verbal audio alerts, the system may repeat such alerts in multiple languages (e.g., English and Spanish). Optionally, sensor 1211 in the form of microphones may record any speech within range of 1211 and perform voice recognition upon such speech to respond to language received and/or recognize the language being spoken (e.g., English or Spanish) and adjust audio alerts to be spoken in the language detected.

Alternatively, dynamic signage may be placed in and around Parking Spaces under TPMS 1000 control. Such signage may be integrated into PMN devices and/or affixed to parking meter or other available poles. Alternatively, such signage may be located together with existing signage. Dynamic signage may take the form of LED displays under the control of TPMS 1000 to display messages related to changing parking controls in the vicinity of such signage. Dynamic signage may be included and/or integrated with PMN 1210 devices. All such PMN 1210 devices may be powered as described elsewhere within this document. Some PMN 1210 devices may omit the inclusion of a camera yet still be considered a PMN 1210 as it is used within this document. Dynamic signage may take the form of light projection from a projector onto the ground, wall, or ceiling in the vicinity of one or more spaces to which the signage applies. In the case of signage being integrated into PMN 1210 devices, such signage may take the form of mechanical static or dynamic signs that may popup to be revealed when applicable and be retracted and/or hidden when not applicable. Such retraction may be automated and/or require the use of human intervention to mechanically retract and lock the sign out of view.

In the case of city streets where the TPMS 1000 only has authority over a portion of all spaces, the spaces under its control are most useful to participants when they are spread out across the city. Conventions may be followed to allow such spaces to be easily anticipated, found, and identified; for example, such spaces under control of TPMS 1000 may be placed on opposite sides of the street near the center of each block. The spaces under control of TPMS 1000 may be painted for easy identification, or the curb or lines located next to a Parking Space may be painted for easy identification. Wearable technologies like Google Glass may be updated with a database of all Parking Spaces under TPMS 1000 control, where identification of an identifying feature of one such Parking Space or the matching of GPS data with the location being viewed may cause the wearable display to depict that the Parking Space is under control of TPMS 1000, for example by overlaying the vacancy status over the Parking Space and/or a warning that unapproved use of the Parking Space may result in fines or towing. Alternatively, digitally addressable Light Emitting Diode (LED) strips may be used to dynamically display the status of Parking Spaces.

Statuses indicated by the strips may include a space being reserved, currently paid for, or open for traditional parking outside of TMPS 1000 control. The LED strips may be affixed to curbing such as by use of special paint in which the LED strips may be embedded. Alternatively, LED strips may be wrapped around parking meter poles. Alternatively, PMN devices placed on old parking meter poles may include dynamic signage such as LED or LCD displays and/or audio speaker systems to dynamically change, control, and notify visually and/or audibly which spaces are currently under TPMS 1000 control. In some embodiments, PMN 1210 devices may use NFC, Bluetooth, and/or Wi-Fi to communicate to Smartphone 100 that particular nearby spaces are presently under TPMS control.

The availability of the space between parked vehicles will be specific to the Vehicle searching for space and its Vehicle Extent, taking into account its length, and any extra distance required for safe maneuvering into the space, such as by parallel parking. However for vehicles equipped with automated means for parallel parking, this extra distance may be less, and is optionally variable to add extra space for drivers less confident in their ability to parallel park or for taking into account the difficulty of parking on steep slopes, in particular for vehicles with manual transmissions. In the case of Vehicles that position themselves automatically into a Parking Space, the Vehicle Extent required may be less in the case that the occupants vacate the Vehicle before it is positioned in a Parking Space, and thus no extra space is required for opening the Vehicle doors.

The allocation of Parking Spaces along a street can be considered a 2-dimensional packing problem where one dimension is the span of the street Parking Spaces and the second dimension is time. When a vehicle is allocated a space for a given time period, then the time dimension is fixed and the vehicle is represented as a rectangle whose length in the dimension of the street span corresponds to the Vehicle Extent's length and its length in the dimension of time corresponds to the duration of parking requested. In the event that a fixed start time is requested, a search is made outward from the most desirable Parking Space allocation until a space is found that does not overlap any other vehicle's rectangle. Because the dimensions of time and street span are unrelated, the rectangles may not be rotated when packing them as these unrelated dimensions may not be swapped.

Premium Parking Spaces are Parking Spaces that have added features generally not available in other Parking Spaces. Premium Parking Spaces may command a higher price than non-premium Parking Spaces, such as due to bidding competition or set rate. Examples of features that make a Parking Space premium are: time of day, demand levels, being covered with a roof, being at ground level, having close proximity to stairs or elevator, having close proximity to entrance or exit of a parking structure, including a charging station for use by electric or plug-in hybrid Vehicles, valet service, close proximity to a desirable location (e.g., on-street parking directly in front of a popular store), being in a gated and/or guarded location, etc. Some premium features value will change over time, for example, a covered parking space is more valuable during a snowstorm and a driveway near a sports coliseum is more valuable when a game is being played in the coliseum and consequently the rate a vehicle pays may change during its occupation of a Parking Space due to premium features changing while it is parked. Vehicle owners/operators/users may track rate changes as a vehicle is parked for a prolonged period in a Parking Space such as by entering/exiting premium time segments or other changes (e.g., a snowstorm begins) that result in a rate change. In some embodiments, users may enter into contracts that lock in the terms of their rate, and thus their rate will not change during the time they park in a Parking Space.

6. Parking Space Identification and Allocation

An application program may be provided on such a Smartphone 100 that records and/or transmits the present and anticipated geographic position of the Smartphone device, which can serve as a surrogate for the location of the vehicle, and/or occupants or Smartphone 100 user to the PSC 1100 that an occupant of the vehicle uses. The PSC 1100 is an automated data processor system that is in signal communication with multiple drivers and vehicles and accesses records of available Parking Spaces in a data structure 1112 to determine which spaces (or portion thereof) best suit the needs and priorities of each vehicle, which may also take into account needs of the vehicle occupants, or parties that plan to be picked up at a target location. Vehicles are allocated Parking Spaces by the PSC 1100 to avoid searching for parking. Ideally, the allocated Parking Space is close to the user/drivers intended destination and may be allocated based on the time they need or intend to occupy the space. The allocation of a Parking Space may also consider the starting vehicle location, since from a fuel savings and pollution reduction standpoint the closest space is better with all else being equal. Distance may be computed as any of: the actual travel distance, projected travel time and/or projected energy consumption along the prospective path. For example, a driver might wait to leave home or another location until a desirable Parking Space will be available and will be notified by the PSC 1100 of an appropriate time to leave. The driver may provide the PSC with a target time window to arrive or depart, e.g., effectively communicating a scheduling request: "I can leave anytime between 10 am and noon, find me parking that is best for my needs and wants within that time frame and let me know when to leave." This can reflect, for example, pricing, closeness, traffic or some combination of these.

In some embodiments, the function of Smartphone 100 may be temporarily provided to vehicle drivers that do not possess a traditional Smartphone 100. Such provided Smartphones 100 may be in the form of custom branded tokens similar to the transponders used by systems like FasTrak® and E-ZPass® that may be charged up with money. Such tokens may only be provided on condition of a monetary deposit or credit card hold being supplied until units are returned. These tokens may include a subset of the functionality found in a traditional Smartphone 100 sufficient for TPMS functionality but may have such functionality limited to its use only by the TPMS. Participating retailers may distribute and collect such tokens and may allow such tokens to be filled with purchased monetary credits for subsequent use to pay for parking. Retailers may also provide validation for parking to such tokens in return for shopping at their store so that parking related to such shopping may be paid for, discounted, and/or defrayed.

Figure 12:
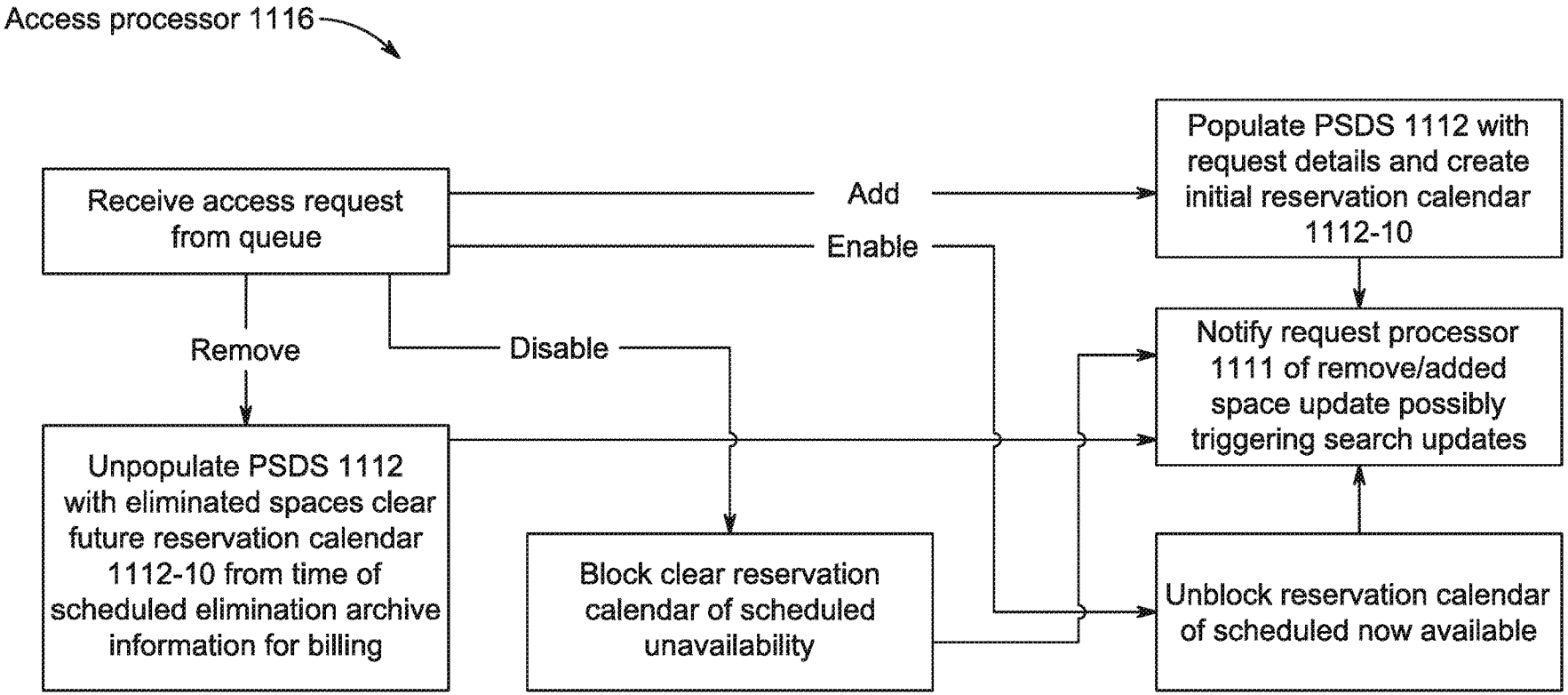
FIG. 12 is a flow chart illustrating operation of the Access Processor 1116 shown in FIG. 4.

The PSC 1100 in access processor 1116 identifies, tracks, and records the availability to access Parking Spaces. As shown in FIG. 12, the access processor 1116 receives an access request to add, enable, disable, or remove a Parking Space. In the case of an add request, the parking space data structure 1112 is populated with the access request details and creates a reservation calendar 1112-10. In the case of an enable request, the parking space data structure 1112 reservation calendar 1112-10 is updated to unblock the requested portions (time and space) of the calendar that are now available. In the case of a disable request, the parking space data structure 1112 reservation calendar 1112-10 is updated to block the requested portions (time and space) of the calendar that are now unavailable. In the case of a remove request, the parking space data structure 1112 is unpopulated with the access request details. The unpopulated request is effected in the reservation calendar 1112-10 by removal of all entries subsequent to the start time of the remove request. Once the start time submitted with the remove request is reached, the reservation calendar 1112 information may be archived for billing purposes and removed. In each of the types of access request (add, enable, disable, and remove), the request processor 1111 is notified of the removed or added space, which may trigger search updates in the request processor 1111.

Figure 8:
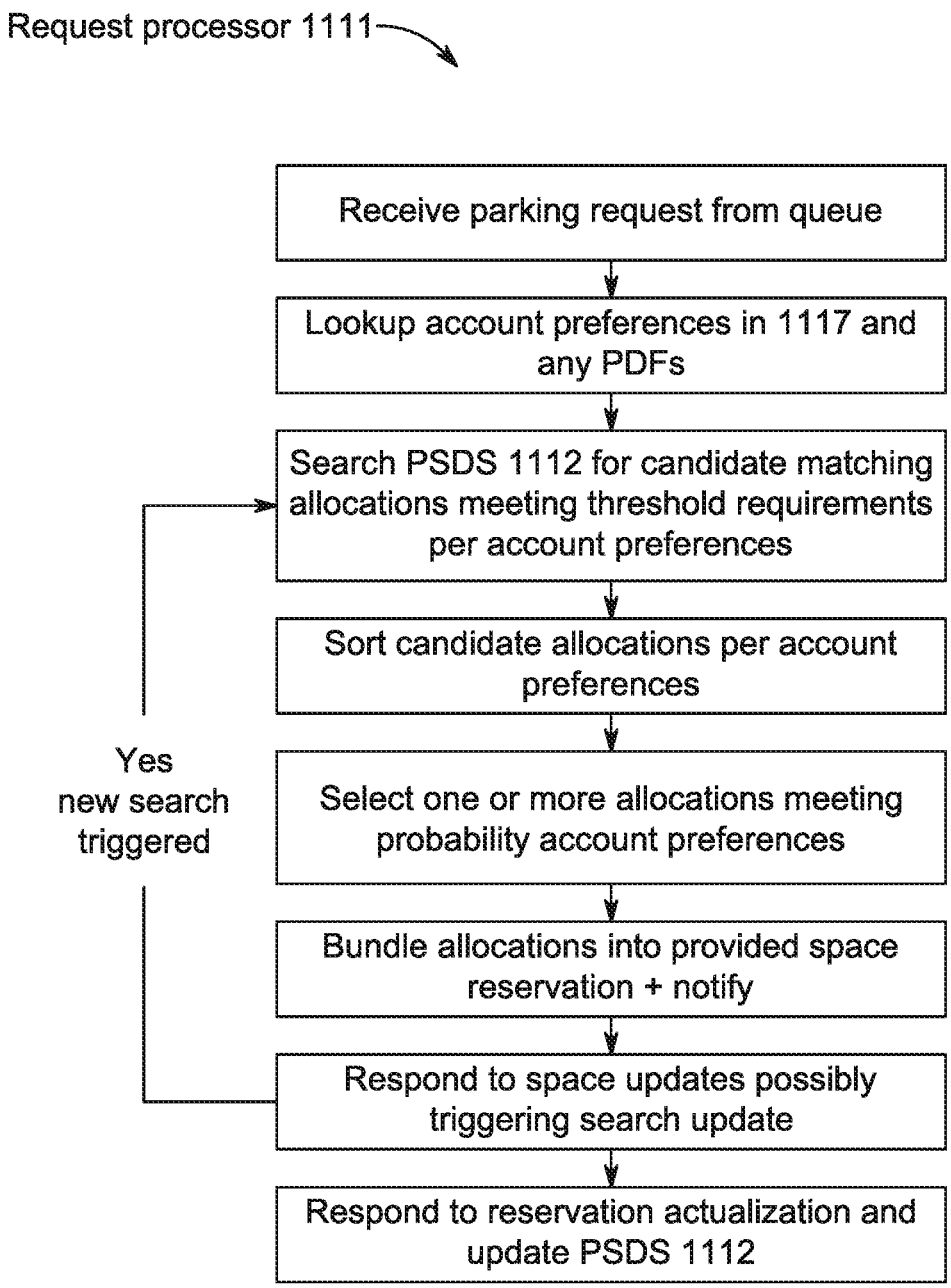
FIG. 8 is a flow chart illustrating operation of the Request Processor 1111 shown in FIG. 4.

The PSC 1100 in request processor 1111 allocates Parking Spaces to vehicles 50 in signal communication by way of signal processor 1115 that communicates over a network to Smartphone 100, integrated transceivers in a vehicle 50 navigation system, or other computing device such as a personal computer. In FIG. 8, a flow chart illustrating the operation of the Request Processor 1111 is shown. The request processor 1111 receives a parking request, such as from a queue of parking requests, for a Vehicle 50 and then retrieves account preferences and PDF(s) in the customer account data structure 1117. Request processor 1111 then searches the Parking Space data structure 1112 for candidate Parking Space Allocations that meet the threshold requirements according to the retrieved account preferences and PDF(s). The candidate Parking Space Allocations are sorted according to further account preferences and the top one or more Parking Space Allocations are selected so as in aggregate to meet probability preferences of the account. The selected Parking Space Allocations (e.g., vehicle 11 in FIG. 16 may represent one of the selected Parking Space Allocations for vehicle 11) are bundled together into a Parking Space reservation and notification of such reservation is sent to the owner of the account making the reservation. As Parking Space updates are applied to the Parking Space data structure 1112, they are searched to see whether they trigger a search update. For example, if a driver occupying a space notifies that they are going to run over their existing Parking Space Allocation and need more time, affected Parking Space Allocations that they now collide with are triggered for an updated search to resolve the collision. In the case of a triggering update, the search returns to the prior step where the Parking Space data structure 1112 is searched for candidate allocations. Next, when a reservation allocation becomes actualized by a Vehicle 50 parking in a Parking Space Allocation, the Parking Space data structure 1112 is updated to reflect where they actually parked and free up any bundled Parking Space Allocations that were not utilized. Finally, when the Vehicle 50 vacates the Parking Space Allocation, the Parking Space data structure 1112 is updated again to reflect when they actually vacated the Parking Space.

Figure 11:
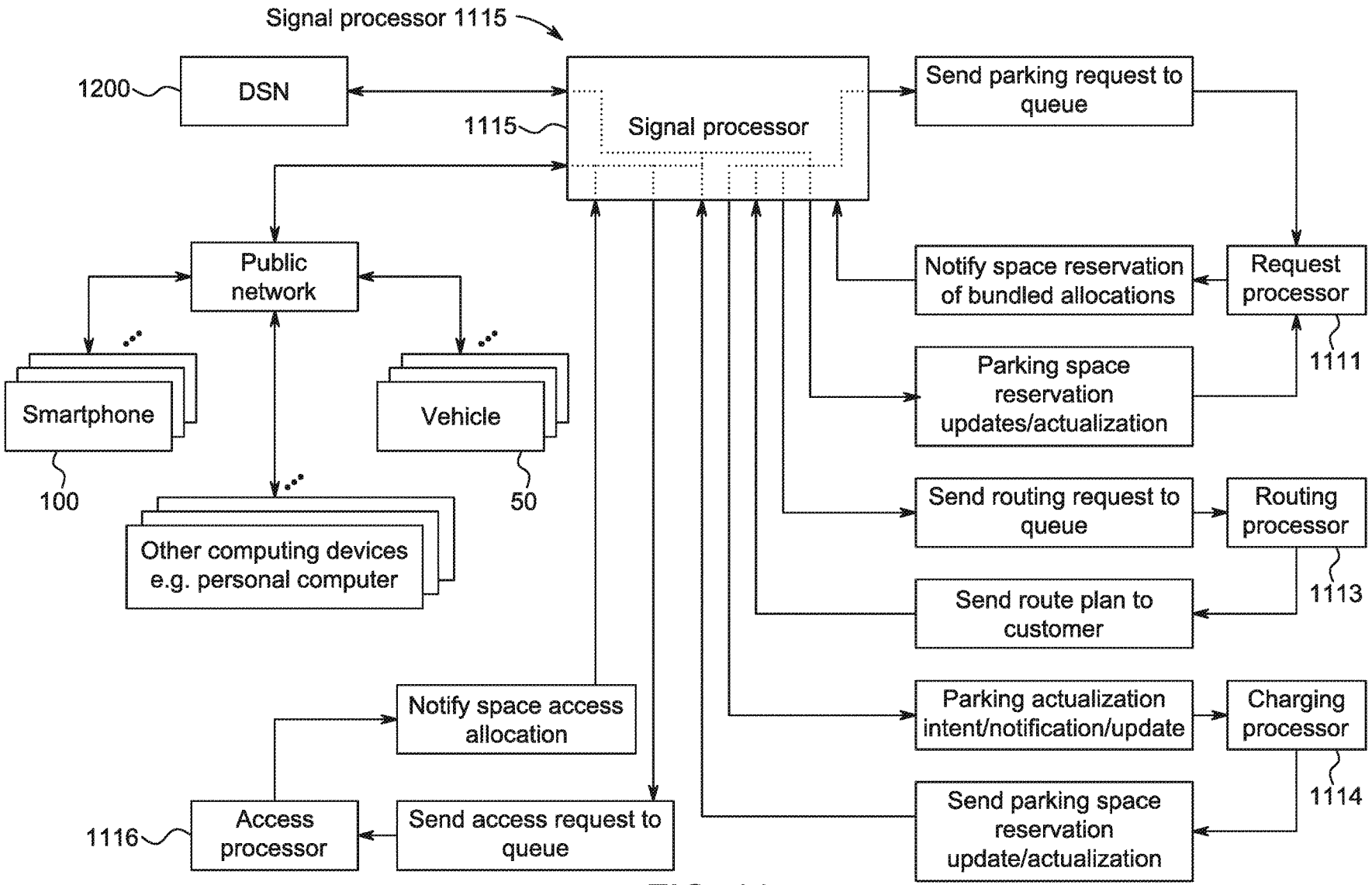
FIG. 11 is a flow chart illustrating operation of the Signal Processor 1115 shown in FIG. 4.

In FIG. 11 a flow chart illustrating operation of the Signal Processor 1115 is shown. The signal processor 1115 receives and responds to requests and notifications from Smartphone 100, Vehicle 50, and other computing devices through a public network. Signal processor 1115 also communicates with digital sensor network 1200. Upon receiving a parking request, signal processor places the request into a queue for the request processor 1111 to process. Upon receiving a parking space reservation update or actualization from charging processor 1114, the signal processor 1115 notifies the request processor 1111 for possible updates to existing reservations. When request processor 1111 updates a Parking Space Reservation of bundled Parking Space Allocations or creates a new one, signal processor 1115 is notified so it may be communicated as necessary back to Smartphone 100, Vehicle 50, and/or other computing devices. Upon receiving a routing request from Smartphone 100, Vehicle 50, or other computing devices, the signal processor 1115 forwards the request to the routing processor 1113 which then provides a route plan for the customer that the signal processor 1115 communicates back to the original requestor (e.g., Smartphone 100, Vehicle 50, etc.). Upon receipt of a parking actualization intent, notification, or update from DSN 1200, Smartphone 100, Vehicle 50, or other computing device, the signal processor 1115 forwards it to the charging processor 1114 which then forwards a Parking Space reservation update or actualization back to signal processor 1115. Upon receipt of an access request from Smartphone 100, vehicle 50, or other computing device, the signal processor 1115 forwards the request to access processor 1116 which in turn forwards a notification of a space access allocation back to signal processor 1115 for forwarding to request processor 1111 for affected Parking Space reservations.

The Smartphone 100 or similar device, if embedded in the vehicle 50, such as part of a GPS/Navigation or mapping processor, can run an application program that provides the signal communication hardware and protocol to communicate with the TPMS 1000, and relay the driver/vehicle identity, current location, and desired parking or visitation location they are driving to. Either the application on the Smartphone 100 or the TPMS 1000 may calculate an estimated time of arrival, and thus develop a parking search query for the PSC 1100 request processor 1111. The objective of the parking search query is to determine the closest available Parking Space that can be allocated to the vehicle to minimize and preclude waiting in traffic or searching for alternative Parking Spaces, such as those not allocated by the TPMS 1000. Hence, another aspect of the invention is such application programs and the processes they conduct in directing vehicles to Parking Spaces.

Upon allocation of a Parking Space by the PSC 1100, the vehicle 50 can be instructed to drive to the allocated location directly, either by the PSC 1100 generating driving instructions, providing a new address to the GPS/navigation and mapping system of the vehicle, or related driver direction regulation systems in the vehicle 50 or the Smartphone 100. Such mechanisms are intended to embrace the transmission of driving instructions to self-driving vehicles. The time at which the allocated Parking Space will become available (vacancy time) can be provided to the Smartphone 100 to permit the user to adjust their rate of travel to coincide with the vacancy commencement time. Such direction may anticipate predicted travel time to the allocated location and may suggest travel speed adjustments (faster or slower) to optimize arrival to match predicted vacancy time. Such directions may dynamically change during travel to account for changes in traffic, updated travel time predictions, and updated vacancy time predictions. In self-driving vehicles, the vacancy commencement time can be used by the self-driving vehicle to control the rate of travel when approaching the space in order to arrive just after the space becomes vacant.

Figure 5:
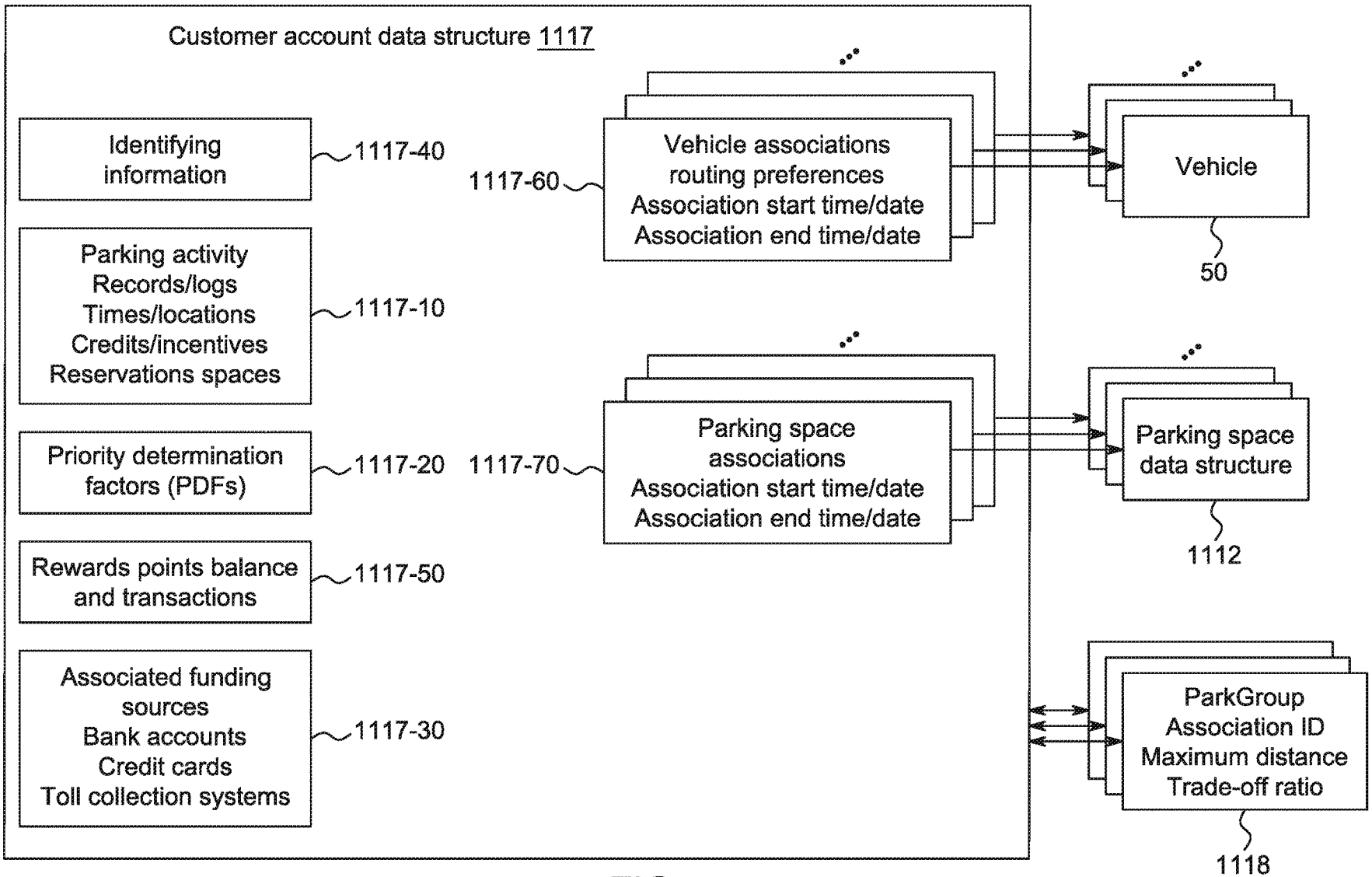
FIG. 5 is a block diagram showing details of the Customer Account Data Structure 1117 shown in FIG. 4.

In FIG. 5 a block diagram showing details of the Customer Account Data Structure 1117 is shown. The customer account data structure 1117 includes identifying information 1117-40 to uniquely describe a customer; parking activity

1117-10 that includes customer records and logs, times and locations, credits and incentives, and parking space reservations; priority determination factors PDF(s) 1117-20; loyalty rewards points 1117-20 including balance and transactions; associated funding sources 1117-30 including bank account and routing numbers, credit cards, accounts with automated toll collection systems (e.g., E-ZPass®); one or more vehicle associations 1117-60 that are linked to Vehicle 50 and include routing preferences, the dates and times that the Vehicle 50 is associated with the customer (e.g., such as for a rental vehicle); one or more Parking Space associations that are linked to Parking Space data structure 1112 and include the dates and times of start and end of a parking association (e.g., a Parking Space Allocation); a link to one or more ParkGroup 1118 that include an association identifier, a maximum distance from other ParkGroup members, and/or a trade-off ratio between Parking Space proximity within the ParkGroup and increased distance from target location.

In the case of a plurality of individuals utilizing a plurality of vehicles who wish to be allocated parking near each other, such individuals may associate their customer account data structures 1117 together into a ParkGroup 1118 that groups and/or associates their individual parking requests in order that their shared preference to park in the near the vicinity of each other may be honored. Such ParkGroups 1118 may specify a maximum distance that assigned Parking Spaces may be located away from each other in order for an assignment for the preference to be satisfied. Alternatively, a trade-off preference ratio may be specified in the ParkGroup 1118 between the increased distance from target parking location for Parking Spaces being required to achieve a particular maximum distance between individually assigned Parking Spaces. For example, a ratio of 2:1 specifies that given two ParkGroup selections of Parking Spaces whose average distance from the target parking location are 80 and 90 feet, and thus vary by a distance of 10 feet, the further ParkGroup selection with an average distance of 90 feet will only be preferred when the distance between vehicles decreases by at least 5 feet. A ParkGroup 1118 may be persistent so that it may be reused on more than one occasion and referred to by customer account data structure 1117, such as by a unique association id. When a customer requests a Parking Space allocation, the request may include a particular ParkGroup 1118 association id to specify their preference to be assigned a space near their friends that are part of ParkGroup 1118. Such a request by one member of a ParkGroup may trigger queries to the other members as to whether they wish to be included in this instance and request a Parking Space near their friends.

Figure 15:
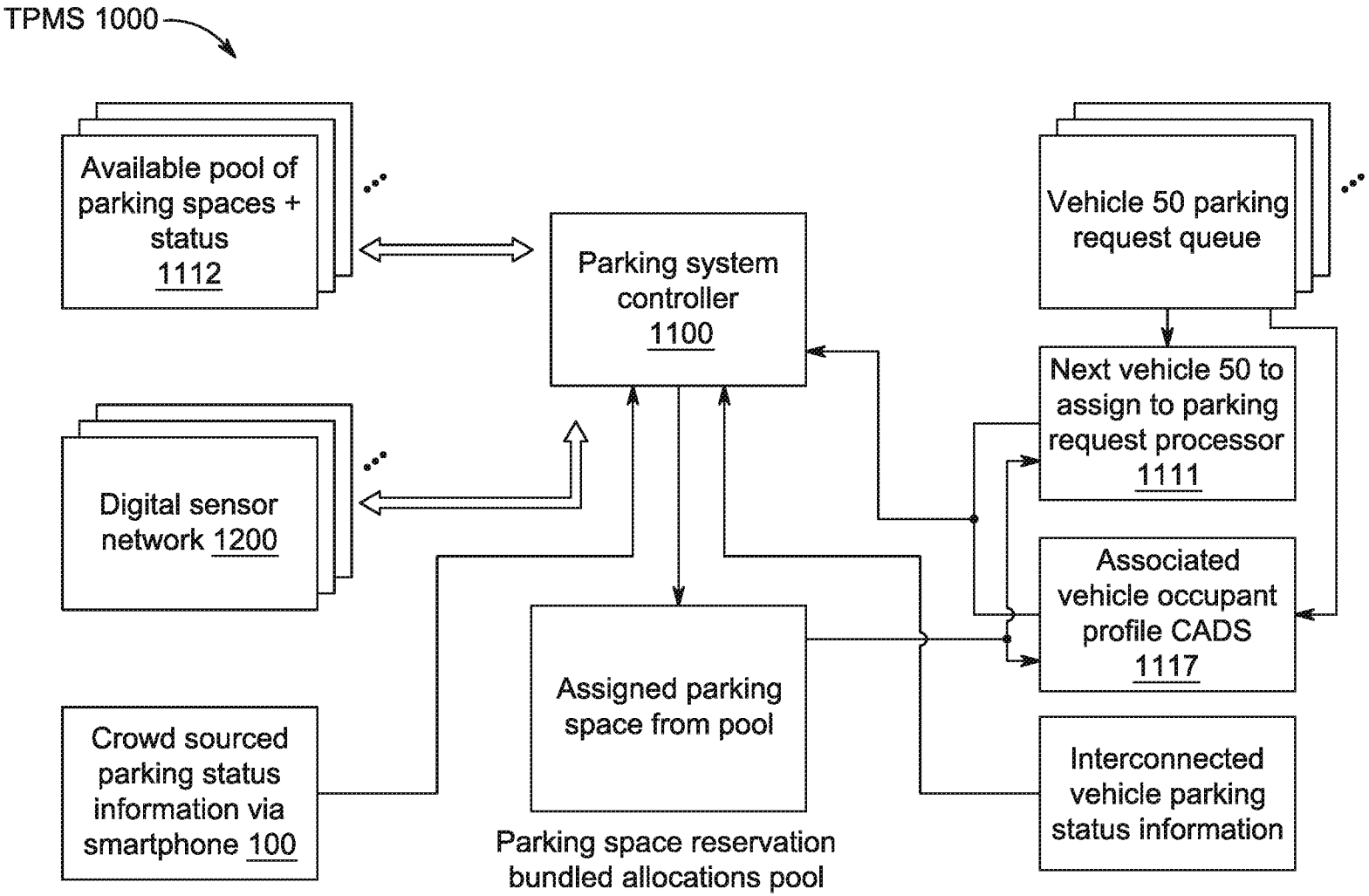
FIG. 15 is a flow chart illustrating the high-level operation of Traffic and Parking Management System (TPMS) 1000.

In FIG. 15, a flow chart illustrating the high level operation of Traffic and Parking Management System (TPMS) 1000 is presented. The Parking System Controller PSC 1100 has an available pool of parking spaces and their statuses as recorded in the parking space data structure 1112. The PSC 1100 also employs a digital sensor network 1200. Additional information on parking status may come in through crowd-sourced updates via Smartphone 100. Additionally, Vehicles 50 that are interconnected with PSC 1100 may provide additional status information updates, such as upon vacating a Parking Space. Requests for Vehicle 50 Parking Space Allocations are placed into a queue and processed by each request being forwarded to the parking request processor 1111 together with each request's associated profile for the vehicle occupants in the customer account data structure 1117. The request processor 1111 allocates available Parking Spaces, possibly as a bundled allocation in the parking space data structure 1112. The PSC 1100 communicates back the Parking System Allocation to associate it with Vehicle 50 and customer account data structure 1117.

7. Repositioning of Parked Vehicles

Self-driving vehicles can be instructed to move forward or backward (or even include sideways repositioning) to create more or larger Parking Spaces as adjacent and next nearest neighbor vehicles leave. Alternatively, self-guided vehicles can similarly be directed to temporarily move from locations, allowing driveway access locations when the owner/tenant leaves or approaches their property, or be directed to move forward/backward/sideways to better accommodate other vehicles leaving or entering Parking Spaces, and allow for better/tighter space utilization. In the case that a vehicle is disabled such as due to vehicle failure, nearby vehicles may be directed to move in any of the aforementioned manners in order to provide more efficient or easier access to the disabled vehicle so that it may be loaded/attached more readily to a tow truck or so that it may be accessed in place for repair. In similar fashion extra access space may be required around a parked vehicle, and thus nearby vehicles may be directed to move, in order to allow for vehicle service access in the vehicle's parked location, such as to replace a windshield, wash and detail a vehicle, or load/unload large objects into/from a parked vehicle.

Alternatively, a driver may leave their key inside their Vehicle 50 and a code may be securely delivered to a Smartphone 100 of another authorized person via an alternative implementation of the inventive application so this authorized individual can open the vehicle and retrieve the key. Alternatively, Smartphone 100 may be instructed to open the vehicle and/or start the vehicle engine, such action may be transmitted by near range wireless communication between the Smartphone 100 and vehicle such as by using Bluetooth or Wi-Fi communication. Such retrieval is usually for the purpose of a non-owner temporarily moving the vehicle whose parked location otherwise obstructs or hinders access to a location that is needed and possibly returning the vehicle to its original parked location when location access is no longer needed.

Alternatively, for vehicles with an electronic key fob and start button electronic ignition, upon gaining entry to the vehicle, the vehicle may be directed to start without the electronic key fob being present and with the Smartphone 100 generating an equivalent or substitute wireless signal under command of the application program, temporarily replacing the fob.

Alternatively, the vehicle key may be stored in a lockbox that may be opened with a traditional key or with a code supplied by the parking system to authorized users. Such codes may only offer one time access and change with each code use.

Alternatively, the vehicle keys may be stored in the trunk of the vehicle so the Smartphone 100 user can similarly generate a wireless signal to open the trunk and gain access to the vehicle key.

The Smartphone 100 may be programmed to only be able to open, access, control, and/or operate the vehicle for a limited time window or for a limited number of occurrences. The Smartphone 100 may be programmed with security features that require the non-owner driver of the vehicle to identify themself before allowing access to the vehicle. Biometric methods may be used to identify themself such as facial recognition or voice print recognition or some combination of multiple biometrics or other security measures such as security questions or codes/passwords.

Additionally, the non-owner driver may be challenged to prove their sobriety or capacity to drive through a quick test such as a breathalyzer or with an eye scan to determine impairment or capacity to drive such as by oculometric (biometrics tied to the movement and condition of the eyes) technology as provided by Eyefluence™ or a quick mental acuity test on their Smartphone 100. Alternatively, a movement test may be administered using the accelerometer of their Smartphone 100 that requires them to fluidly move their Smartphone 100 in a certain pattern that mimics the motion they have previously demonstrated when known to be unimpaired. In one embodiment, this may be a 3-dimensional pattern that depicts a form they previously defined (such as mimicking the motion of handwriting a word in space where the word may change from one challenge to the next but the pattern is based upon learning how they write in this fashion) and a when a new challenge word is found to deviate too substantially from learned patterns, the driver is not allowed to start/operate the vehicle. Another example is to have the challenged person create an inward spiral motion of a predetermined number of rotations to a center point where the regularity of their spiral and number of turns is checked against previous tests while known to be sober. Another method may require a challenged user to draw a pattern (e.g., inward spiral) with their finger on their Smartphone 100 screen that is compared against their norms when not impaired. Alternatively, they may have to play a simple game of tapping the screen to test their reaction time analogously to the Whack-a-Mole™ game to prove they are not impaired. Other games might be a driving simulation game or a maze game where you roll a virtual ball through a labyrinth by tilting the phone. Such games ideally take less than fifteen or thirty seconds to play and have been played previously while not impaired to create a benchmark standard of unimpaired performance.

Such enabling of the vehicle 50 for a non-owner driver's use/operation is correlated with the GPS of the vehicle to prevent it from being moved too far from the parked location. This may be done by sending a signal to the vehicle to first warn the driver and then shutdown if the vehicle continues to go too far from the original parked location.

In some embodiments, the vehicle 50 may track accelerometer and/or other sensor information for the vehicle while it is being moved by a non-owner and create alerts to the owner when unusual acceleration, motion, sound, and/or sensor data is detected as well as triggering the persistent capture of "black box" data, telemetry, measurements, video and/or photographic records before and after such triggering events for the purpose of detecting and documenting possible damage to a vehicle while being moved by a non-owner. Such data may be compiled in a rolling window covering the immediately preceding time frame, for example, the previous thirty seconds of data is continuously maintained in a circular buffer. When a triggering event occurs, the rolling window is captured at the point of trigger together with subsequent data in the time period, of possibly different duration, immediately following the triggering event. Such data includes on board vehicle technology sources/sensors, whether factory installed or subsequently added, such as cameras, proximity sensors, air bag/crash sensors, and tire pressure sensors. When a plurality of triggering events occur wherein the captured data time frame window of such events overlap or nearly overlap each other, such triggers may be coalesced in order that a single alert may be triggered and/or a single extended time window of data may be captured.

In some embodiments, the non-owner driver's Smartphone 100 may provide accelerometer and/or other sensor data by requiring the phone to be mounted to a secure location within the vehicle before it may be started/operated and further require it be maintained there while the vehicle is enabled.

In some embodiments, a user of the system may use the system to offer to move other individuals' vehicles within the system on their behalf. Alternatively, users may request access and use of parked vehicles and pay the vehicle's owner for this use and the ability to park in a new location as a means of temporary transportation. For example, a user may be flying out of the SFO airport and drive to the airport and park in the short term parking, knowing that another user, coordinated by the parking system, is just landing and will take their vehicle back to San Francisco where they will be paid for its use during their vacancy while travelling. Shortly before their return flight lands, another user takes the vehicle back to short term parking at SFO as their transportation to the airport and the user gets off the plane and is directed to their vehicle's new location in short term parking. Alternatively, upon landing, they may be directed to another user's vehicle recently placed in short term parking and take the other user's vehicle back to San Francisco to pick up their own vehicle or go to some other desired location.

An owner may desire their vehicle be moved due to a forthcoming rate increase for their current parked location or because it is parked in a premium priced location (e.g., airport short term parking) and may offer to pay another user to move their vehicle on their behalf or to move it closer to their current location if they have traveled significantly away from their vehicle since parking. Alternatively, they may pay to access other parked vehicles in the system to drive themselves closer to their own vehicle or get picked up by another user in the system and share a ride back toward their vehicle.

The system may be used as a ride-share system to track your location and speed, to know where you are going and when you expect to arrive at a pick up point, and coordinate another driver meeting you, to give you a lift, possibly refining the meeting point location dynamically to optimize the meet up. Alternatively, upon meeting another person driving, they may relinquish control of the vehicle to you or may drive you part way and then relinquish when they are at their destination.

In some embodiments, taxi cab drivers may list themselves in the ride-share section competing together with individual users and listing their offered pick up location, pick up time, drop off location, drop off time, and pricing bid for the service. In some embodiments, the driver of a ride-share (whether a taxi driver or individual user) has recently demonstrated they are not impaired before picking up a passenger. Accordingly, the above aspects of the invention are intended to be enabled by the PSC 1100 via multiple communications with the Smartphones 100 of the various drivers, utilizing the application program capability thereof to submit vehicle use as well as parking requests. Moreover, taxi stands are virtual and use vacant parking until someone pays more to park there. Instead of dedicated space, the virtual taxi stand is in the vicinity of this end of the block. A person may use their app to say I want a taxi and it may be integrated with the plane landing automatically so as to be available just in time as they reach the curb after getting off the plane and retrieving any luggage. The taxi may also be employed to provide transportation to a Parking Space. Because the taxi is idle anyway, it gets better utilization and offers a discounted price built into the parking fee. Bidding may be employed with a share going to the city if the bid is higher than the required taxi fare. Taxi ads in the vehicle may be integrated with a user's profile to permit more directed targeted advertising.

In some embodiments, public and/or private buses may place their vehicles into service using the TPMS 1000 to facilitate and allocate their use to create spontaneous bus routes whose paths and schedules vary over time to meet the changing demands/needs of users. Such buses may include any vehicle where a driver picks up, transports, and drops off passengers. Users may register a request for transportation between two points at a requested time with TPMS 1000 and be matched with potential buses offering to provide such transport. Such requests may include a designation of, commitment to, and/or prior satisfaction of some level of business transaction with one or more businesses at or related to either or both ends of the transportation request. Matching offers may include variable factors including pricing/terms, vehicle kind/certification, driver kind/certification, pick up/drop off location/time, and/or vehicle route. Matching offers may be sorted and/or filtered among the variable factors to facilitate a user picking one for their needs. In some embodiments, users may propose one or more counter offers with revised terms back to bus providers for their possible acceptance. Such offers and counter offers may be managed by the TPMS 1000 to ensure only one such offer is accepted, possibly giving priority to the first such acceptance received by TPMS. TPMS 1000 in communication with Smartphone 100 may help direct passengers and/or bus drivers to meet, locate each other, and/or communicate with each other (e.g., voice telephone connection or text messages) and/or provide real-time updated estimates of pick up and/or drop off times.

Businesses may defray the cost of passenger customers travelling to or departing from locations related to their business and such adjustments may be reflected in the pricing/terms of offers presented to users. Businesses may join together to share the use of busses. For example, at an airport, multiple vehicle rental companies may share a single fleet of buses to transport customers to and from the terminals. Customers and/or businesses may register transportation requests such that, for example, upon landing, Smartphone 100 notifies TPMS 1000 of landing and creates an estimated arrival at the curb ready for transport to the rental company. Such requests are combined by TPMS 1000 and allocated to the fleet of buses to optimize each customer's transport so as to minimize their wait and minimize the duration of transport. Such optimization may benefit from combining requests onto the same bus at overlapping times where at least the pickup terminal coincides or the drop-off vehicle agency coincides.

Buses may be equipped with monitor display side, front, and/or back panels that display messages and/or branding to dynamically brand a bus with a message meeting the needs of passengers and/or sponsoring business when picking up or dropping off passengers whose transportation cost the business has paid for, at least in part. Panels may include the use of window displays that allow riders to see out of the bus but from outside present a monitor that provides a display hindering looking into the bus through the windows. Such window panels may be achieved by perforating a display mechanism affixed to a window with an array or lattice of small transparent holes that in aggregate provide enough light at a sufficient distance to adequately see out of the bus but which when viewed from outside the bus are obscured by the more dominant lit display in the areas around the lattice holes. Furthermore, see-through OLED displays or LCD screens that do not require backlighting such as the Samsung Smart Window may be used as see-through electronic displays. Such panels are in communication with TPMS to dynamically control their content according to passenger pick up and drop off as monitored and controlled by TPMS. For example, in the vehicle rental airport example given above, the bus sides can become dynamically marked with distinctive Hertz coloring, pictures, icons, logos, and words when picking up passengers that are Hertz customers. In the case that at a single stop, multiple vehicle rental agency customers are boarding together, the siding can be shared by the agencies by either alternating the display screen in time across the agencies or by dividing the display screen real estate into a portion for each agency and place such allocations statically or scrolling/moving around the bus with optionally the scrolling real estate exceeding the actual display area and thus a rotating portion always being hidden.

In some embodiments, businesses, analogous to Zipcar, may place their vehicles into service using the TPMS 1000 to facilitate and allocate their use and storage. Users may locate available vehicles in their vicinity and use them to travel to their destination and purchase parking to store the vehicle at the destination. Users may relinquish control of the vehicle when they desire but may be required to pay for storage until a subsequent user takes possession of the vehicle, possibly by holding the vehicle and assuming subsequent storage costs until they are ready and/or able to pick it up and travel. Users may be offered special drop off Parking Spaces that provide incentives such as rebates and/or reduced rate or free parking. Alternatively, users may be provided disincentives from parking in certain locations in the form of surcharges and/or increased rate parking. Such incentives/disincentives may vary over time and help to balance the supply and demand for the distribution of such vehicles to avoid a surplus or deficit of stock from accumulating in any one location/vicinity.

8. Priority

It is preferred that the DSN 1200 is capable of communication with the PSC 1100 to detect the status of all Parking Spaces, so the PSC is also operative to log the occupation of spaces by vehicles that are not authorized, and to alert a civil authority to issue parking violations and/or to remove vehicles. Additionally, when a vehicle that is not authorized occupies the originally assigned Parking Space, the PSC may automatically assign a suitable replacement Parking Space for the driver/user of the authorized vehicle and automatically adapt to any changes required by the new assignment including updating pricing (e.g., compensation for inconvenience and/or rate changes) and/or route directions.

However, the driver/user of the authorized vehicle if confronted with the misappropriation of their allocated Parking Space is also capable of alerting the PSC of the same as they request a new Parking Space.

In some embodiments, Parking Space allocation includes an allocation for the vehicle to drive along its route to and/or from the allocated Parking Space. A driver's bid may, in addition to the Parking Space, also include allocation of the whole route being available for their unobstructed travel to and/or from the Parking Space. In such a view, a Parking Space is just an allocation of space for a vehicle and such allocation may be generalized to be a moving allocation, optionally within a pod with other vehicles. Such allocations ensure optimal travel lane utilization by ensuring only vehicles reserving a space are present in a lane and thus the avoidance of traffic slowdowns due to overutilization.

Figure 7:
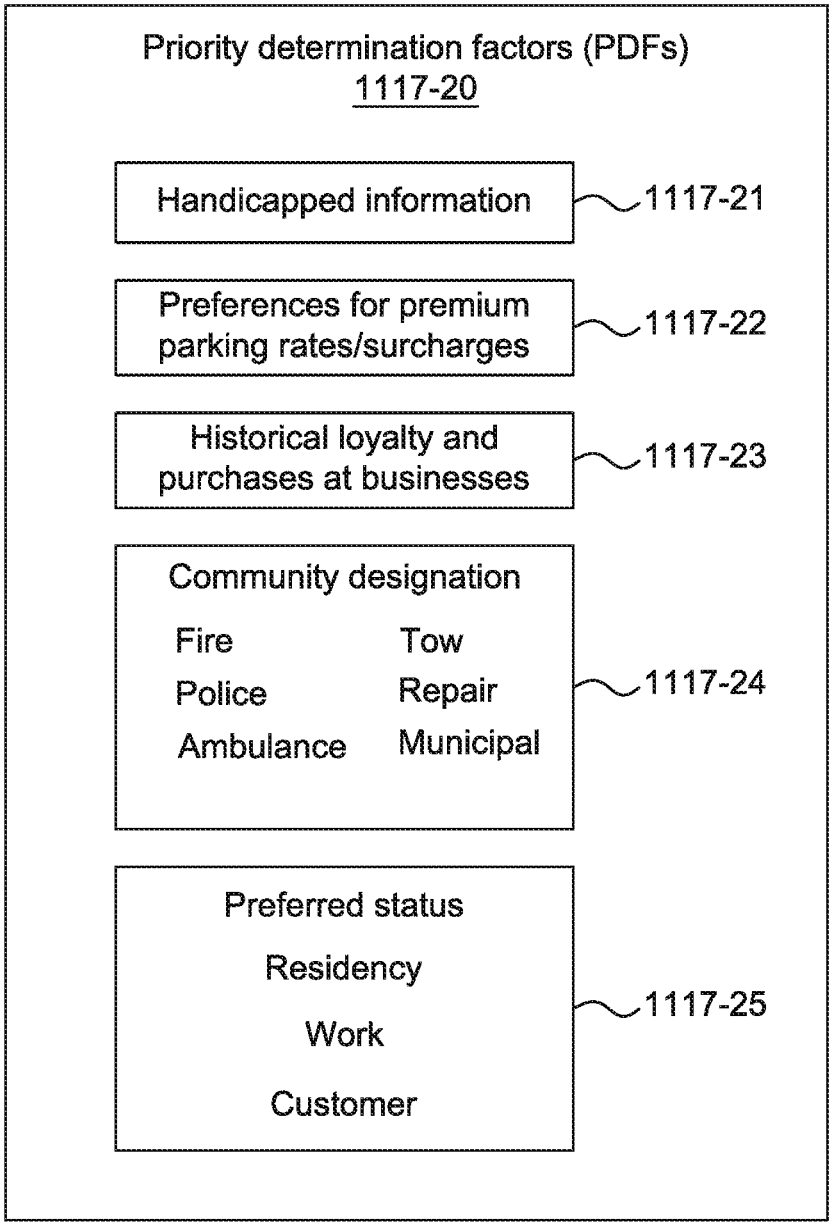
FIG. 7 is a block diagram showing details of the Priority determination factors (PDFs) 1117-20 shown in FIG. 5.

As shown in FIG. 8, Parking space allocation of request processor 1111 may be done in real time, in response to the vehicle's communicated need for location, duration, and Parking Space size, and any Priority Determination Factors 1117-20 (PDFs). As shown in FIG. 7, PDF(s) may include handicapped priority access 1117-21, preferred status due to residency, work, or customer affiliation 1117-25, willingness/preference to pay or bid more (e.g., surcharges) for premium Parking Spaces 1117-22 closer to a desired location, or within walking distance or a mass transit route thereto, community vehicle designation (e.g., fire, police, ambulance, emergency, municipal, repair, tow, or delivery vehicles) 1117-24, as well as past loyalty or purchases 1117-23 at business establishments that wish to offer parking refunds, rebates or advances based on the likelihood of future purchases.

Further, vehicles used in providing municipal, police, fire or emergency repair services can receive a high priority PDF 1117-20, placing them ahead of commercial or delivery vehicles, which themselves might have a higher priority in some times and locations than the priority of private vehicles. Vehicles with short parking duration may also get priority over longer term parking vehicles. Further, carpool vehicles (High Occupancy Vehicles—HOV) can have a higher priority PDF 1117-20 than single or low occupant vehicles. The PDF 1117-20 and related account information for each vehicle is optionally stored in the customer account data structure 1117 of the PSC 1100. Vehicle 50 has its Customer Account Data Structure 1117 debited according to a tariff schedule 1112-21, which is optionally fixed or variable. Ultimately the customer preferably has an associated real cash balance in a bank account 1117-30 correspondingly linked to the Customer Account Data Structure 1117 or credit available from a commercial or bank credit card service 1117-30. Such a service can link or be associated with a public bridge and toll collection system 1117-30 such as FasTrak® or E-ZPass®.

In addition to individuals, businesses and governmental entities may also have Customer Accounts and thus have entries in the Customer Account Data Structure 1117. This allows the vehicles of such non-individual entities to also participate in the TMPS 1000. Thus, an individual owner, occupant, or driver may utilize multiple Customer Accounts depending upon their roles. For example, a vehicle owner may run a business and have a family and thus require parking in both roles for the same vehicle at different times but wish to account for such parking within the role they participate in when parking. In some embodiments, vehicles may be autonomous (self-driving) and thus not have any driver or occupants at times yet still participate in TPMS 1000 by way of the Customer Account of their owner. At times, a vehicle may be under the control of someone other than the vehicle's owner or the ownership may transfer from one person to another. Therefore, the Customer Account Data Structure 1117 may include the assignment of responsibility for parking a Vehicle 50 for set time period that corresponds to their temporary use/assignment of Vehicle 50 such that during their assignment, their account reflects any charges or credits incurred by their use of TMPS 1000.

9. Selective Deployment

It should be appreciated that the deployment of multiple PMN(s) 1210, 1210' and 1210" forms an intelligent surveillance network that is preferably wireless and redundant through looped and multiple connectivity of the each PMN 1210 to one or more others in its signal range. The DSN 1200 disclosed herein also enables a selective deployment of the TPMS 1000 for private use, such as in a corporate parking or shopping garage, as well as public use in high demand areas, as the need arises, without the construction of another communication network or deployment of sensors in streets. However, in the case of enclosed spaces, such as underground or multi-story garages in which GPS signal reception may be poor, detection of Wi-Fi networks by the vehicle/user can initiate the automated deployment of signal triangulation by the PSC to detect the location of a vehicle/user in such a garage or enclosed space.

As the PSC maintains a record of each parked vehicle and the Smartphone 100 or the user that parked the vehicle, another process that is optionally enabled by the Smartphone application software is providing a user walking and/or public transportation direction back to their parked vehicle. Such direction can include consideration of safer and better-lighted routes, favoring routes utilizing crosswalks under signal control, avoiding areas with dense foot traffic (e.g., area around a theatre just letting out after a performance), avoiding areas without sidewalks or closed for construction, avoiding areas of higher pollution concentrations (e.g., streets clogged with standing traffic), avoiding vehicular traffic and the like.

Additionally, the PSC 1100 may be authorized by a user (e.g., by specification using their Smartphone 100) to provide directions and/or access/entry (via one or more of the methods described herein) to their vehicle to a third-party in order for the third-party to perform services for the authorizing user on their vehicle while it is parked, e.g., to replace/repair a windshield, to wash/detail their vehicle, or to deposit/pickup packages in their vehicle.

Further, in the case of garages and parking structures with height limitations (which can be inherent or due to use of luggage/roof racks on the vehicle), any routing instructions need to be based on vehicle specific limitations, and are made in reference to a 3-dimensional map of the leveled garage or parking structure. Further, the DSN 1200 can also detect that the Vehicle Extent of a vehicle has changed with the addition of rear accessories such as a bike rack or trailer. Similarly the DSN 1200 can also be operative to detect temporary roof items, as a vehicle approaches the garage with height limitation, in order to provide via the PSC an alert to the driver to abort parking when such temporary items make the vehicle to tall, long, or otherwise unfit for a garage. A similar accounting can be made for a limited turning radius of some vehicles or the difficulty of backing up such as when pulling a trailer.

Parking spaces once identified and allocated to a vehicle are preferably exclusively available only to that vehicle for a flexible or limited time period.

To preclude other vehicles not authorized to park at the locations under the authority of the TPMS from utilizing these locations, the use of a Parking Space can be subject to independent verification, or verification by the networked PMN(s) 1210.

10. Management of Private Parking Spaces

To the extent the owner of a private space or the access to the private space (e.g., parking in front of a driveway or garage door) has no need to use the space over a specific period; they can offer the space and time slot to the control system for matching with the needs of specific vehicles.

Hence, it is also anticipated that a property owner can be in signal communication with the PSC 1100 through a Smartphone 100 utilizing an appropriate application program or a general purpose computer via the Internet or another wide area or local area network to convey the access rights for a limited time or times to the PSC for sub-license to other vehicle(s). As shown in FIG. 5, it is anticipated that such a property owner is registered with the PSC in a Customer Account Data Structure 1117 that includes their identity 1117-40 and/or banking account information 1117-30 for the purpose of crediting parking fees earned, as well as Parking Space Associations 1117-70 to Parking Space Data Structure 1112 that contain Parking Space information including the geographic identity, descriptive/technical photographs 1112-40, available parking hours and days in Reservation Calendar 1112-10 and/or Association Start and End time dates at 1117-70, bonus features 1112-50 (e.g., availability to purchase extra options such as a vehicle charging station, a vehicle washing/detailing service, hot/cold water access, and/or electrical/charging access) and conditions 1112-70. Conditions may include that a driver utilizing the space must make the vehicle available for movement by the property owner and/or their assignees, via one or more of the methods described above. Hence, it is anticipated that for drivers subscribing to the PSC, there is a corresponding data structure 1117 storing their account information 1117-30, vehicle association(s) 1117-60 to Vehicle 50 that may include license plate number or other identifier, and capability of moving the vehicle(s) with either a stored key or electronic entry or ignition signal, and their willingness to authorize another person, such as the property owner to move the vehicle.

Identification and tracking of unoccupied spaces is preferably performed by a Digital Sensor Network (DSN) 1200 that is in signal communication with the PSC 1110 of the TPMS 1000. However, to the extent that a private property owner wishes to monitor their driveway or garage access being offered for use by others, they may install sensors such as a private security camera which can also be in signal communication with the DSN to alert and track the status of vehicles authorized and charged to park in the owner's private property. They may install additional sensor nodes PMN 1210 in signal communication with the DSN 1200 to alert and track status of vehicles. Such additional PMN 1210 may include sensors 1211 that may be analogous to microphones, garage door safety infrared sensors to detect vehicle ingress and egress, or magnetic field sensors analogous to buried security gate sensors used to open a gate when a vehicle approaches for exit and drives over the sensor, or RFID tag sensors, or inductive sensors, or treadle sensors (possibly offset-treadle installations), or light-curtain laser profilers, etc. Accordingly, if the private security camera or other sensor(s) detects a vehicle, other than the owner's, in or blocking egress to the driveway or related Parking Space, the PSC can confirm the vehicle is registered and/or authorized to utilize the space. If not, the PSC can then alert the civil authorities or others for citation, booting and/or removal by towing. It should be understood that parking revenues for private property and egress to private property can be split or shared with a municipality as a tax or a service fee for effectively "policing" private space, or via a share of the fines and charges for trespassing by parking on a private space without authorization by the owner, via the PSC. Similarly, any registered user/member may earn a share of the fines and charges for trespassing by unauthorized parking in any public or private spaces without authorization via the PSC 1100 by reporting such violations using Smartphone 100 to PSC and effectively "policing" spaces under control by the PSC.

Thus, one mode of the inventive method deploys multiple PMN 1210 that form the DSN 1200 throughout a city, the traffic flow and Parking Space availability can be communicated to the PSC 1100 of the TPMS 1000 for allocation to specific vehicles that suit the demand needs. For example, in the case of high traffic flow (such as special events, accidents or road construction) or air pollution alerts, smaller, less polluting or electric vehicles only might be directed to the city center, while larger vehicles might be directed to more distant locations where they are instructed to use mass transit systems. Events communicated to the PSC 1100 such as special events, days with high air pollution, accidents, or road construction may be reported through crowdsourcing, from a municipal source, etc. In another and optionally combinable mode, the PSC simply allocates vehicles to private Parking Spaces that are not monitored by a DSN, and optionally tracks and charges for utilization based on confirming with the vehicle navigation system, via a GPS record, the time the vehicle spent in the allocated Parking Spaces.

11. Availability Prediction

Preferably, the PSC 1100 not only allocates vacant Parking Spaces to vehicles 50, but also predicts or controls Parking Space availability by statistically analyzing individual Parking Spaces, blocks, or zones to find and/or alter typical use patterns as well as analyzing the locations of users to predict location availability, and allocates Parking Spaces based on such future predicted availability.

For example, a user who has gone to shop at a particular store can optionally be tracked from when they leave the store to predict when they will return to their vehicle. Such prediction may be based in part upon that user's history of average time and variance between leaving a store and returning to their vehicle for various distances between the store and their vehicle.

In some embodiments, one or more parking system allocations may be bundled together into a single space reservation such that the predicted probability of at least one such parking system allocations being vacant when the reservation is to be actualized by a vehicle parking exceeds a desired level. For example, Mary's Customer Account data Structure 1117 may include a preference that reservations should be at least 96% likely to be fulfilled and thus a particular two-hour reservation for such user may be composed of four allocations bundled together and ordered by selection priority wherein the first and most preferred allocation has an 78% predicted probability of vacancy, the second allocation has a 20% probability of vacancy, the third allocation has a 42% probability of vacancy, and the fourth and least preferred allocation has a 62% probability of vacancy. In such a case, the combined probability of at least one such allocation being vacant is 96.12096%, thus satisfying the required 96% satisfaction rate threshold. Mary's allocations are annotated with their probability of utilization if an allocation will actually be available as 100% for the first allocation, 22% for the second allocation, 17.6% for the third, and 10.208% for the fourth. These predicted usage probabilities allow for secondary or backup allocations to coincide with the example allocations, all such allocations are ordered by priority of their registration such that lessor priority allocations are only fulfilled if any prior registered allocations are not utilized. In the preceding example, the first allocation of Mary is not allocated at a lower priority to any other users because it is the first choice of Mary and will be taken if vacant, but the second allocation having a 20% likelihood of vacancy for Mary but only 22% chance of being used by Mary, the second allocation can be a backup allocation to yet another user and have a 15.6% likelihood of vacancy for them, while the third allocation backup has a 34.608% likelihood of vacancy, and the fourth a 55.67104% backup likelihood of vacancy. Such probabilities may be adjusted to account for differing required vacancy times, allowing the above first allocation to have a backup allocation that commences 15 minutes after Mary's requested start time and thus if the probability of vacancy increases to 98% 15 minutes later, then the probability of availability for a lower priority backup allocation starting 15 minutes later is 21.56%.

Alternatively, future availability of Parking Spaces A1-9 or B1-9 (as shown in FIG. 2) can be assured by the allocation of time blocks to vehicles in reservation calendar entries 1112-20 in reservation calendar 1112-10, in which the vehicle must vacate the Parking Space by a specific time. If the Parking Space is determined to be vacant by the DSN 1200 before the expiration of an allocated time block, then it can be reallocated to a different vehicle or driver. The DSN can report any change in parking status to the PSC 1100.

A prediction of the vacancy of an occupied Parking Space can be made for a vehicle/driver that has been allocated and is using (parking in) a Parking Space can be determined in several ways. First, they can simply be asked via a text message or similar query to their Smartphone 100 to provide advance notice of when they plan to vacate the Parking Space, which might be predicable by the use of the Smartphone when they leave a store and start walking to their vehicle.

Alternatively, the application program on the Smartphone that communicates with the PSC 1100 can be configured to track their location. Thus, for example, if they requested parking near a particular store, the application program can be operable to report to the PSC 1100 when they arrive at the Parking Space, arrive at the store, and leave the store. Upon the detection that they have left the store, a text message or similar query to their Smartphone 100, asking them to provide advance notice of vacation and/or confirm that they intend to presently return to their vehicle and vacate the Parking Space. As the predicted walking time or public transit access time can be computed from their present location to the allocated Parking Space their vehicle occupies, in part based upon their own historical patterns of movement, it is possible for the PSC 1110 to log a potential probable vacancy time and expected variance for that prediction for the precise Parking Space their vehicle currently occupies. The computation can be performed either with the Smartphone 100 or the PSC 1100. However, the intent is for the status of each potential Parking Space (shown schematically in FIG. 2 as A1-A9 and B1-B9) to be stored in a Parking Data Structure 1112, so the current and predicted future availability of each Parking Space is stored in the TPMS 1000 can be known. Such prediction can optionally include the assignment of a probability of one or more Parking Spaces being vacated by the time the next user arrives and requires a Parking Space allocation. Hence the PSC can then assign or associate the next user with one or more Parking Spaces in a predetermined area such that the probability of at least one being available when they arrive exceeds some threshold probability.

Thus, the Parking Data Structure 1112 has a data set corresponding to physical Parking Spaces and dimensions, a current parking status associated with each Parking Space in reservation calendar 1112-10, and in reservation calendar entry 1112-20 if the space is used, a vehicle identifier, as well as a predicted future free/vacation time, which optionally also includes the results of a calculation that functions to predict a probability of being freed at a given time (e.g., 50% likely free in five minutes 95% likely free in ten minutes).

12. Parking System Controller (PSC)

Other components of the PSC 1100 are optionally a Routing Processor 1113 to provide driving instructions to Vehicles 50 based on one or more actually or potentially available Parking Spaces being allocated by the Request Processor 1111, which is in communication with other components via conventional communications means, shown as a data bus. The Request Processor 1111 queries the Parking Data Structure 1112 to find available Parking Spaces in time and geographic space coordinates, and changes the parking status data in reservation calendar 1112-10 and reservation calendar entry 1112-20 for a Parking Space when an allocation is made, possibly dividing a Parking Space into pieces of different status (e.g., occupied or vacant) when an allocation within a Parking Space is partial. Also connected to other components via the data bus is the Signal Processor 1115 which receives and transmits communications with the DSN 1200 as well as any public communication network used by drivers or Smartphone owners when they request information of the availability of space or request for an allocation of space near a location or particular event, such as a sporting event, or performance. Thus the Signal Processor 1115 can communicate requests to the Request Processor 1111, which queries the Parking Data Space Structure 1112 to find potential Parking Spaces that best fit the query profile and any PDF(s) 1117-20. Such PDF(s) are optionally stored in the Customer Account Data Structure 1117, for access by the Request Processor 1111 to determine priority, special access, billing privileges or preferences of certain customers. A PDF might include handicapped/mobility status, preferred shopper status, area residency, or prior credits and incentives reflected in the Customer Account Data Structure 1117 for the owner/operator of vehicle 50.

Figure 9:
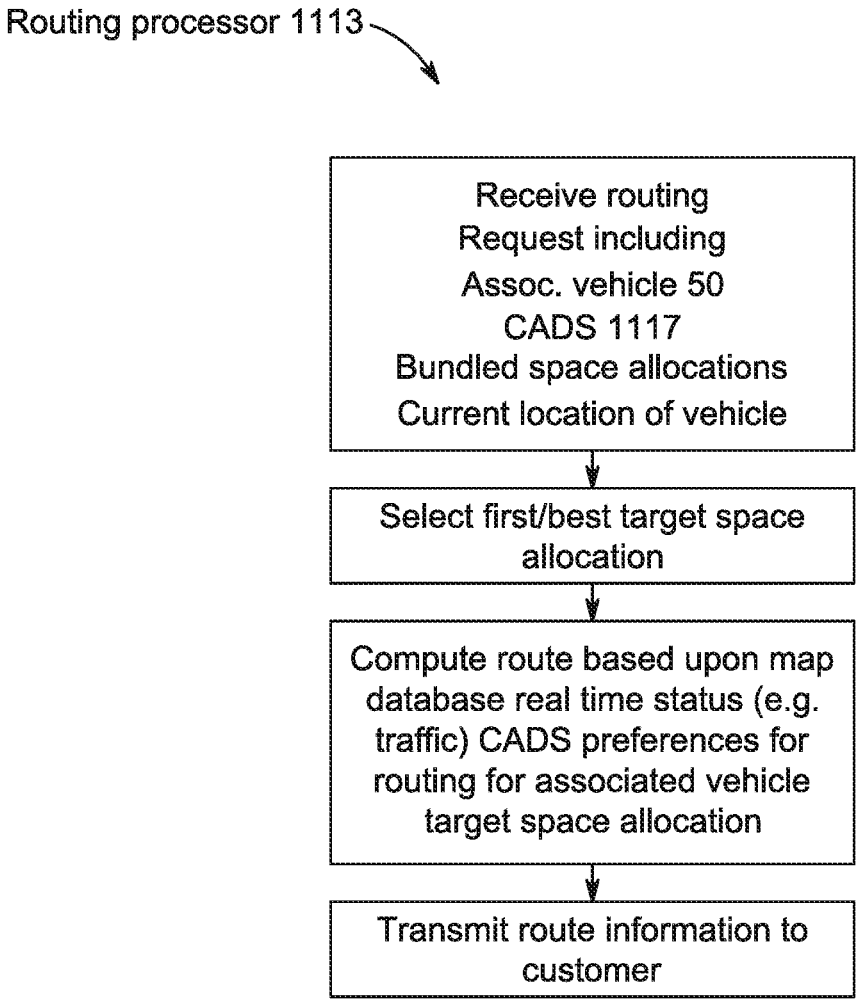
FIG. 9 is a flow chart illustrating operation of the Routing Processor 1113 shown in FIG. 4.

In FIG. 9 a flow chart illustrating operation of the Routing Processor 1113 is shown. The routing processor 1113 receives a routing request by way of signal processor 1115 for a Vehicle 50. The request includes associated vehicle 50, customer account data structure 1117, parking reservation bundled Parking Space Allocations, and the current Vehicle 50 location. The routing processor 1113 selects the first or best fitting Parking Space Allocation from among the bundled allocations. Such selection of first or best Parking Space Allocation includes consideration of the current traffic conditions and available routes to each of the bundled Parking Space Allocations and customer account data structure 1117 preferences to select the Parking Space Allocation that best meets the needs of the customer. The routing processor then computes the route to the selected Parking Space Allocation by utilizing a map database, real time status (e.g., traffic), customer account data structure 1117 routing preferences for the Vehicle 50, and selected target Parking Space Allocation. The routing processor 1113 then transmits through signal processor 1115 the route to the customer by way of Smartphone 100, Vehicle 50, or other computing device.

Charging Processor 1114 is used to track time and actual location use to a customer, and modify the account status accordingly in the Customer Account Data Structure 1117. A bid can include how much a party is willing to pay, or how much they commit to spend in a municipality or with one or more merchants who own, lease or control Parking Space, or whom may wish to subsidize parking not under their control on behalf of their customers. A preferred or prospective shopper who bids for a space may be penalized if they don't actually spend the committed amount. Subject to a customer account data structure 1117 privacy preferences, a business may be able to get notice from TMPS 1000 that a prospective customer is en route or planning to be in the vicinity of the business and that customer account data structure 1117 includes record that they have recently bought goods at the business recently. The business may offer an invitation through TMPS 1000 for their customer to park for free at a location very near their business' location, possibly including an advertisement or coupon to induce the customer to include a visit to their store as part of their visit in the vicinity of their business.

Figure 10:
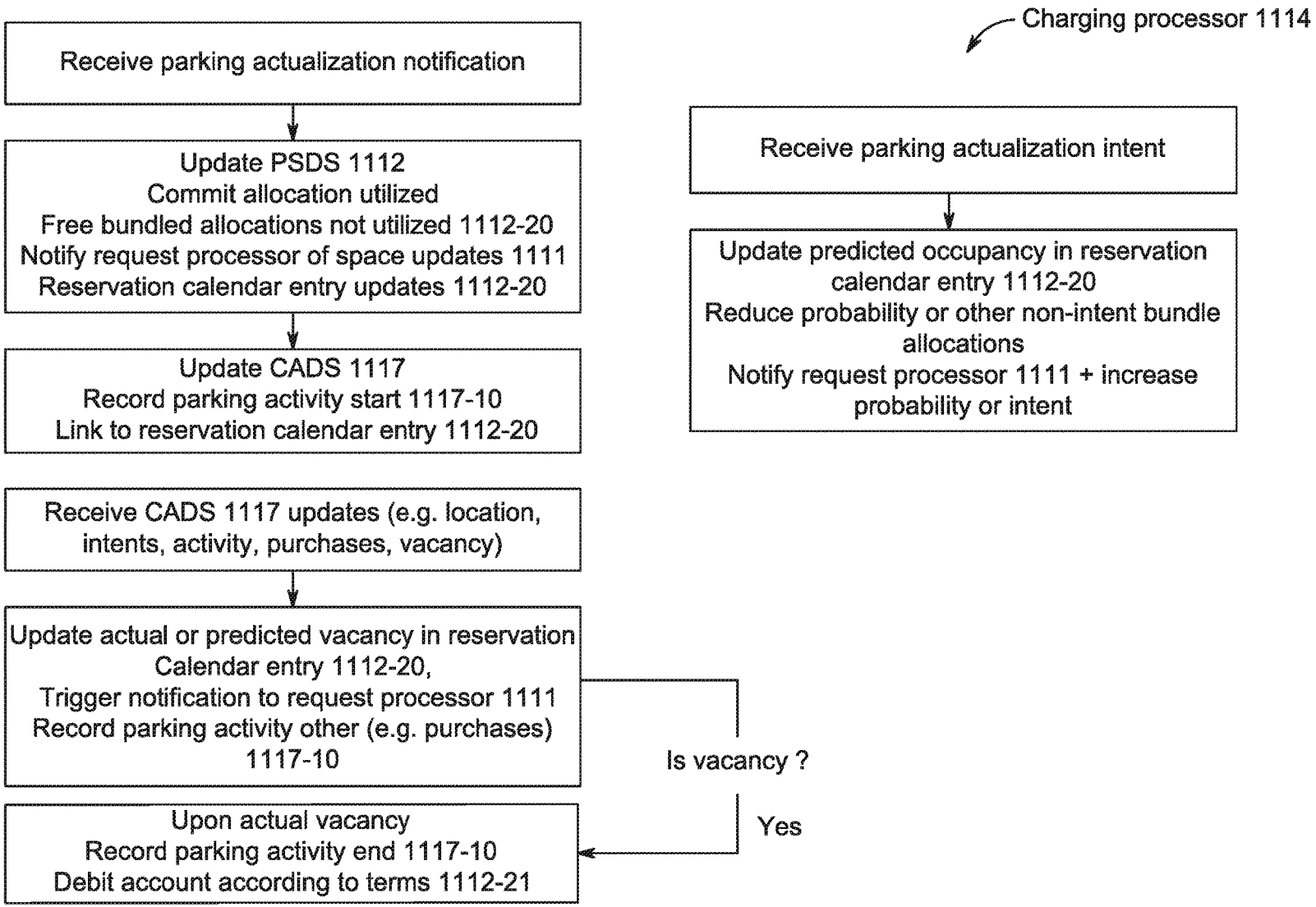
FIG. 10 is a flow chart illustrating operation of the Charging Processor 1114 shown in FIG. 4.

In FIG. 10 a flow chart illustrating operation of the Charging Processor 1114 is shown. Upon receipt of a parking actualization intent, the charging processor 1114 updates the calendar entry 1112-20 to reflect the updated predicted time of occupancy and associated probabilities, additionally for any other bundled Parking Space Allocations of the reservation, their probabilities are correspondingly reduced. The charging processor also sends notification to request processor 1111 via signal processor 1115 of any increased probabilities and/or intent to occupy. Upon receipt of a parking actualization notification from signal processor 1115, the charging processor 1114 updates the Parking Space data structure 1112 to record the committed Parking Space Allocation that is being utilized, updating the reservation calendar entry 1112-20, and to free any bundled Parking Space Allocations that are not going to be used in calendar entries 1112-20, and send notice to request processor 1111 of Parking Space updates by way of signal processor 1115. Next the customer account data structure 1117 is updated to record the parking activity start 1117-10 and link to the reservation calendar entry 1112-20. During the Vehicle 50 occupation of the Parking Space Allocation, the charging processor receives updates to the customer account data structure such as the location, intents, activity, purchases, and/or vacancy of the customer. The updates to the customer account data structure 1117 may result in an actual vacancy or updated predicted vacancy in the reservation calendar entry 1112-20. The updated vacancy information triggers notification to the request processor 1111 by way of signal processor 1115. Other customer account data structure 1117 update activity such as store purchases may result in recording other parking activity 1117-10 as a billing credit toward Parking Space fees and charges. In the case of an actual vacancy of a Parking Space, the end time parking activity 1117-10 is recorded in the customer account data structure and the customer's account is debited according to the parking terms 1112-21.

Access Processor 1116 (as illustrated in FIG. 12) handles requests to add or remove specific Parking Spaces from the system based on alternative needs to parking, such as closure of streets, a private owner wishing to limit availability, and the like such as access request 1112-30 shown in FIG. 17. Such private use may constitute an entity wishing to purchase a block of spaces and reserve them for their assignment to others. For example, if someone is having a party at their house and want to reserve street parking for their guests in front of their house they can pay for their parking and assign the spaces to the guest's vehicles. Alternatively, a merchant may wish to purchase a block of spaces in front of their store and assign them to their customers. Access requests are similar to parking requests but may span a range that can accommodate multiple Vehicle Extents, require a contiguous allocation, be able to be sublet, and/or entail priority determination factors (PDFs) that override existing parking reservations.

The term processor or microprocessor with respect to components of the PSC 1100 optionally means a separate microprocessor, CPU or controller or a software module that accomplishes the functions described herein. Further, it should also be understood that the same functions can be performed in a single microprocessor, CPU, controller deploying a software module or a plurality of distributed and/or redundant microprocessors, cores, CPUs, controllers deploying a software module that are physically located on the same or different computer hardware or servers in signal communication via the internet or another wide or local area network, which is sometimes referred to as "cloud computing". It should be understood that a server is generally understood to be a system (software and suitable computer hardware) that responds to requests across a computer network to provide, or help to provide, a network service. Servers can be run on a dedicated computer, which is also often referred to as "the server", but many networked computers are capable of hosting servers. In many cases, a computer can provide several services and have several servers running. A server may also be virtual and moved from one computer to another, or scaled, being replicated across one or more computers where the number of hosting computers varies based upon the server's demand and may be responsive to geographical demand, where hosts are selected to be nearer to demand and thus reduce the latency of its services.

As a preferred mode is to collect revenue automatically via a subscription to the TPMS 1000 in which users provide billing information 1117-30, users can be offered financial incentives, such as parking discounts and/or rewards points 1117-50 for confirming that they intend to leave at the predicted or specified time and/or actually have vacated a Parking Space before a specified time. In the case that a user's plans change, they register a willingness to accept bids to leave early with TMPS 1000, or they receive notice of inducement to leave early due to increased parking demand and they may optionally choose to vacate their Parking Space earlier than their originally predicted or specified time, in some cases having already committed and/or paid for such time, they may receive a portion of any revenues collected for subsequent vehicles parked in, or overlapping a portion of, their vacated Parking Space for the duration of their originally scheduled occupation. For public Parking Spaces (e.g., street parking), the municipality that controls the public Parking Spaces may also receive a portion of any revenues collected. For non-public Parking Spaces (e.g., private driveways and paid structures), the governing municipality may apply a surcharge or tax to any revenues collected. Such revenue sharing computations may optimize revenue for the operators of TMPS by sharing such revenue using a formula such that the net revenue collected always exceeds that were the user not to have vacated their Parking Space earlier than previously committed. Such information on each potential user is stored in the Customer Account Data Structure 1117.

The incentive for providing concurrent or subsequent notification of vacating a sport and/or an estimate of when they expect to vacate a Parking Space can be a reduction in parking fees, earning rewards points 1117-50 that can be accumulated and redeemed against future parking, or a future credit, premium or advantage (such as enhanced PDFs 1117-20).

Further, as the user of the space (i.e., the driver or passenger of the parked vehicle) is likely to carry a Smartphone 100 with a GPS after they leave their vehicle, it is possible for the Smartphone to be in signal communication through wireless networks including Wi-Fi and cellular data service (e.g., GSM, 3G/4G networks) in conjunction with location tracking mechanisms such as GPS with the PSC when the user is outside of their vehicle, such as to detect when they have reached their ultimate destination, or are returning to their vehicle.

Other optional capabilities of either each PMN 1210 or the DSN 1200 is to confirm the identify of the vehicle that received the allocation by reading license plate numbers (e.g., through ANPR: automatic number plate recognition, which uses OCR: optical character recognition to "read" license plate numbers), other identifying marks and/or electromagnetic signal communication as a vehicle enters and leaves the garage for accessing the garage as a whole, or as a vehicle enters and/or leaves a Parking Space for the specific Parking Space allocation. Preferably, the allocated vehicle can have an installed GPS that communicates to the TPMS 1000 the vehicle location to confirm the Parking Space is occupied. However, to the extent that vehicles do not have an installed and system enabled GPS, an older Smartphone can be left in the vehicle, once the software application is installed, so they act as a surrogate for an integrated GPS system. Such older Smartphone need not be activated on a cellular network if it can communicate via Wi-Fi such as that which may be provided by the parking system.

To the extent the vehicle user also carries a Smartphone 100 with them, the wireless connection of the Smartphone to a vehicle's wireless or wired communication system, may act, among other uses, as a predictor that the space will be vacant shortly. These uses can depend on one or more of proximity (e.g., the Bluetooth connection), the electronic confirmation of such a connection to confirm to the PSC that the GPS coordinates of the Smartphone 100 then correspond to the vehicle location, acting among other uses as a predictor that the space will be vacant shortly. Alternatively, sensor system or DSN 1200 can confirm the vehicle location is the same as the Parking Space, to distinguish from the vehicle owner/driver walking away from vehicle with the Smartphone. Further, knowing that the Smartphone 100 is the position of the vehicle owner/occupant/driver can be used to calculate a location (e.g., through GPS) and walking speed (e.g., through accelerometer) to estimate the probability of the Smartphone and vehicle occupants reaching the vehicle at a particular time and hence predictive of the time when the Parking Space will be vacated after they leave an establishment.

Further, such walking time from the vehicle to the establishment can be used to provide the carrier/user of Smartphone 100 with warning, via the Smartphone, that they need to vacate a Parking Space by a certain time if they have a time limited access to a Parking Space, and the warning time can include buffer to allow for such additional delays (avoiding the need to absquatulate) as check-out counter wait times, and the like, at establishments.

Further, the vehicle may be heuristically deduced to have vacated its Parking Space in the event that a user's Smartphone 100 position is observed to return to the vehicle's parked location and subsequently depart from that location at a velocity or acceleration that exceeds the velocity or acceleration that a person can reasonably attain when traveling by non-vehicular means such as by walking, running, or biking. In order to reduce error, the velocity can be calculated by removing the acceleration due to gravity from the accelerometer data, then integrating. The acceleration can simply be taken from accelerometer data. Such heuristics avoid the spurious deduction that a Parking Space is freed by the case of the user returning to the vehicle for some other purpose than vacating the Parking Space (e.g., to retrieve/deposit an item from/into the vehicle). Such deductions may optionally be confirmed by the PSC 1100 originating a request to the user by way of Smartphone 100 whereby the user may confirm whether or not they have vacated the vehicle's Parking Space. Alternatively, Smartphone 100 may provide a simple button for a user to depress in order to check out of a Parking Space and declare that it is now empty. Such assertions that a user has vacated a Parking Space are subject to audit and/or independent confirmation from other users or by use of PSC 1100 devices. Once a user has indicated they have vacated a Parking Space, their continued presence is subject to the same penalties, procedures, and disincentives as any other unauthorized parked vehicle.

13. Additional TPMS Functions

The TPMS 1000 can be programmed to provide additional functions as described below. Routing Processor 1113 may direct Vehicles 50 to the allocated Parking Space as they approach their destination, optionally by a navigation command system with voice commands and/or maps or 3-Dimensional type road displays.

Owners of driveways or street egress or access to driveway, driveway frontage, can offer their space to the TPMS 1000 via Access Processor 1116 in several ways, for example in time blocks when they are away from home, at work, on vacation or extended errands. Such time blocks may be reflected in Parking Space Associations 1117-70 and/or Reservation Calendar 1112-10.

In such cases, vehicles can be allocated space provided they guarantee they will vacate the space within a specific time that matches the allocation or be subject to any prearranged penalties to which the user agreed. The potential for criminal exploitation for the purpose of burglary, based on the knowledge that a vehicle allocated to a private driveway, or driveway egress might be parked at a vacant home, can be minimized by several means. The first is running background and criminal record checks on drivers and vehicle owners before they are allowed to access such spaces. Further, the knowledge of the identity of the requestor should itself be a deterrent to exploiting this information to assist in burglary. In addition the PMN 1210 can act as surveillance cameras for the property, as well as to be used to identify the availability of the Parking Spaces, and images and/or lighting can be acquired more frequently to check the appearance of the residence to insure there is no improper entry of it, or other suspicious activity.

Alternatively, vehicles can offer to pay a premium or bid for spaces wherein the driveway owner will agree to be inconvenienced if the vehicle stays a longer amount of time.

Allocation of private spaces owned or controlled by merchants can be based on one or more indicators, such as a user-based marketing profile that indicates favorite places to shop or dine, utilize services such as grooming, medical appointments, etc. Higher value consumers can be assigned PDF(s) 1117-20 and consequently allocated spaces more convenient to where they have shopped in the past, or where they plan to shop.

Parking can be allocated based on fixed time and location events, such as movies, plays, sporting events, so the user arrives on time, taking into account walking time, or the use of shuttles, and when the event ends.

Alternatively, the owner of the driveway space can be a trusted "valet" with the ability to move the vehicle if they need to access the driveway. The driver deposits keys in a digital lock box when they park. The driveway owner can open the lock box, move the vehicle temporarily. When the vehicle owner returns, they are sent an email or text message with a unique code to open and retrieve their keys from the lock box. The lock box is in signal communication with the DSN 1200 and then linked with the TPMS 1000.

Vehicle owners have the option of trusting their vehicle to a valet, or can select a preference for a parking type and pay a fee set according to predetermined pricing or demand based pricing. For example, owners of luxury vehicle may be willing to pay more for parking in urban driveways without limitation so they can park close to shopping and dining without concern that other drivers or a valet will damage their vehicle. By assigning vehicles to parking slots close to the desired location, excess traffic of vehicles circling to find Parking Spaces is avoided and traffic flows faster.

It should be appreciated that the TPMS 1000 can deploy various tariff systems to charge for parking in accordance with revenue maximization, or public policy considerations, such as reducing traffic in certain areas to vehicles that intend to park for longer times; further, prices can be set to correspond with demand. Vehicle owners/users willing to park on the street and walk or take some mass/public transit pay significantly less.

Vehicles occupying driveway frontage are registered with the TMPS 1000, and hence not cited for parking violations, as civil parking enforcement are able to correspond with the PSC 1100 by submitting a license plate or other indicator visible from or in the vehicle to confirm that they are parking in the space at the driveway owner's permission. Alternatively, in any of the vehicle locating or tracking embodiments describe herein, vehicles may be fitted with other electromagnetic means of identification such as Radio Frequency Identification (RFID), Near Field Communication (NFC), or Ultra-Wideband (UWB) whereby civil parking enforcement submit the detected radio identification indicator when corresponding with the PSC 1100.

The cities or municipalities more effectively utilize street parking to realize greater revenue. Owners of urban driveways are able to generate additional revenue, some of which flows back to the municipality as tax revenue or fee splitting with the property owner.

In the case of parking lots, such as at malls, airports, workplaces, etc. vehicles can be directed to the closest Parking Space that assists traffic flow into the lot, as well as future traffic flow on departure. For example, in pull-in style slanted slots, the earliest arriving workers, expected to leave first, are directed to the front slot, with later arriving workers or later departing workers directed to the rear slot. Once the vehicle in the front slot has pulled out, the vehicle in the back slot can leave without having to back up. Avoiding backing up reduces the potential for accidents in the parking structure or lot and speeds traffic flow, as vehicles are not delayed while waiting for vehicles to back out. Alternatively, Parking Spaces can be expanded by parking vehicles in slanted Parking Spaces three or more slots/vehicles deep, with first vehicle arriving occupying the forward Parking Space, the second vehicle immediately behind the first vehicle, and the third vehicle immediately behind the second vehicle, and so on, with a departure lane in front of the first vehicle and an access/entry lane behind the last vehicle. All vehicles enter Parking Spaces from the access/entry lane. The first vehicle to park is able to leave first via the departure lane, allowing the second and third vehicle to depart in the same order, that is providing First-in/first-out (FIFO) sequencing of vehicle allocations depending on when or how soon they want or are willing to commit to leave.

Alternatively, TPMS 1000 may include functionality to facilitate public streets may have a parking lane dynamically freed of vehicles in order to provide an additional lane of driving during temporary periods of high traffic such as during rush hour or due to a ballpark exodus at the end of a sport's game. Such Parking Space conversion to a driving lane may be registered via access processor 1116 and recorded in reservation calendar 1112-10 as an access request 1112-30. Similarly through access processor 1116, streets may have lanes dynamically converted to short term double parking usage where vehicles scheduled for longer term parking are blocked by earlier departing vehicles parking in the dynamically added parking lane and blocked vehicles may have approved being blocked in return for a portion of the blocking vehicle's parking fee. In some embodiments, an entire street (or only a portion of lanes) may be filled with parked vehicles blocking traffic with those vehicles scheduled to vacate first located at the head of the street followed by progressively later exiting vehicles up to the tail of the street. Such blocked streets (or lanes) may include all vehicles parked such that they are directed with the same orientation of forward travel or with differing orientations. For example, a single lane allocated to parking may have two contiguous section of vehicles pointed for forward egress in opposite directions from each other such that vehicles may simultaneously exit from both ends of a street block, being in separate sections, as they drive in opposite directions from each other, unobstructed, toward the end of a street block.

In some embodiments, the standard direction of traffic flow on a street may be changed by TPMS dynamically between any of one-way, two-way, and/or opposite of normal one-way to optimize and/or account for changing conditions of parking demand and travel demand. Such changes to traffic flow directions and parking restrictions may be conveyed to drivers by way of dynamic signage. For example, a three-lane two-way street, affording parking on only one side of the street, may be changed into a one-way street, affording parking on both sides of the street. Such change of a street from two way to one way may be effected in part by employing dynamic signage that TPMS causes to update to reflect the updated state of being one way. Alternatively, a four-lane two-way street, affording parking on both sides of the street, may be changed into a one-way street, affording double parking on one of the two sides. Alternatively, a two-way street with four lanes, affording parking on both sides of the street, may be changed into a street with no parking and one lane allocated to one direction and three lanes allocated to the opposite direction to account for a temporary surge of traffic in a particular direction. Dynamic changes to signage may be communicated by TPMS to self-driving vehicles in order that such vehicles may automatically adhere to the dynamically changing driving conventions/conditions. In some embodiments, vehicle Parking Spaces may be dynamically switched between parallel parking and vertical parking. For example, a six lane two way street with parallel parking on both sides leaving two lanes of traffic in each direction can by changed into a two way street with only one lane of traffic in each direction and replacing the parallel parking with vertical parking, each Parking Space straddling two lanes, affording exiting vehicles to leave in either direction of traffic flow. Such methods are known in the art, example methods are disclosed in U.S. Pat. No. 7,663,505 B2 (Issued 2010-02-16) for a "Traffic management device and system".

Alternatively, assuming vehicles can exit the parked position via the same exit/entry aisle, such as by backing out, the last vehicle to park can also be the first to leave. Hence, vehicles and other vehicle need not be parked two per slot column, but may be parked one behind the other in groups of three, with and egress aisle/lane, in front and an access lane in back.

Likewise, electric vehicles can be directed to available charging stations, and a user with Smartphone 100 may be directed to move the vehicles when charging is complete via a text message or other electronic notification. It is also envisioned that with self or auto-drive and park capabilities vehicles 50 can automatically be directed to take turns at charging stations, with automation of the charging cable socket attachment and removal, such as aided by machine vision.

Further, with respect to employee parking lots, arrival time can be predicted by either the application equipped Smartphone 100, the TPMS 1000 or the vehicle 50 GPS and Navigation/GPS system, from the start of the commute to work, or when the vehicle enters the employer facility.

Employees with special needs, seniority or rank can have PDF(s) 1117-20 that grant them preferred access to handicapped or closer Parking Spaces. The methods disclosed herein further enable a better utilization of handicap Parking Spaces now by allowing use as premium parking when not needed. Employees preferring the exercise of walking to and from their vehicles can specify this preference for recording in customer account data structure 1117 and be parked further away, possibly being awarded financial incentives in charging processor 1114 such as by granting of rewards points 1117-50 on behalf of their employer upon validation by TPMS 1000.

The sensor system or DSN 1200 provides a means for vandalism and theft deterrence and also discourages hit and run accidents.

The capabilities of the inventive TPMS 1000 may also be used to alert drivers to a wait time to empty a parking lot, or provide more orderly egress after lots are filled with vehicles parked for sporting events or other events in which the participants/spectators end their engagement at a locale at near or about the same time and thus will likely all want to vacate the locale (and thus their parking) at about the same time, such as concerts or museum/restaurant closing time. Drivers willing to linger after a game or concert can be incentivized to pay less for parking, while those vehicles whose drivers are willing to pay more or who buy more expensive tickets can be directed to Parking Spaces situated to leave first. However, since departures will be staged, everyone will leave more rapidly without the typical chaos in event parking lots. Alternatively, drivers willing to leave early before a game or concert has completed can be incentivized to pay less for parking subject to their egress from the parking vicinity ahead of the normal event end time. Drivers may be subject to penalty parking rates if they do not reasonably conform to their agreements or show good cause, especially if in so doing, they block or impede other compliant drivers. Driver preferences for selecting Parking Spaces may give priority to factors such as close proximity while other drivers may give priority to reduced exit delay, the avoidance of stairs, or pricing. Such preferences may be ranked and assigned relative values such that potential Parking Spaces may be assigned an overall numerical value based upon an individual driver's preferences allowing spaces to be ordered from most attractive (highest ranked) to least attractive (lowest ranked) for presentation to a user for the purpose of selecting a space. Alternatively, the highest ranked space may be automatically selected.

Cities will recognize savings by eliminating the need to add, replace or update parking meters, as well as lower labor cost for fewer if any meter attendants (such as when the assessment of parking citations is automated or performed virtually by meter attendants working from a remote location with access to PMN 1210), and higher space utilization, by billing for actual time, not time block, when drivers can "freeload" on extra meter time left over from a prior occupant. Also, by being able to immediately identify and cite parking regulation violators, greater revenues are gained and/or greater parking regulation compliance achieved. Additionally, parking violators may be warned such as via speaker 1215 as they park by persons acting as virtual meter attendants or automatically by TPMS causing prerecorded messages to warn violators. The TPMS may be tied into an emergency system of a city to notify drivers to vacate their vehicle due to, for example, a fire and the notified driver would be blocked by arriving emergency vehicles or conversely the driver would be notified that they are blocking needed access by arriving emergency vehicles, or also to snow removal vehicles.

Further, merchants that own private lots are able to ensure that people that use the lots are actually in the sponsoring establishments, as the location of Smartphone 100 carried by the user associated with the parked vehicle is traceable to confirm they are in their establishment and not elsewhere. Such confirmation can be an automatic validation of parking by your Smartphone detecting you are in the store such as through GPS and/or Wi-Fi network identification of location, etc. Validation can include spending sufficient time in the store and/or making a purchase at one or more stores to justify access to the Parking Space, or as a credit toward parking fees. Alternative means of confirmation may include check-in with a Smartphone app (e.g., Foursquare) or by using by Near Field Communication (NFC), or by having a barcode on their Smartphone's display scanned inside a sponsoring establishment.

Further, users of the TPMS 1000 can be sent advertisements or coupons via the Smartphone communication 100 to local establishments in the vicinity of Parking Spaces, such as parking rebates, validation offers and the like.

A user can pick up a fob when entering the city so their vehicle can be tracked, return when leaving the city. The GPS fob can also be used in the absence of a Smartphone 100. The app or fob detects the user walking back to the vehicle and predicts when the user will vacate the Parking Space based on past behavior and can encourage the user to walk faster to save money increase revenues etc. The user can get an offer from an incoming person offering them $5 to vacate 5 minutes earlier. A trusted individual can be offered to move their vehicle closer.

Shuttle bus coordination at the airport: the user preregisters on their Smartphone 100 that they will need shuttle service when they get off the plane to take them to the vehicle rental agency. When the user lands land and turns the phone on, the app coordinates with the shuttle service and anticipates the time to curb based on whether the user has luggage or not and the user's past walking rate. The app on the Smartphone 100 tells the user the running current estimate of when shuttle will arrive at the curb. This estimate is aided by the fact that the driver or shuttle bus is also connected to the network and hence its location is always known. The driver can be instructed by the app to skip terminals where there is no one being dropped off and no one needs to be picked up. When the driver is close to the user, they can leave the shelter of the terminal and proceed outside to the curb for pick up. The user's phone communicates their position so the shuttle can easily pull up nearby. The app can connect to the user by voice line with the driver if they have trouble finding the user. Similar functionality applies to shuttle busses that take the user to and from discounted satellite parking spaces to coordinate and efficiently transfer the user to and from the user's vehicle's parked location and destination.

Additional features and benefits of the TPMS 1000 include:

- handling payment or bidding in auctions;
- permitting trading up/down and swapping of reservations and allocating portion of trade profit or total trade amount to city as an added revenue stream;
- reminders to the user when rates will change or when they have promised to vacate and penalties may accrue;
- keeping track of the user's in-city purchases to refund or extend parking time;
- anticipating or asking spending intentions and notifying nearby stores that may wish to offer coupons or upgrades to parking to come to their store and/or buy at their store;
- receiving violation notices for breaking parking regulations;
- charges penalties if the user is late vacating a Parking Space;
- allowing for stacking/blocking parked vehicles when committing to longer parking lengths and the blocker commits to a shorter parking length;
- optimizing the user's shopping plan across multiple stops order to minimize costs or distance from store parked, or driving congestion;
- notifying the user when it is optimal to leave home on an errand as above for multiple destinations;
- notifying the user when tow-zone times are approaching or when the user is about to accept a reservation that eventually becomes a tow zone;
- optimizing package delivery where a delivery service such as UPS has a code to open the user's vehicle and can find the user's vehicle when parked and deliver the package to the user's vehicle, or groceries are ordered and the user drives up and groceries are placed in the user's vehicle; also the user may leave dry cleaning in vehicle and it may be picked up while parked and returned after cleaning while parked;
- optimizing package, such as UPS, deliveries to businesses by ensuring nearby open space exists when delivering to businesses for very short parking lengths or double parking when blocked vehicle does not need access during brief delivery;
- provide non-parking drivers notice to for example slow down when a person is pulling out ahead of them or about to park so they can account and smoothly integrate their driving with the vehicle parking or exiting;
- knowing about how long on average each user takes to park so it is integrated into apps predications and notifications appropriately;
- used for traffic control monitoring in the city since each participating vehicle can be seen and tracked in the city to monitor congestion;
- charging the user based upon the space taken (e.g., size of the vehicle) or if the user is sloppy and did not park within tolerances required they are charged a surcharge, and in parking garages with side by side parking vehicles are charged based on width too, and the user can choose if they only need access to doors on one side to park next to another so choosing where one is pointing in, the other out and their adjacent sides are very close to each other to save money using less space;
- commercial space loading zones can also be treated as regular parking but in their loading zones;
- allowing short parking in bus stop with coordination and possible mover if the user is late back to allow bus coming to use stop when they arrive, and the bus driver has an app to coordinate and predict the bus arrival time at a stop;
- tipping of valet parking built into the system;
- coordinating snow or leaf removal with payment from services of renting out driveway;
- valet parking knows when the user is returning towards their vehicle and automatically retrieves the vehicle, or if the user pays the bill at the restaurant the system anticipates the user returning to pick up the vehicle;

While the invention has been described in connection with a preferred embodiment, it is not intended to limit the scope of the invention to the particular form set forth, but on the contrary, it is intended to cover such alternatives, modifications, and equivalents as may be within the spirit and scope of the invention defined by the appended claims.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

14. Traffic Management Device and System

A conventional traffic control device (TCD) such as alternating color lights, (i.e., green (go), yellow (warning), red (stop)), flashing lights, or variable signage, and the like is optionally controlled by a master controller, timing circuit, a pedestrian crosswalk or emergency vehicles. Such TCD may also deploy variable timing cycles, that is the percentage or length of time one cross street receives a green light differs from the other cross street, in response to measured traffic volume or historical patterns. All these embodiments of TCD's are compatible with the instant system, characterized by a TCD that deploys a transmitting device to signal approaching traffic of its current state and the time remaining until the state changes, or optionally until it returns to the "green" state for oncoming traffic. Accordingly, in another aspect the vehicle has a receiving device to collect signals from the TCD, the receiving device being operative to ascertain the vehicles position with respect to the TCD and determine a preferred rate of speed so as to arrive at the TCD while it is in the "green" state, thus avoiding the deceleration, waiting at the TCD and acceleration to driving speed.

The TCD can transmit the requisite information from its location using a broad or narrow beam of RF or microwave transmission, optical transmission or a series of more localized transmitters dispersed about the roadway.

The vehicle can determine its current position through GPS, detection of embedded sensors in the roadway, Doppler radar and like methods to measure the actual distance from the TCD, which can also be determined by the combined information received from the TCD transmission and other sources.

Figure 19:
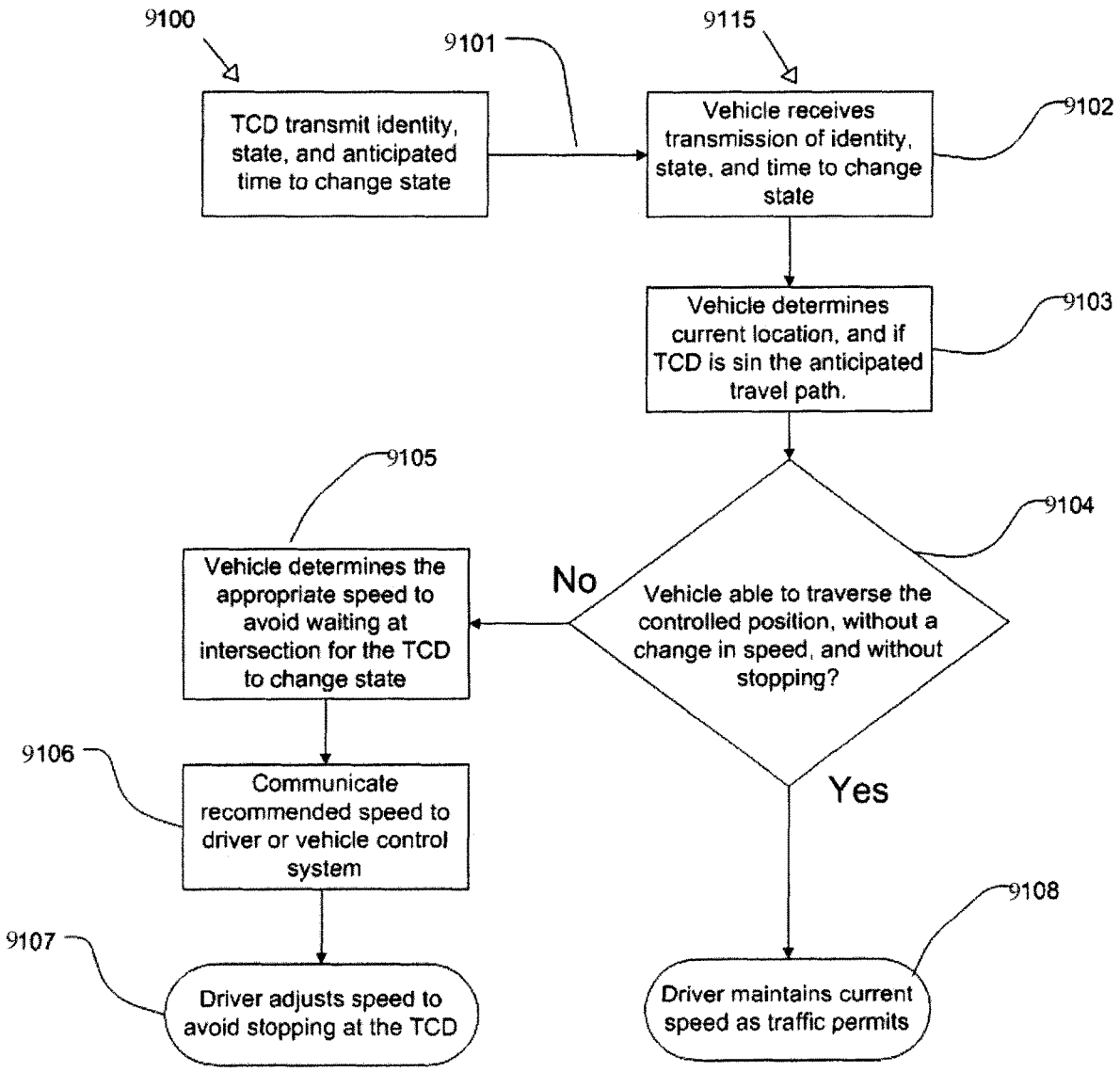
FIG. 19 is a flow chart illustrating one embodiment of a traffic control system.
Figure 20A:
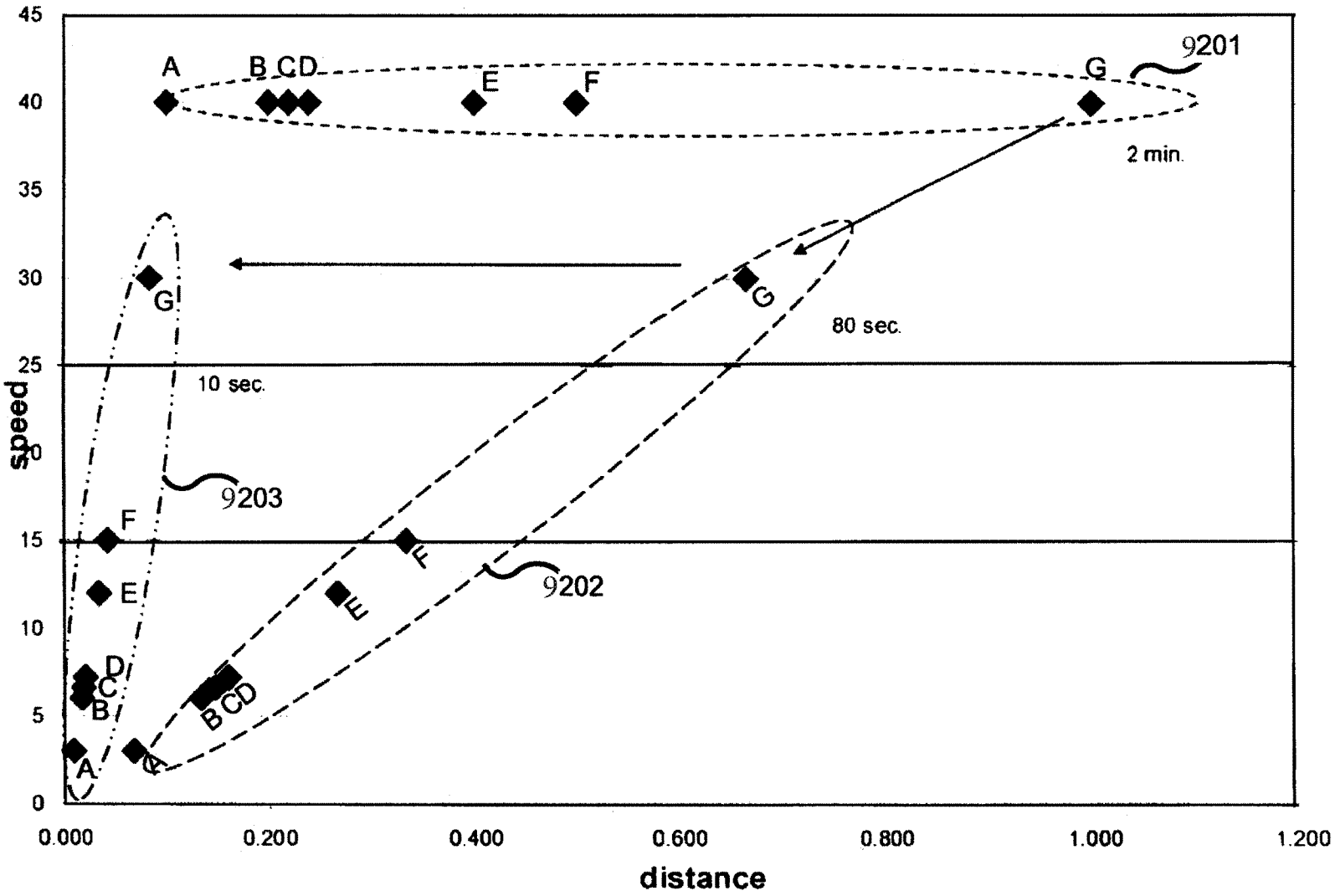
FIG. 20A is a plot showing the speed and position of a cluster of vehicle subject to the control systems and devices described with respect to FIG. 19.
Figures 20B, 20C, 20D:
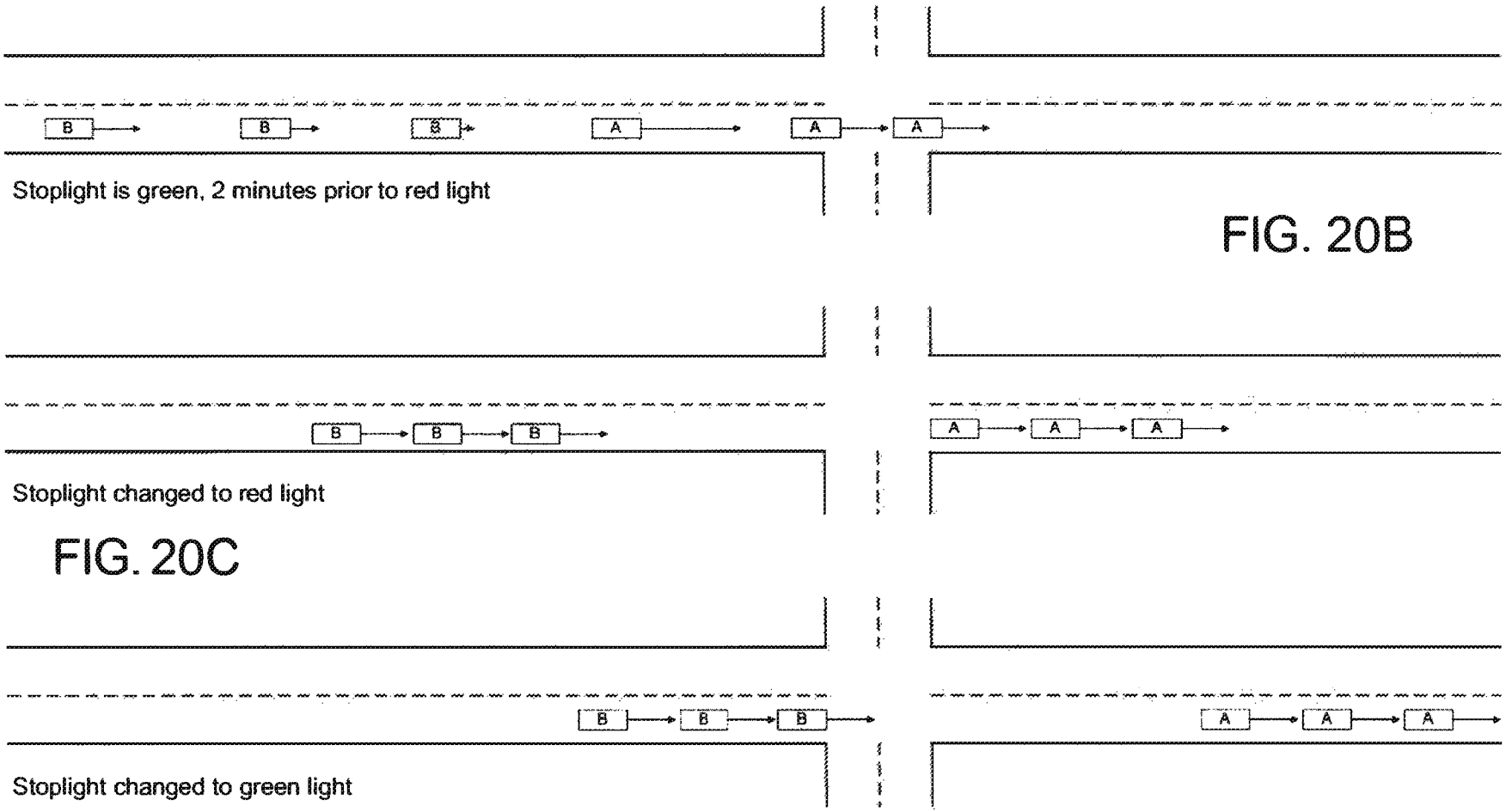
FIGS. 20B, 20C, and 20D are plan views of an intersection corresponding to the time intervals plotted in FIG. 20A.
Figure 21:
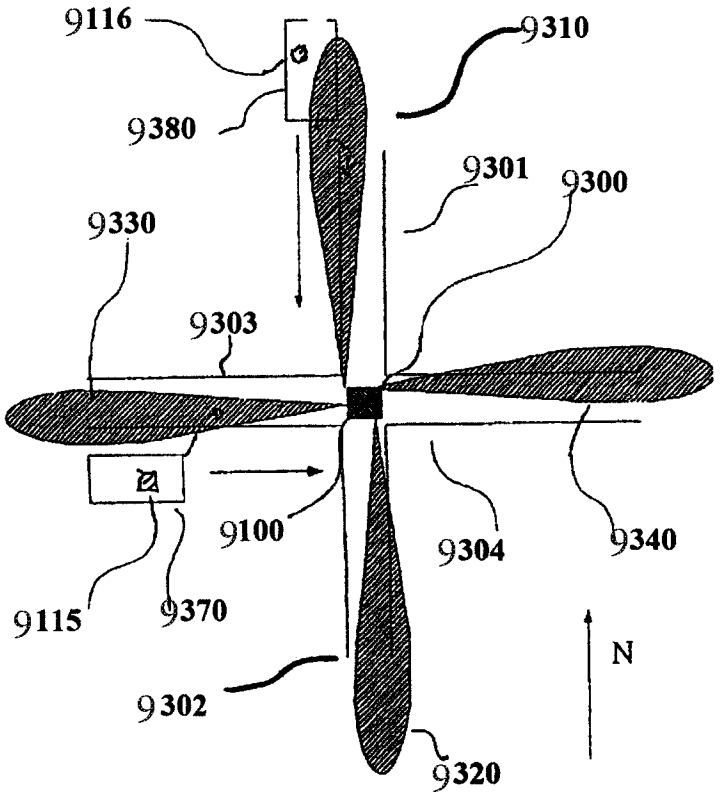
FIG. 21 is plan view of an intersection illustrating one embodiment for communicating with a plurality of vehicles according to FIGS. 19 and 20.

FIG. 21 is a plan view of an intersection illustrating one embodiment for communicating with a plurality of vehicles according to FIGS. 19 and 20. As vehicles approach the intersection from four directions, the TCD broadcasts a signal to four sets of approaching vehicles. In this embodiment, the broadcast pattern is narrow and corresponds substantially with the width of the roadway to avoid signal overlap and confusion with adjacent TCDs that also broadcast signals.

Figure 22:
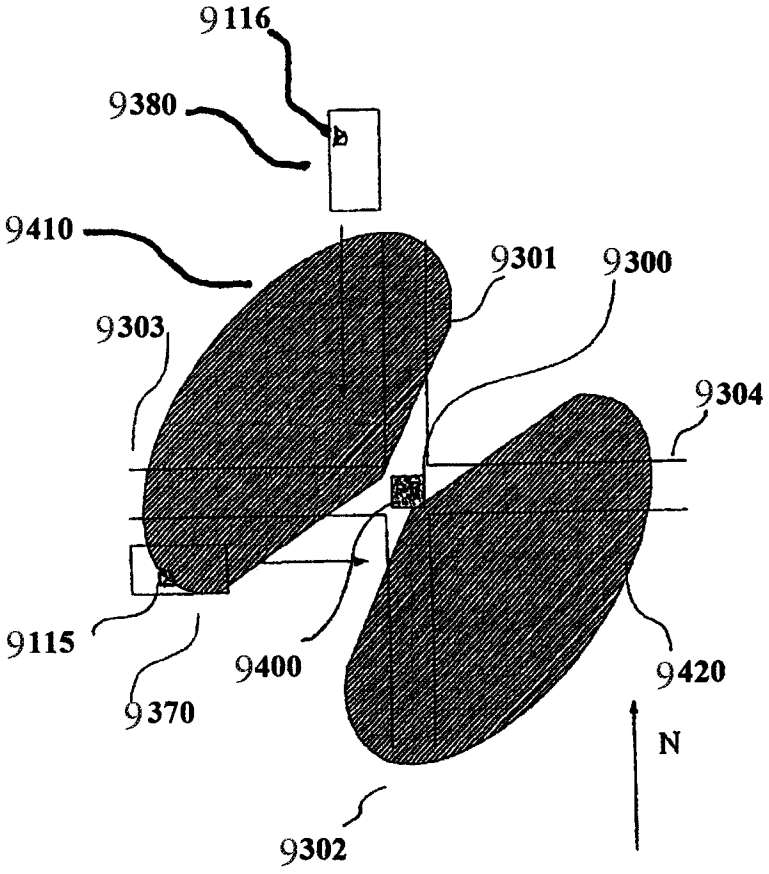
FIG. 22 is plan view of an intersection illustrating another embodiment for communicating with a plurality of vehicles according to FIGS. 19 and 20

A traffic control device (TCD) 9100 is operative to transmit or broadcast signal to approaching vehicles, wherein the approaching vehicles uses the information received as set forth in the flow chart in FIG. 19. Thus, the composite signal received by approaching vehicles in step reflects the state and timing of the control device, and depending on the transmission or broadcast scheme deployed, examples of which are illustrated in FIGS. 21 and 22, the location and identity of the TCD, and other information necessary for vehicles approaching from a specific direction to distinguish the appropriate signal from that of signals meant for vehicles approaching from a different direction.

Vehicles are in turn equipped with a device 9115, for vehicle 9370 and 9116 for vehicle 9380 to receive the composite signal and determine an appropriate speed that would permit them to safely reach and traverse the controlled intersection without the need to stop at the intersection when the control device permits cross traffic through the intersection. Thus, vehicles would avoid waiting in line at intersections, as well as the idling of the engine that wastes fuel and increases pollution. Further, as traffic flow would not be retarded by the time consumed when each vehicle in a line accelerates from a stopped position (sometimes referred to as "the accordion effect"), the overall traffic capacity of roads would be increased.

Thus, in step 9101 in FIG. 19 the TCD transmits its identity, state and anticipated time to change state. Device 9115 is embedded or associated with the vehicle, in step 9102 receives the transmission of the TCD identity, state and time to change state.

In step 9103 the vehicle determines its current location with respect to the TCD, and if the TCD is in anticipated travel path.

In step 104, Device 9115 is operative to determine if the vehicle will be able to traverse the controlled position without a change in speed, thus avoiding having to stop.

In the event that step 9104 determines that the vehicle cannot traverse the intersection without reducing speed (No branch to step 9105), in the next step 9105 device 9115 determines the appropriate speed to avoid waiting at an intersection for the TCD to change state.

In step 9106, which follows step 9105, device 9115 communicates a recommended speed to the vehicle's driver, or alternatively automatically lowers the speed or a cruise control maximum speed threshold for the vehicle. In the former case, the driver adjusts the speed of the vehicle, step 9107, to avoid waiting at the intersection.

In the event that step 9104 determines that the vehicle can traverse the intersection without reducing speed (Yes branch to step 9104), in the next step 9108 the driver maintains the current speed until device 9115 instructs or otherwise controls the vehicle in response to a signal received from the first TCD 9100, another TCD or other elements of the traffic control system.

FIGS. 20A-20D illustrate the operative principle with vehicles which are approaching an intersection. In FIG. 20A, vehicles labeled as A-G initially approach at constant speed, being at varying distances from the intersection. As a first approximation to implementing the system, we now calculate an ideal speed to avoid stopping at the intersection, based on a change from red to green in 2 minutes. It is a simple matter to compute the maximum speed below the speed limit by dividing the distance to the intersection by the time remaining until the TCD turns green.

FIG. 20A further illustrates the results of such computations in a graphic format wherein the speed of each vehicle is plotted on the ordinate as a function of distance from the intersection, with the speed plotted on the abscissa. The plots are made for three time intervals, the first interval, marked by region 9201, being at 2 minutes before the light will turn from red (the current state) to green, when all vehicles are traveling at the speed limit (40 mph). The other two sets of points highlighted within the border of regions 9202 and 9203 respectively represent the position and speed of the same vehicles 80 and 10 seconds prior to the light changing. The vehicles closer to the intersection during the red condition will be slowed more than vehicles more distant. Thus, as time elapses the vehicles tend to cluster into groups. It should be appreciated that while the TCD is green, the group of vehicles that can safely traverse the intersection will be instructed to travel at a certain speed, subject to traffic conditions, and thus may be allowed to accelerate up to or even beyond the speed limit to optimize the spacing and speed of the group relative to other groups fore and aft.

FIG. 20B illustrates the operative principles with two clusters of cars identified as cluster A and cluster B by the letter on each vehicle, all traveling from left to right as they approach the intersection. At some time during their approach, in this case 2 minutes prior to the light changing to red, the cars are traveling at constant speed, and are located at varying distances from the intersection. Based on their distances to the intersection, and the speed of the cars, those cars in cluster A will pass through on the current green light cycle, and cluster B will be required to slow down in anticipation of the light turning from green to red. In this manner, cars in cluster B continue moving but do not arrive at the intersection until the next green light. In the manner described above, we can calculate if any of the cars in cluster A will be required to increase their speed in order to cross the intersection during the current green light. In FIGS. 20B-20D, the relative magnitudes of the velocities of each vehicle are indicated by the magnitude of the corresponding vector.

The plan view in FIG. 20C shows the cars at the intersection as the light changes to red. The vehicles closer to the intersection during the red condition will be slowed more than vehicles more distant. Thus, as time elapses the vehicles tend to cluster into groups. The cars in cluster B are shown grouped together and traveling at the ideal speed to avoid stopping at the light. It should be appreciated that while the TCD is green, the group of vehicles that can safely traverse the intersection will be instructed to travel at a certain speed, subject to traffic conditions, and thus may be allowed to accelerate up to or even beyond the speed limit to optimize the spacing and speed of the group relative to other groups fore and aft. Therefore, the cars in cluster A are shown after having passed through the intersection, grouped together closely and traveling at the same speed. The plan view in FIG. 20D shows the intersection as the light turns green. Cluster A is continuing on beyond the intersection, and cluster B has reached the intersection, and is accelerating as a group, back up to the normal speed of traffic on the road.

FIG. 21 is a plan view of an intersection of two roads at intersection 9300. The road carrying north-south traffic has a first segment 9301 in which vehicle 9380 is traveling southbound as it approaches the intersection with TCD 9100, whereas segment 9302 carries northbound traffic. The road carrying east-west traffic has a first segment 9303 in which vehicle 9370 approaches intersection 9300 from the west, whereas segment 9304 carries traffic that approaches intersection 9300 from the east. In this example, the TCD broadcasts a separate directed signal to approaching traffic, that is broadcast signal 9330 for vehicles approaching on segment 9303, signal 9340 for vehicles approaching on segment 9304, signal 9310 for vehicles approaching on segment 9301 and signal 9320 for vehicles approaching on segment 9302. Thus, vehicle 9370 on segment 9303 is intended to be responsive to the information in broadcast signal 9330, as received, analyzed and communicated by device 9115 there within. Whereas vehicle 9380 on segment 9301 is intended to be responsive to the information in broadcast signal 9310, as received, analyzed and communicated by device 9116 there within. Naturally, there could be one transmission signal for each intersection or road with multiple intersections or an area wide signal that carries all the necessary data. This data could then be analyzed by each vehicle's reception device so that only pertinent information is displayed to the driver.

FIG. 22 is a plan view of intersection 9300 illustrating another embodiment wherein TCD 9400 utilizes fewer, but broader signal broadcasts, signal 9410 covering vehicles on segments 9301 and 9303, while signal 9420 covers vehicles in segments 9302 and 9304. This embodiment differs from that illustrated in FIG. 21 in that the broadcast pattern is broad, and not limited to a particular section of roadway, as the devices provides a code multiplexed signal that includes information pertinent to vehicles approaching from two or more directions wherein the vehicles select the appropriate code relevant to their direction of travel or approach to the intersection. This is particularly beneficial if the vehicle's driver is being prompted to follow a course set out in a GPS enabled navigation system, as the computation system can be programmed to identify TCD's that correspond to the planned travel route, and to the extent it can intercept multiple TCD signals within the route, assist the vehicle driver to maintain a speed that optimally permits the traverse of multiple controlled intersections with the minimum acceleration and deceleration.

In alternative embodiments, a vehicle speed controller is operatively responsive to device 9115, for example a cruise control system and may take into account the acceleration characteristics of the vehicle.

In another aspect driver displays/guides and vehicle control systems are used to control the length of time for green, yellow, and red lights, the spacing between vehicles and groups of vehicles (pods), and the size of pods. This traffic flow system can also include a method for placing vehicles in pods or groups so that vehicles can be coordinated to travel with increased efficiency of traffic flow. In this aspect, device 9115 may also have the capability of communicating vehicle information to the TCD system, which is a network of devices such as TCD 9100 throughout the entire roadway system. This information may include but is not limited to its position on the roadway, whether or not it is travelling in a pod, and if so, its position within the pod and the size of the pod. Determination of whether a vehicle is in a pod and/or its location within a pod may be calculated through a combination of means. These means include but are not limited to inter-vehicle communication of GPS based position information, GPS based position information of vehicles transmitted from the TCD system, traffic signal or roadway-based RF, optical, and proximity sensors, and vehicle mounted RF, optical, and proximity sensors. The device 9115 may communicate to the TCD system directly via means including but not limited to, satellite, long range RF, or cell phone network-based data communication. Device 9115 may also communicate indirectly to the TCD system via RF transmissions to a receiver in TCD 9100 located at the nearest traffic light, or to relay stations located along the roadway. Utilizing this pod information, the TCD system is capable of determining whether the spacing between pods permits the addition of new vehicles to the pod in a controlled sequence. The pods and the crossing lights are then coordinated to maintain vehicle/pod speeds so that intersections can be crossed without the need to stop. Generally in such pods the cars are spaced at a minimum distance that is safe for travel at a high speed, but each pod is separated from the next nearest pod by a much larger distance, typically at least the length of the pod, which includes the vehicles and the spacing between them.

Additional technologies exist to allow data communication between any fixed elements of the TCD system by utilizing microwave transmitters, land lines such as phone, fiber-optics, coaxial cables, wireless networks, or other future technological means.

In some cases, the traffic flow system may be used on a roadway having intersections that are a relatively short distance apart. There may be pods formed whose length exceeds the distance between the intersections. In this case, the traffic flow system coordinates the timing of the lights at each of the intersections. This ensures that the lights are kept in the green state, allowing the entire pod to travel through both intersections and maintaining optimal traffic flow.

In yet another aspect the vehicle includes onboard speed/brake controlling systems that synchronize vehicle speed with intersection crossing so that the driver is not required to manually control the vehicle's speed.

In yet another aspect the vehicle includes onboard speed/brake controlling systems that allow the vehicle to automatically maintain following distance behind another car. In the case where the vehicle is travelling as part of a pod, but is not the lead vehicle, this will allow the vehicles to maintain accurate and safe grouping even while travelling at high speeds. This system will require inputs in order to determine whether the vehicle is leading or following. Input means may be through communication with the TMS, inter-vehicle communication, user input, or external vehicle sensors. In addition, sensors are required to determine the vehicle range. Range finding technologies that may be utilized include, but are not limited to, ultrasound, laser, and radar.

In yet another aspect, vehicles entering a road are required to stop and wait for a pod to approach and then are directed, manually or automatically, to take a position in a given lane at the front or rear of the pod. Vehicles waiting for a pod can park on both sides of a lane(s) for travel in one direction. The number of vehicles allowed to join a given pod can be controlled to maximize the flow of traffic.

In yet another aspect, vehicles awaiting a light change at an intersection are required to wait a distance away from the intersection so that they can begin to accelerate prior to the light changing in order to maximize the number of cars that can pass through the intersection during the computer-controlled period. The period is controlled by the number of vehicles waiting to pass through the intersection and the priority given to the traffic demands on that road versus the traffic demands on the intersecting or crossroad.

In yet another aspect stop/yield signs (or any sign) can be fitted with a transmitter/receiver device and indicator lights that signal an approaching vehicle if another vehicle is approaching the intersection via another road. The signal would be actuated by an approaching vehicle's transmission of data as to speed, time to crossing, intended travel path, and it would take into account other vehicles approaching the intersection from another road or direction of travel. The integrated stop sign/signal could be controlled by on board vehicle computers that synchronize with other vehicle computers approaching the intersection or by a simple computer integrated in the sign/signal. Once again, vehicle speed could then be controlled so the approaching vehicles would cross the intersection at different times.

In yet another aspect, the signals could also be used to enforce speed limits on different roads. For instance, on a residential street an integrated stop/yield signal would only signal a stop for vehicles exceeding the speed limit by a given percentage, whereas vehicles obeying the speed limit would be given priority and allowed to roll through the intersection rather than being required to stop. Less air pollution would be generated by allowing vehicles to roll through stop sign intersections in residential areas. The onboard vehicle systems could be turned off or on by the driver.

In yet another aspect, vehicles use mapping programs to communicate with the central traffic system the intended travel path for maximizing the flow of traffic. For instance, a certain vehicle's travel path may lead to a congested area several miles ahead and a faster, secondary path could be recommended. Also, if the secondary path is not chosen then the vehicles progress may be slowed or even pulled to the right lane and slowed or pulled off the road and stopped, thus allowing vehicles with faster or less congested travel paths to receive a higher priority than the vehicle traveling toward a congested area.

In yet another aspect, emergency vehicles would be given total or partial over-ride priority at intersections and on roadways. Partial over-ride priority could involve timing changes to lights/signals that might slightly slow the progress of the emergency vehicle so that its travel is safer and less disruptive to traffic flow. In addition, travel path data indicating congested roads and faster travel paths could be used to improve destination arrival times.

In yet another aspect, the communication between the vehicle and the signal light at an intersection could be used to prevent collisions from crossing traffic. For instance, a disabled vehicle may be unable to stop causing it to run a red light. A vehicle that continues to move toward the intersection would be detected by the control system that would then prevent the intersection signal from turning to red or if the signal had already switched then all intersection signals could immediately switch to red and begin flashing. An alarm could also be sounded at the intersection and inside all vehicles traveling toward the intersection.

In yet another aspect, vehicles fitted with an onboard system(s) that would function as described above could be used to guide the speed of vehicles that are not fitted with a system. For instance, a special indicator light could be used by the fitted vehicle to inform an unfitted vehicle of the optimum travel speed, etc.

In yet another aspect vehicles that do not utilize this technology or that are awaiting a light change are required to travel or wait in a designated lane to allow other lanes free for vehicles using the technology or vehicles traveling at a speed toward the intersection for the light to change.

Figure 23:
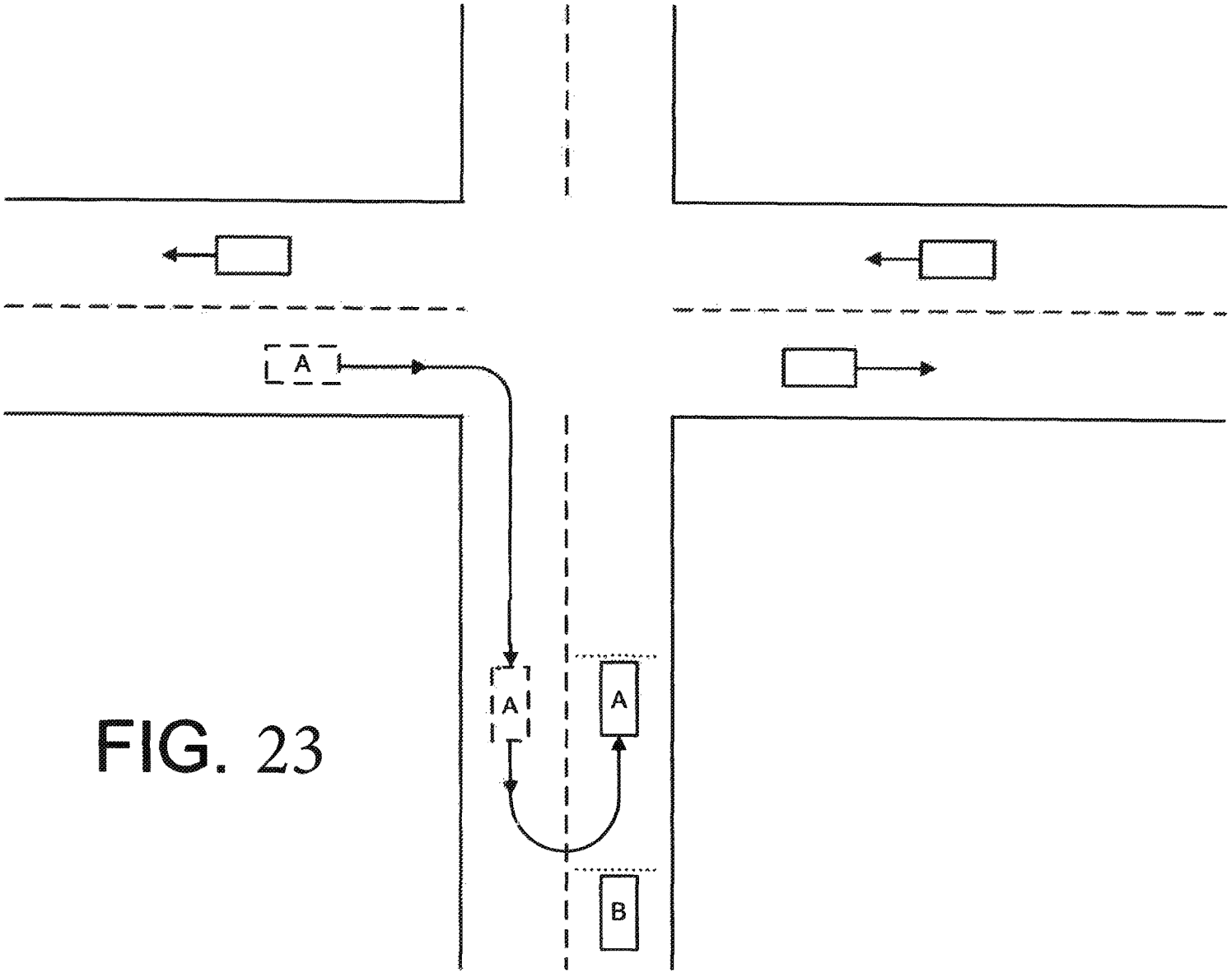
FIG. 23 is plan view of an intersection illustrating another embodiment for communicating with a vehicle that enables the vehicle to make a left turn when the traffic control light governing its travel direction is green.

Another embodiment is illustrated in FIG. 23 that enables vehicles in pods to make left-hand turn on a green light. Thus, the TCD or traffic control system, directs vehicles that seek to turn left at the intersection (vehicle A) to first make a right-hand turn, then perform a U turn, after which they hold at intersection. Vehicle A is traveling toward the intersection, currently with a green light to cross, but wishes to turn left. There is currently no green for the left turn, so that through traffic can be maximized. In order for vehicle A to make the left turn. It first turns right at the intersection, then immediately performs a U turn and stops at a holding line some distance behind the threshold of the intersection. The holding line is located far enough back from the threshold of the intersection to allow for full vehicle acceleration prior to entering the intersection. When the light changes, vehicle A crosses and travels across the intersection, effectively having performed a left-hand turn from its initial direction of travel. In order for vehicle A to have enough room to perform the U-turn, cross traffic such as vehicle B must stop behind a second holding line as shown in FIG. 23. Vehicles B and then A are signaled to begin moving prior to the light changing, so that they cross the threshold at full speed at a specific interval after the light changes to green.

Figure 24:
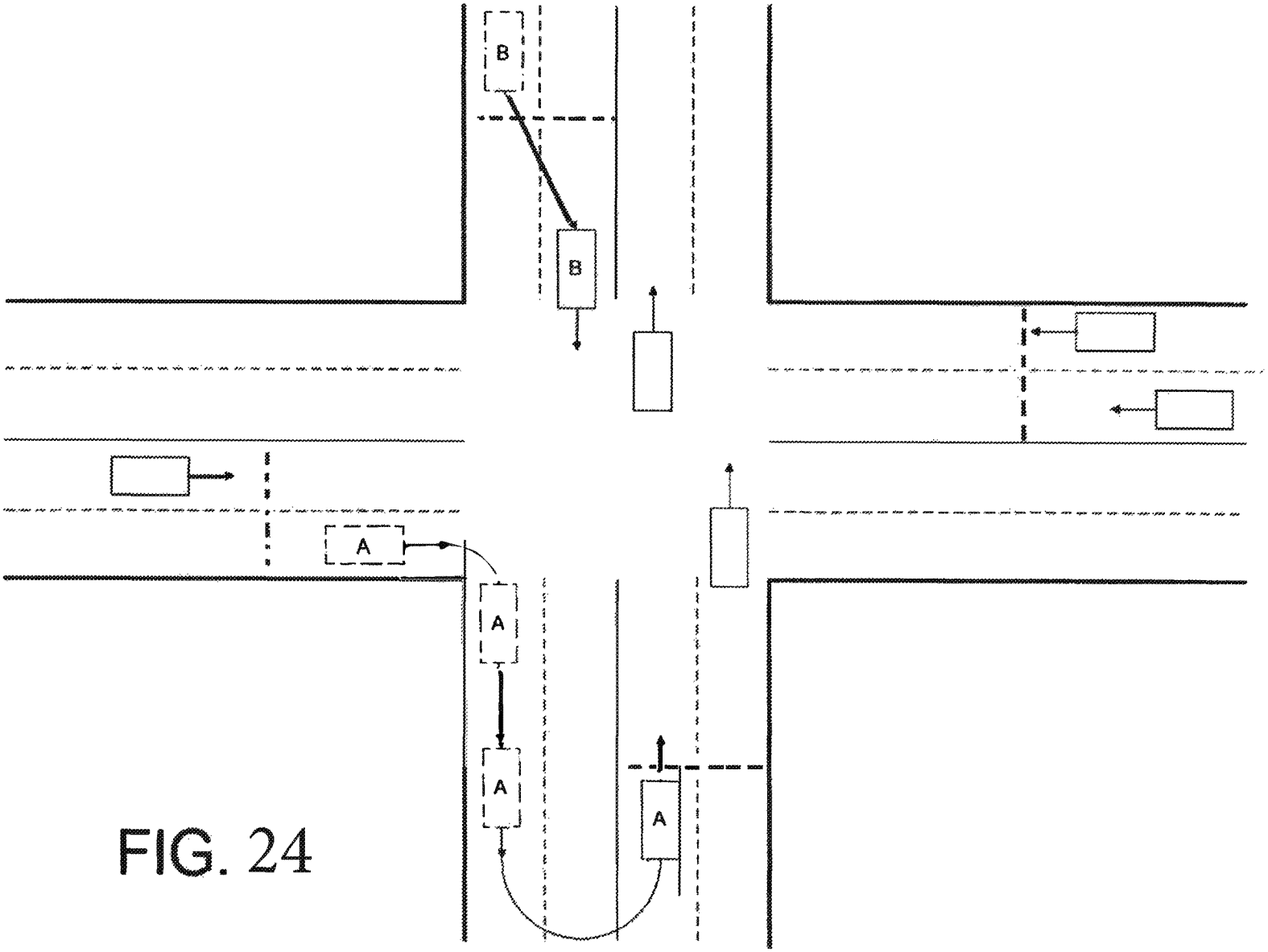
FIG. 24 is plan view of an intersection illustrating another embodiment for communicating with a vehicle that enables the vehicle to make a left turn when the traffic control light governing its travel direction is red.

FIG. 24 illustrates another alternative embodiment in which a vehicle is able to make an effective left-hand turn on a red light. When vehicle A approaches the intersection traveling from left to right with a red light and wishes to make a left turn, it turns right (downward on the drawing) at the intersection and then holds on the shoulder or in the right-hand lane (as shown). Note that space is provided so that multiple cars may be holding in this location (as shown by the dotted vehicle outlines in FIG. 24). Cross traffic (moving up and down on the drawing sheet) such as vehicle B has the green light and continues to travel across the intersection. If vehicle B is in the right hand lane (as shown), it is signaled either by display on a sign, an indication in the vehicle, or both, to change lanes to the left hand lane in order to de-conflict with traffic (such as vehicle A) holding in the right hand lane. Once cross traffic is clear, vehicle A performs a U turn and continues travel across the intersection, effectively having performed a left-hand turn from its initial direction of travel.

Another embodiment maximizes vehicle travel efficiency by grouping vehicles into pods as soon as possible, and preferably to the maximum extent possible. If a pod is not immediately approaching as the vehicle turns onto the TCD equipped roadway, it is given a signal to hold on the far right of the road, or on another suitable holding area such as a center median. This is shown with vehicle A in FIG. 25A. It waits there until a pod approaches, and based on the speed of the pod, the system determines the appropriate time for the vehicle to begin accelerating. The vehicle merges over to the appropriate lane, and then joins the pod. The vehicle may join at the position at the rear of the pod, or if automated vehicle control systems are used, at the front of the pod. FIG. 25B thus shows vehicle A joining behind vehicles labeled C that travel in a pod.

In a further embodiment, vehicles entering onto the TCD equipped roadway will have destination information entered into a navigation system. The TCD uses this information to determine the exit and approximate estimated time of arrival at that exit. The system determines the volume of traffic that will be exiting at that time of arrival. Based on that volume, the system determines if capacity limitations will be exceeded. If so, the system has the vehicle pause in the holding area until joining the next pod which will allow the system to remain within its capacity requirements. Thus FIG. 25A also illustrated such a situation in that it shows car A waiting for pod B to pass, since entering this pod would exceed system capacity at the time which A will be exiting. As shown in FIG. 25B, car A is shown merging into the traffic lane and joining at the tail end of pod C. Thus, the grouping of the pods becomes determined by the destination of the vehicles within it, in order to avoid having too many vehicles reach the same exit at the same time. One of the critical system capacity limitations is the area for holding vehicles which intend to make left turns and have exited to the right and have performed a U turn via the method described in FIG. 23. The area where these cars are waiting to accelerate and cross the road can only hold a finite number of cars before reaching the area where the traffic behind it (shown by vehicle B in FIG. 23) is located.

Figure 25A:
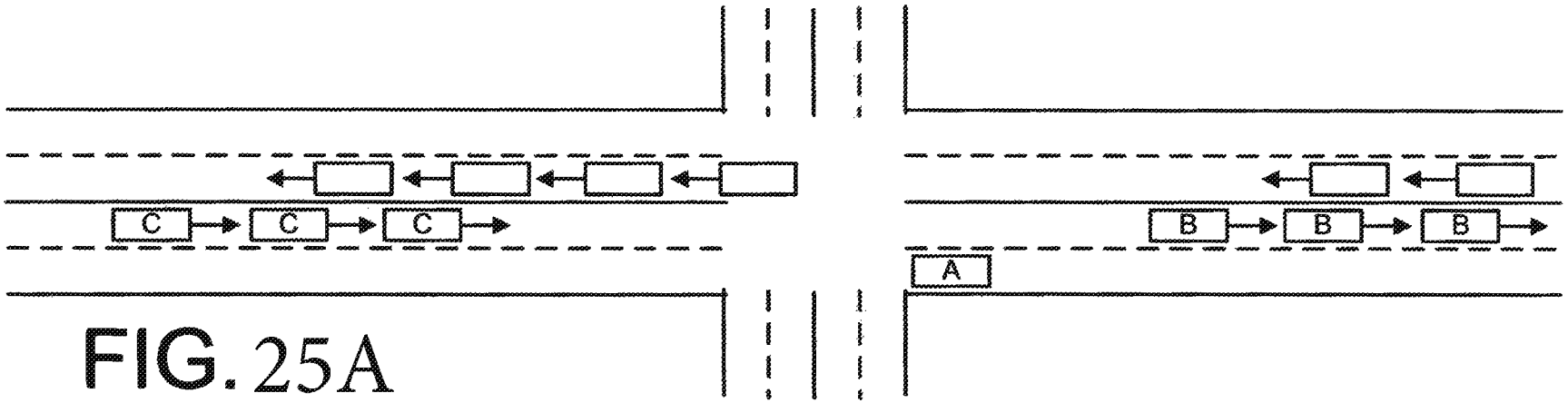
FIGS. 25A and 25B are plan views of an intersection showing the stages where a vehicle waits to join a pod that is about to traverse an intersection.
Figure 25B:
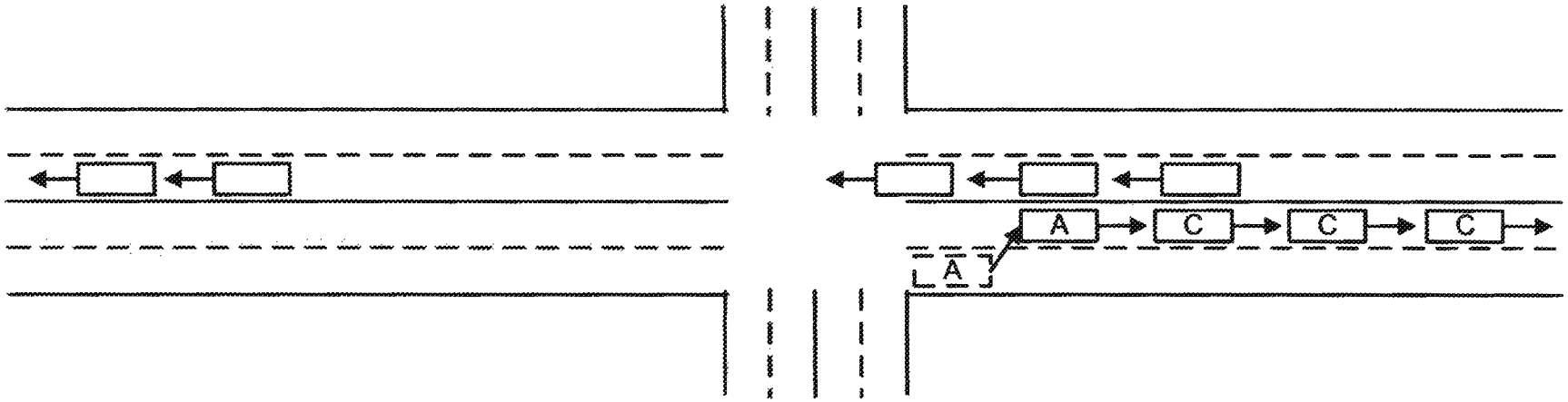

In more embodiments it is preferable that a vehicle waiting as shown in FIG. 25A to join a pod receives notification of events that permit it to join the pod safely and efficiently. Such notification may include, without limitation, the time remaining until traffic signal changes color, as well as other information that would prompt the driver to enter the pod, such as a preliminary notification that they will be instructed to join the next pod, a countdown to start of acceleration necessary to join the pod, either at the front or rear, and a target speed to reach on acceleration. The driver notification may include but not be limited to visual stimuli in graphical, digital, analog, numerical, or color-coded displays, audio stimuli in the form of voice or tones, or touch stimuli in the form of vibration or motion.

As the TCD system in the preferred embodiment has the capability to monitor the cars compliance with instructions for entering pods, it is also possible to log such data and quantify the driver's reliability and hence skill in performing such maneuvers. Thus, it is desirable to constantly evaluate the driver's adherence to the traffic laws, and ability to drive their vehicles in accordance with the system recommendations for maintaining constant speed, accelerating, decelerating, and executing lane changes. In addition, a driver's reaction time and smoothness of driving style may also be factored into the evaluation. More preferably drivers are ranked or scored based on these evaluations. When drivers enter the TCD system, it is most preferable that their placement at the front of the pod only occur when they have demonstrated a pattern of skill and instruction compliance that it is likely that the entry to the pod will not be dangerous or slow the pod, if they do not have such a rating then they would be placed at the rear of the pod, due to a lower ranking. Further, as the last car in a pod can safely de-accelerate without changes lanes when it desires to exit the pod, it is also preferable to arrange or order cars in a pod with the last car exiting first. Thus, it is also preferable to take both skill ranking and the vehicles intended exit location, which can be communicated with the traffic control system via the vehicle's GPS navigation plan, into account when deciding which pod a car should enter. Thus, drivers with the lowest skill ranking would only enter at the end of a pod of cars when they will be the first car in the pod to leave the pod. Furthermore, in an alternative embodiment, continuous evaluation of driving performance would be performed by the TCD. At any occurrence of driver error or inattentiveness this would allow it to immediately re-order the vehicles within a pod, placing the erring driver toward the rear.

Further, another aspect is providing rules of traffic flow that enable pods or clusters of vehicles to travel unimpeded by vehicles that are not capable of communication with the traffic control system that manages pod formation. For example, vehicles not participating in the traffic control system would not be allowed to pass pods and/or travel on the same lane or possible roadway as pods.

Figure 26:
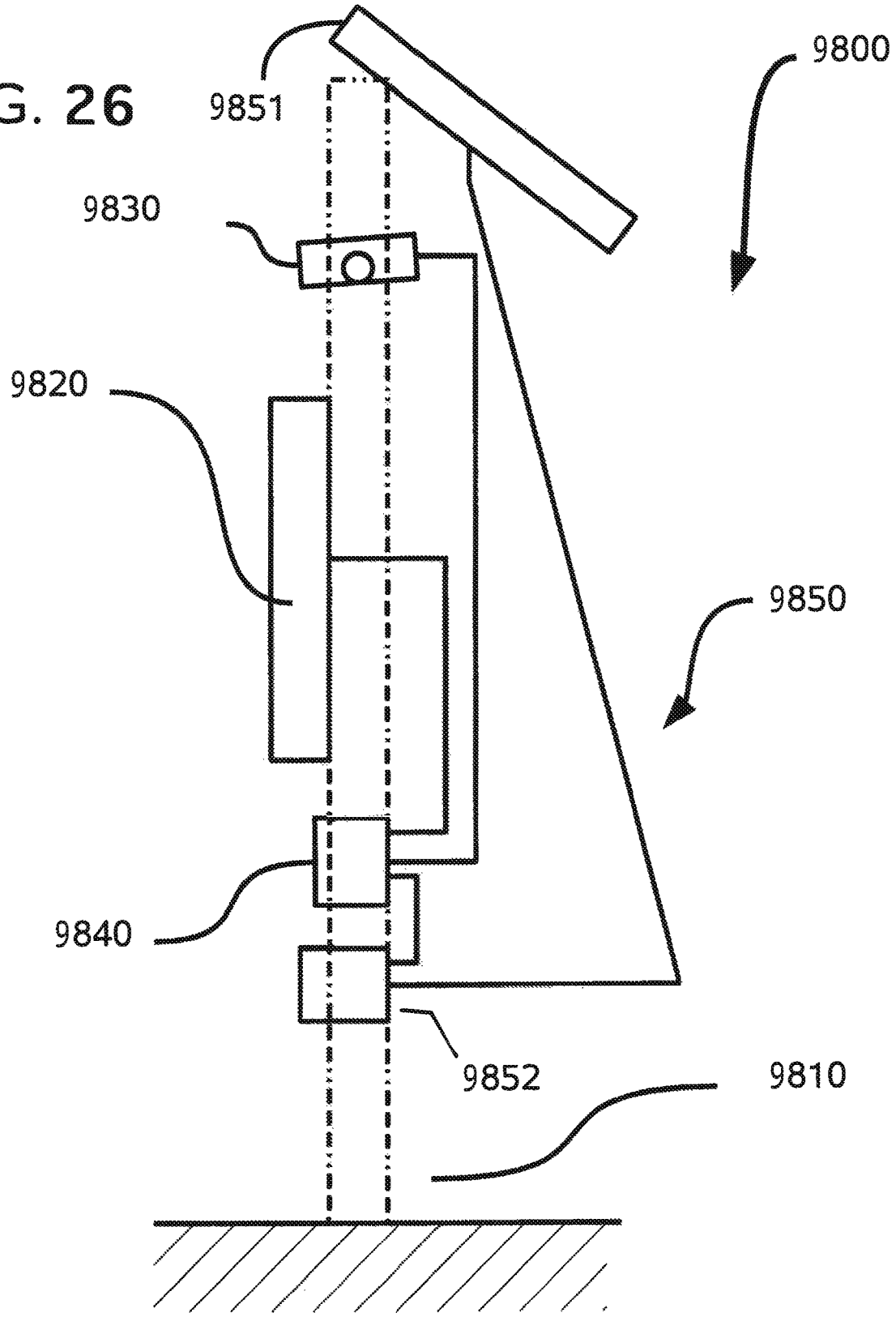
FIG. 26 is a schematic cross-sectional elevation of an agile traffic sign.

In FIG. 26, there is illustrated yet another embodiment in which an agile traffic signal device (ATSD) 9800 is shown, being mounted above the ground on structural support 9810. The ATSD comprises an electronic display 9820 in signal communication with a computation unit 9840. The computational unit 9840 is informed of the speed of approaching vehicles by the speed detector 9830. It is also an embodiment that such an ATSD 9800 can also act as a TCD and communicate with vehicles as described above, and in particular determining if the vehicle is compatible with the traffic control system automation and providing instructions as appropriate. For example, non-compatible vehicles might be directed to stop, rather than yield or directed to different lanes.

Figure 27A:
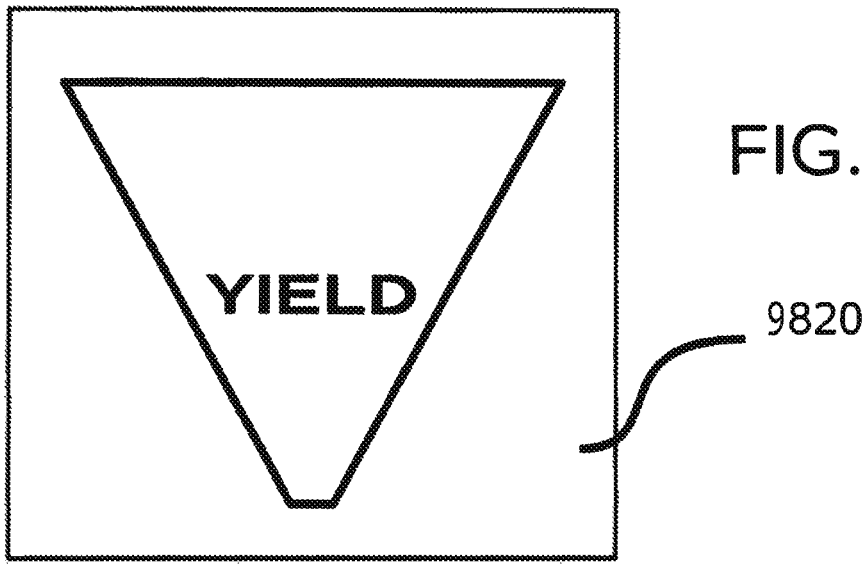
FIGS. 27A and 27B are elevations of the display portion of the agile traffic sign of FIG. 8 showing representative examples of alternative states.
Figure 27B:
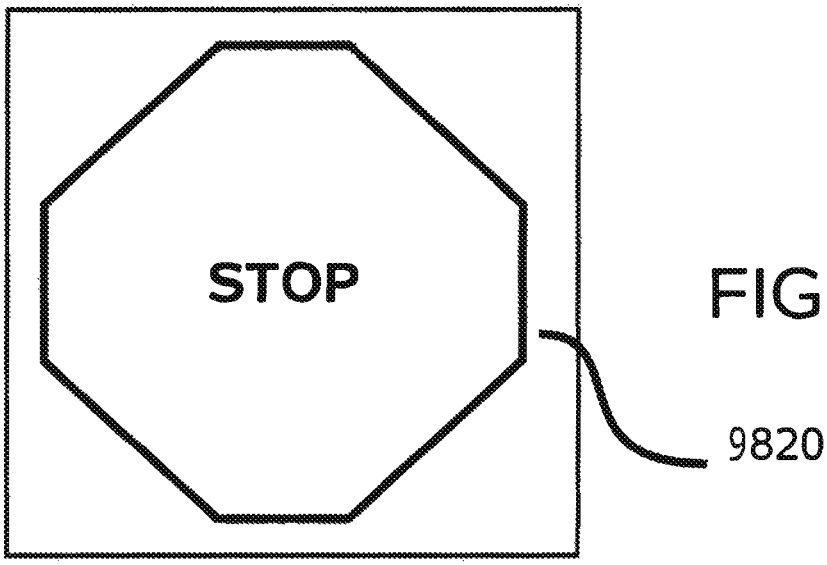

FIGS. 27A and 27B illustrate the ATSD as visible to drivers in different states determined by computational unit 9840 in response to the vehicle speed or acceleration as determined by motion sensor 9830. The motion sensor 9830 preferably measures the speed directly, such as a Radar gun or LASER beam speed detector and the like. The speed detector may optionally deploy proximity, pressure, or movement sensors embedded in the roadway. The vehicle speed is reported to the computational unit 9840. If the vehicle is traveling at a safe speed for the prevailing traffic conditions, including the presence of cross-traffic the vehicle is intended to merge into, the state of the sign remains as shown in FIG. 27A, a convention merge or yield sign. It is also an embodiment that such an ATSD 9800 can also act as a TCD and communicate with vehicles as described above, and in particular determining if the vehicle is compatible with the traffic control system automation and providing instructions as appropriate. For example, non-compatible vehicles might be directed to stop, rather than yield or directed to different lanes.

However, if it is determined that the vehicle is traveling too fast or road conditions are unsafe for any merge, then the computational unit 9840 is then operative to switch the display unit 9820 to that shown in FIG. 27B, where the vehicle is directed to stop. The display unit 9820 is optionally operative to be in the form of or display a conventional 3-color intersection control light (i.e., red, yellow, or green). In this mode, it is preferable that the agile sign 9800 have two or more vehicle detectors pointed at cross streets in the intersection. When it is detected that no vehicles are approaching the intersection in a first direction, the vehicles approaching in the cross-direction have a green light. However, if vehicles are approaching from both directions, vehicles from one direction would be scheduled to receive a red light, when the other vehicles cross, and would thus be alerted by the TCD to change speed in order to avoid having to stop, being scheduled to receive a green light as soon as the first set of one or more vehicles approaching in the cross direction pass the intersection. Thus, the ATSD 9800 would time the alternating red and green lights based on traffic demand, as well as communicate the signal timing as discussed in other embodiments.

The ATSD 9800 is optionally powered by direct wiring to a power source 9850, like most conventional traffic lights, or is optionally powered as shown by an overhead PV cell

9851, which more preferably continuously charges battery 9852, which directly powers computational unit 9840 and the display 9820.

Figure 28:
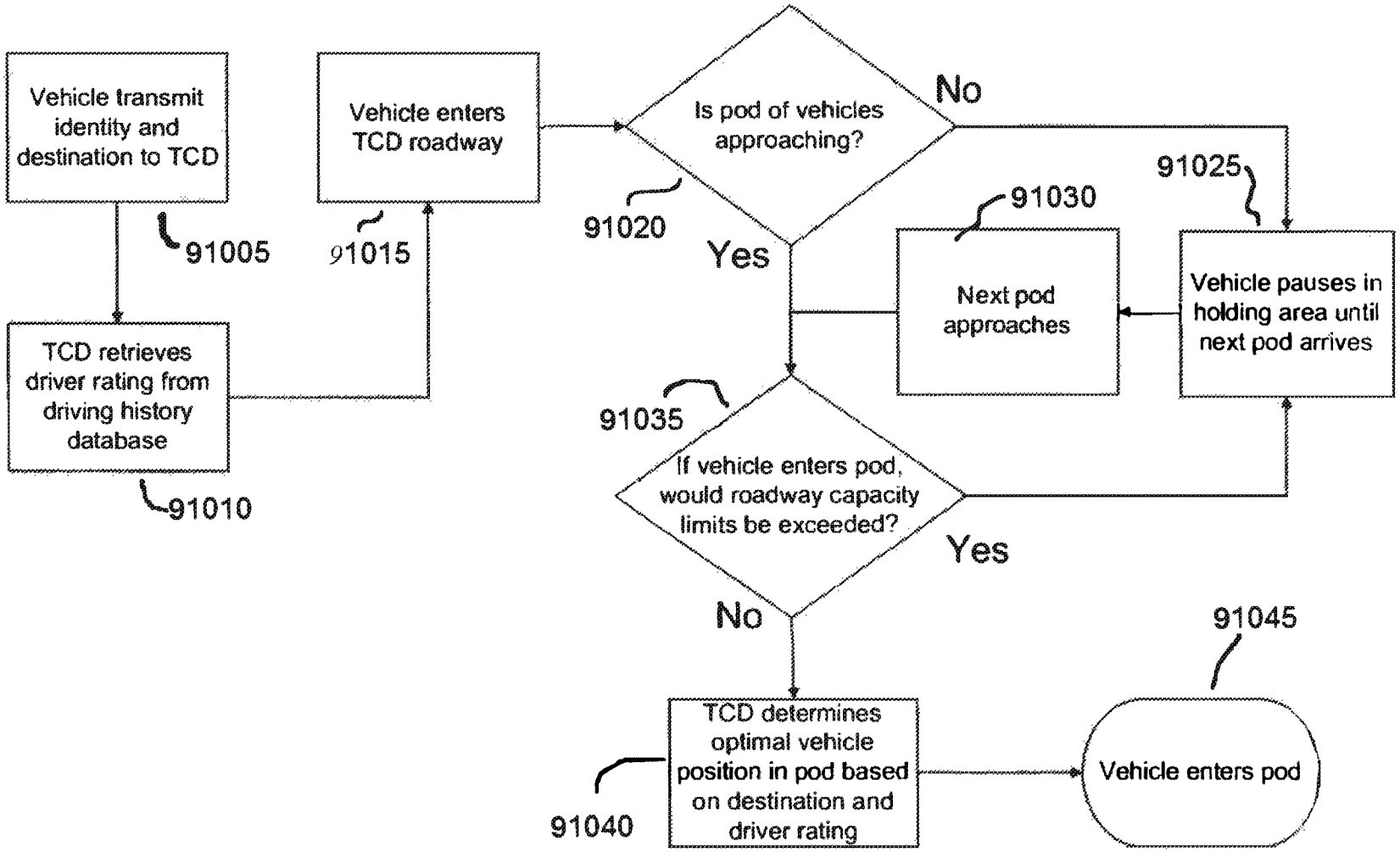
FIG. 28 is a flow chart of another embodiment for controlling and arranging vehicles in pods.

FIG. 28 is a flow chart illustrating the method by which the traffic control system manages the pod formation in accordance with the embodiments shown in FIGS. 23-25. In step 91005 the vehicle transmits its identity (and/or the driver identity) and destination to the traffic control system or TCD. Then the TCD retrieves the driver history the driving history database in step 91010. Then in step 91015 the vehicle enters the TCD controlled roadway, and is in communication with the traffic control system. The traffic control system in step 91020 determines if a pod of vehicles is approaching and if not (No branch) then the vehicles is directed in step 91025 to pause in a holding area, where it can await the arrival of the appropriate pod. Such location is optionally without limitation either at a holding lane or space or by travelling in a lower speed lane. When a pod is approaching, step 91030 or Yes branch from step 91020, the traffic control system determines if adding the subject vehicle to the pod would cause the roadway to exceed capacity, if Yes then the vehicle continues to hold, step 91025. If No, then in step 91040 the TCD or traffic control system determines the optimal position in the pod based on the driver destination, rating or a combination of the same. Depending on the determination in step 91040, the driver receives instructions or the vehicle is controlled by the traffic control system and enters the pod in step 91045.

Figure 29:
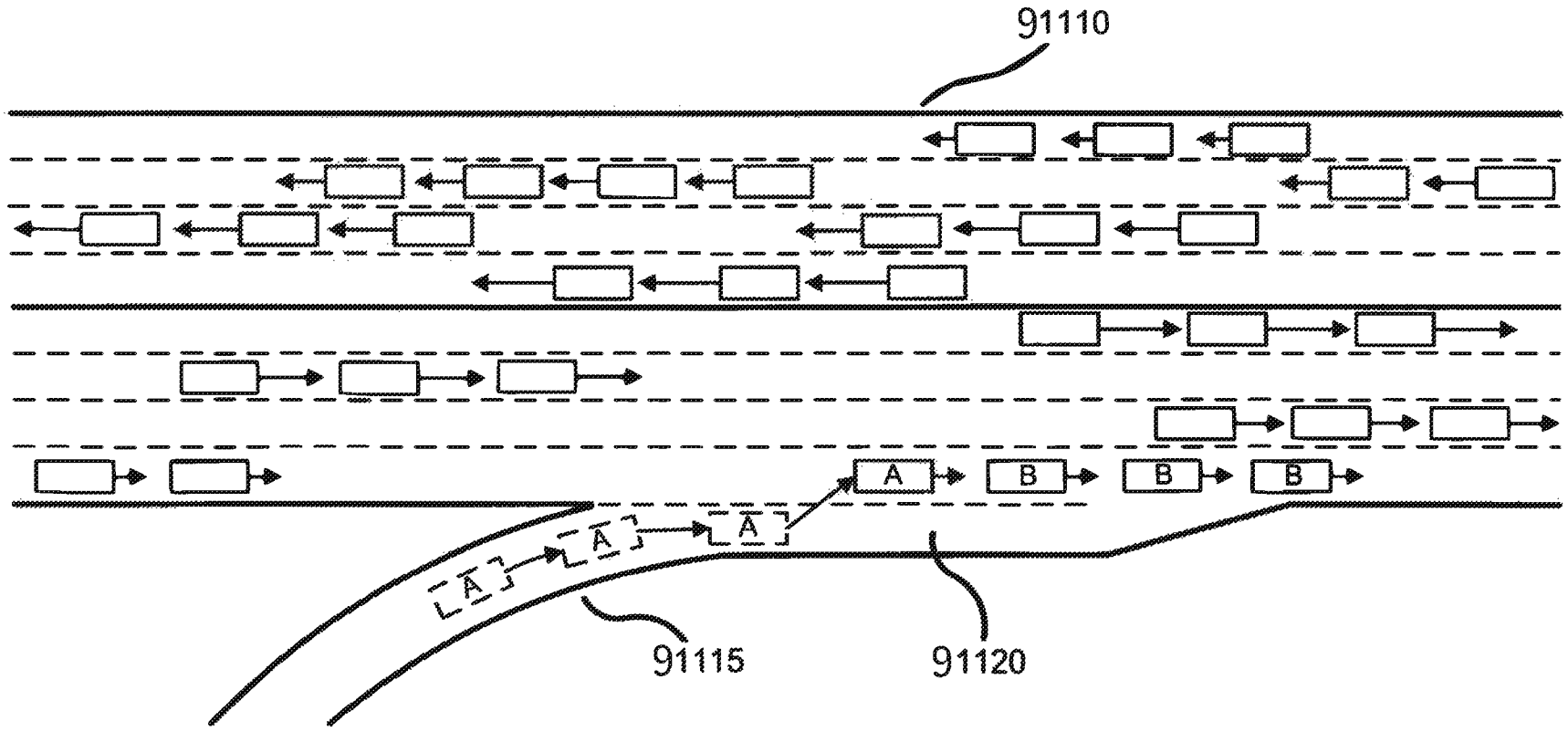
FIG. 29 is plan view of a high-speed multi-lane roadway illustrating an embodiment for optimizing flow on a highway or freeway.

In yet another aspect, freeway traffic can be more safely managed by transmitting to vehicles speed changes to help prevent major slowdowns or stops by better managing vehicles speeds as they approach congested traffic zones. Applications of this embodiment may include but are not limited to a highway, freeway, or a toll road. Radio/laser (or the like) receiver/sender devices could be used to keep track of all vehicle speeds and/or intended travel paths throughout an entire roadway system. This information could then be used to inform drivers as to optimum speeds, lane of travel, and travel plans/paths. This is illustrated in FIG. 29, which shows vehicles a grouped into pods and coordinated on a roadway having no stoplights. As depicted, holding area 91120 is located on the far-right lane or shoulder of the roadway. Prior to entering the roadway 91110, users are able to input their destination, as well as the desired speed of travel, or accept the default speed of the roadway. Using a procedure similar to that illustrated in FIG. 28, vehicle A enters the roadway 91110 via entrance ramp 91115, and if no suitable pod is available, pauses in holding area 91120. Vehicles are allowed to continue and enter a lane on the roadway 91110 only when a suitable pod approaches. In this case, pod suitability is also based upon the predetermined speed of travel. In the embodiment shown in FIG. 29, pods are arranged on the roadway 91110 lanes by speed, with the fastest in the left most lane and the slowest in the right most lane. Alternate embodiments may also utilize pods which span a plurality of lanes or all lanes. Once a suitable pod approaches, vehicle A accelerates and changes lanes in order to join vehicles in pod B. As previously described in earlier embodiments, position within the pod is determined both by vehicle destination and driver skill rating.

Vehicle following distance as shown in FIG. 29 is closely maintained using automatic onboard speed/brake controlling systems, as previously described in earlier embodiments. Vehicles traveling in pods in this manner have the benefits of the safety and allowance for the inherent lag in vehicle speed and direction changes that is afforded by the buffer spacing between pods. An additional advantage is the high density of vehicles within the pods, contributing to high rates of vehicle throughput on the roadway. A final advantage is the ability of the pod to accelerate, decelerate, or change lanes simultaneously as a group, in order to optimize roadway usage and avoid accidents, obstacles, dangerous conditions, or slowdowns. For instance, accident information could also indicate which lanes are blocked or have non-moving vehicles a mile ahead and could inform drivers when to change lanes and the approach speed. Vehicles that are in close proximity to each other could also exchange data between them to coordinate lane changes with each other, prioritize queue placement, and speed of travel.

The traffic control system may implement a method having at least one device to communicate discrete instructions to each vehicle in a plurality of vehicles. The traffic control system receives and transmits information about the location and speed of one or more vehicles in the plurality of vehicles. The method comprises: (i) instructing a first subset of vehicles to change speed to separate the plurality of vehicles into at least a first pod and a second pod, each pod comprising a subset of vehicles instructed to travel at the same speed with each vehicle in a pod being separated from each other vehicle in the pod by at least a first distance, (ii) instructing vehicles in the second pod to change speed so as to be separated from the vehicles in the first pod by a second distance, wherein the second distance is greater than the first distance, and (iii) prompting one or more vehicles to enter the first pod at a time determined by the speed and location of the first pod.

The foregoing method may also include prompting one or more vehicles to enter the first pod at a time determined by the speed and location of the first pod by providing a preliminary notification to one or more of the vehicles that they will be prompted to join the first pod. The foregoing method may also include prompting one or more vehicles to enter the first pod at a time determined by the speed and location of the first pod by providing a countdown to one or more of the vehicles of a time to join the first pod and a target speed to achieve to join the first pod. The foregoing method may also include employing at least a second device to visually communicate discrete instructions to the vehicles. The foregoing method may also include instructing the first pod to wait a buffered distance from an intersection, instructing the second pod to travel at a common speed so as to arrive at the intersection when a control signal is still green, and instructing the first pod to increase speed so as to travel behind the second pod and traverse the intersection together as a group of vehicles instructed to travel at the same speed, in the same direction, and on the same road, each vehicle being separated from other vehicles in its associated pod by a least the first distance. The foregoing method may also include determining that a pod has a length that exceeds a distance between two intersections on a road on which the pod is traveling; and coordinating timing of control signals at the two intersections to cause the control signal at a second of the two intersections to permit the pod to traverse the intersections as a group. The foregoing method may also include instructing the one or more vehicles entering the first pod to change speed so as to enter the first pod in reverse order according to each of the one or more vehicles' intended exit location.

The traffic control system may also implement a method of operating a traffic control system that controls movement of vehicles on one or more contiguous portions of a roadway, the portions not having any intersections, where the method comprises: (i) communicating discrete instructions to a plurality of vehicles; (ii) exchanging traffic control data with the plurality of vehicles, the traffic control data comprising at least one of current and desired speed and at least one of current and future position, wherein one or more of the plurality of vehicles is entering the roadway; and (iii) instructing the one or more vehicles entering the roadway when to change speed so as to join a pod composed of some of the plurality of vehicles, wherein each pod is composed of vehicles traveling at the same speed and in the same lane.

The foregoing method may also include a step where the pods are instructed to change speed or perform lane changes in order to optimize one or more of roadway usage, avoiding accidents, avoiding obstacles, avoiding dangerous conditions, or avoiding slowdowns. The foregoing method may also include the one or more vehicles desiring to enter the roadway are instructed to change speed to enter a pod in an order dependent upon at least one of the destination of each vehicle and the driving skill of each vehicle.

The traffic control system may also implement a method of controlling a vehicle traveling within a group of vehicles comprising: (i) receiving from a remotely located traffic control device that controls traffic flow through an intersection being approached by the vehicle, an identity, state, and an anticipated time of change of state of the traffic control device; (ii) determining a current position and a current speed of the vehicle relative to the intersection; and (iii) determining an appropriate speed of the vehicle to permit the vehicle to safely reach and traverse the intersection without stopping, whereby the vehicle changes the current speed to the appropriate speed and subsequently traverses the intersection together with other vehicles in the group of vehicles without coming to a stop.

The foregoing method may also include maintaining a following distance behind another vehicle traveling in front of the vehicle. The foregoing method may also include responding to a mapping system aboard the vehicle by causing the vehicle to alter a path being traveled to a secondary path. The foregoing method may also include effecting a left-hand turn at an intersection by responding to the traffic control device to cause a right-hand turn, followed by a U-turn and stopping at a holding line at a distance behind the intersection, and further responding to a green signal at the intersection by crossing the intersection. The foregoing method may also include the vehicle holding before making the U-turn. The foregoing method may also include the vehicle holding after making the U-turn. The foregoing method may also include effecting a left-hand turn at an intersection by responding to the traffic control device to cause a right-hand turn, responding to the traffic control device to pause in the right-hand lane or the shoulder; responding to the traffic control device to proceed to make a U-turn, and stopping at a holding line at a distance behind the intersection, and further responding to an anticipated time to change to a green signal at the intersection by crossing the intersection at the green signal. The foregoing method may also include the vehicle crossing the intersection at full speed and at a specified interval after the signal changes to green. The foregoing method may also include causing the vehicle to start moving from the holding line prior to occurrence of the green signal. The foregoing method may also include causing an indicator mounted to the vehicle to display one or more instructions to other vehicles.

The foregoing vehicle control systems and methods may be employed in a variety of ways in conjunction with the foregoing parking control and management system to increase the efficiency with which vehicles are directed along various roadways and freeways to an available parking destination that matches the requirements of drivers/passengers of the vehicle as disclosed in detail herein. While the invention has been described in connection with various preferred embodiments, it is not intended to limit the scope of the invention to the particular form set forth, but on the contrary, it is intended to cover such alternatives, modifications, and equivalents as may be within the spirit and scope of the invention as defined by the appended claims.

We claim:

1. A method of controlling movement of vehicles on one or more portions of a roadway, comprising:

communicating discrete instructions to a plurality of vehicles;

exchanging traffic control data with the plurality of vehicles, the traffic control data comprising at least one of current and desired speed and at least one of current and future position, wherein one or more of the plurality of vehicles is entering the roadway;

on contiguous portions of the roadway not having any intersections, instructing the one or more vehicles entering the roadway when to change speed so as to join a pod composed of some of the plurality of vehicles, wherein each pod is composed of vehicles traveling at the same speed and in the same lane;

receiving at a control system a target vicinity for at least one of the vehicles;

calculating an arrival time of each vehicle in its corresponding target vicinity;

identifying prospective parking locations within each target vicinity that are calculated to be empty;

generating an arrival time for each of the vehicles at each of the corresponding prospective parking locations;

allocating a parking location to each vehicle as a function of at least the arrival time; and causing information indicative of the allocated parking location to be provided to devices, each device associated with a vehicle.

2. The computerized method set forth in claim 1 wherein the step of identifying prospective parking locations further comprises retrieving data indicative of parking fees for each of the prospective parking locations and wherein the step of allocating a parking location further comprises retrieving data indicative of pricing preferences of at least a first individual associated with one of the vehicles and allocating a parking location as a function of a correlation between the pricing preferences and parking fees for each prospective parking location identified for the one of the vehicles.

3. The computerized method set forth in claim 1 wherein the step of identifying prospective parking locations within the target vicinity that are calculated to be empty further comprises identifying parking locations that are currently filled and that are expected to be empty by the arrival time for the vehicle for which the prospective parking locations are identified.

4. The computerized method set forth in claim 1 wherein the step of identifying prospective parking locations within the target vicinity that are calculated to be empty further comprises retrieving and processing restriction information pertaining to each parking location, the restriction information indicative of whether the vehicle for which the parking location is identified is permitted or able to park in the location.

5. The computerized method set forth in claim 1 wherein the step of identifying prospective parking locations within the target vicinity that are calculated to be empty further comprises transmitting to a device associated with at least a first vehicle repositioning information indicative of a new parking location for the at least first vehicle.

6. The computerized method set forth in claim 1 wherein each of the devices is a smartphone associated with a driver of a corresponding vehicle.

7. The computerized method set forth in claim 1 wherein each of the devices is a navigation device installed in a corresponding vehicle.

* * * * *